United States Patent [19]

Ito

[11] Patent Number: 4,864,365

[45] Date of Patent: Sep. 5, 1989

[54] AUTOMATED IMAGE DUPLICATING APPARATUS

[75] Inventor: Masazumi Ito, Aichi, Japan

[73] Assignee: Minolta Camera Kabushiki Kaisha, Osaka, Japan

[21] Appl. No.: 114,246

[22] Filed: Oct. 29, 1987

[30] Foreign Application Priority Data

| | | | |
|---|---|---|---|
| May 29, 1987 | [JP] | Japan | 62-135996 |
| Jun. 30, 1987 | [JP] | Japan | 62-162738 |
| Jun. 30, 1987 | [JP] | Japan | 62-162739 |

[51] Int. Cl.[4] ..... G03G 21/00

[52] U.S. Cl. ..... 355/207; 355/311

[58] Field of Search ..... 355/3 R, 35 H, 14 R, 355/14 SH, 14 C

[56] References Cited

U.S. PATENT DOCUMENTS

| | | | |
|---|---|---|---|
| 4,161,277 | 7/1979 | Steiner | 235/304 |
| 4,222,660 | 9/1980 | Furuichi et al. | 355/14 R |
| 4,275,958 | 6/1981 | Tachika et al. | 355/14 R |
| 4,453,821 | 6/1984 | Smith | 355/14 C |
| 4,568,173 | 2/1986 | Abuyama | 355/14 R |
| 4,652,113 | 3/1987 | Watanabe | 355/4 X |
| 4,668,075 | 5/1987 | Shigemura et al. | 355/14 SH |
| 4,693,459 | 9/1987 | Shimoda et al. | 355/14 SH X |
| 4,693,590 | 9/1987 | Umeda | 355/14 SH |

FOREIGN PATENT DOCUMENTS

| | | |
|---|---|---|
| 56-66865 | 6/1981 | Japan . |
| 58-7652 | 1/1983 | Japan . |
| 60-37567 | 2/1985 | Japan . |
| 60-93467 | 5/1985 | Japan . |
| 61-32868 | 2/1986 | Japan . |
| 62-62060 | 3/1986 | Japan . |

OTHER PUBLICATIONS

IBM Technical Disclosure Bulletin vol. 18, No. 10, Mar. 1976, pp. 3162–3163.

"Automatic Restoration of Interrupted Job", D. J. Conly, et al, IBM Technical Disclosure Bulletin, vol. 25, No. 11A, 4/83, pp. 5630–5632.

*Primary Examiner*—Fred L. Braun

*Attorney, Agent, or Firm*—Burns, Doane, Swecker & Mathis

[57] ABSTRACT

An automated image duplicating apparatus including the combination of a main module and a subsidiary module which is typically implemented by an automatic document feeder, wherein the apparatus has a variety of optional copying conditions and modes of operation available therein and including exceptional ones which can not be executed unless a predetermined requirement is fulfilled. If the optional conditions and modes of operation including the exceptional ones are requested without the predetermined requirement, the execution of the exceptional conditions and modes of operation are held in abeyance until the requirement is satisfied. When the predetermined requirement is satisfied thereafter, copying is performed in accordance with all the requested optional copying conditions and modes of operation including the exceptional ones. The predetermined requirement is typically the state of the automatic document feeder ready to operate, and the exceptional conditions and modes of operation typically include automatic paper-size and magnification/reduction ratio select modes.

18 Claims, 35 Drawing Sheets

DEFAULT ENABLE SUBROUTINE

G01
KEY-IN COMPLETE
NO
YES
START AUTO CLEAR TIMER
G02
G03
AUTO CLEAR TIMER ENDED
NO
YES
G05
A/C SWITCH ON
NO
YES
G04
PROGRAM ENABLED
YES
NO
ESTABLISH DEFAULT RULE CONDITIONS
G06
G07
ADF MODE
NO
YES
G08
SELECT APS MODE
G09
SELECT UPPER CASSETTE
RETURN

START

G01
KEY-IN COMPLETE
NO
YES
G10
MAIN DRIVE MOTOR STARTED
YES
NO
G11
START AUTO CLEAR TIMER
CLEAR AUTO CLEAR TIMER
G02
G03
AUTO CLEAR TIMER ENDED
NO
YES
G04
PROGRAM ENABLED
NO
YES
G05
A/C SWITCH ON
YES
NO
ESTABLISH DEFAULT RULE CONDITIONS
G06
G07
ADF MODE
NO
YES
G08
SELECT APS MODE
G09
SELECT UPPER CASSETTE
RETURN

I2

I19
INTERRUPTED DEV EXISTS
NO
YES
I20
SELECT INTERRUPTED DEV
I21
WARN FOR INTERRUPTED COLOR
I22
BOOK COPYING INTERRUPTED
NO
YES
I23
ADF MODE
YES
NO
I24
SELECT BOOK COPYING
I25
BOOK COPYING FLAG ← 1
I26
DUPLEX-DOCUMENT COPYING INTERRUPTED
NO
YES
I27
ADF MODE
NO
YES
I28
SELECT DUPLEX-COPYING MODE
I29
DUPLEX DOC'T FLAG ← 1
RETURN

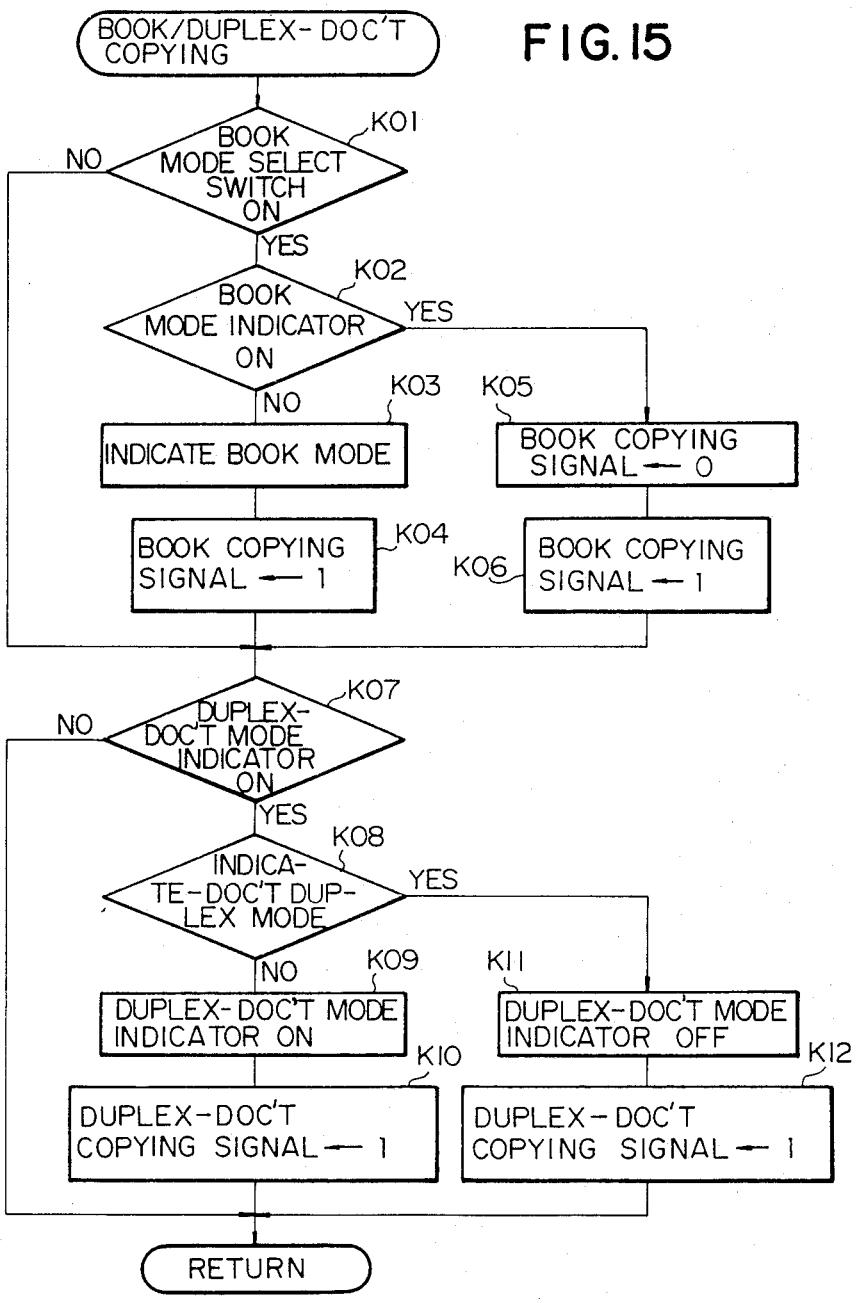
BOOK/DUPLEX-DOC'T COPYING
FIG. 15
K01
BOOK MODE SELECT SWITCH ON
NO
YES
K02
BOOK MODE INDICATOR ON
YES
NO
K03
K05
INDICATE BOOK MODE
BOOK COPYING SIGNAL ← 0
K04
BOOK COPYING SIGNAL ← 1
K06
BOOK COPYING SIGNAL ← 1
K07
DUPLEX-DOC'T MODE INDICATOR ON
NO
YES
K08
INDICA-TE-DOC'T DUP-LEX MODE
YES
NO
K09
K11
DUPLEX-DOC'T MODE INDICATOR ON
DUPLEX-DOC'T MODE INDICATOR OFF
K10
K12
DUPLEX-DOC'T COPYING SIGNAL ← 1
DUPLEX-DOC'T COPYING SIGNAL ← 1
RETURN

AUTOMATED IMAGE DUPLICATING APPARATUS

FIELD OF THE INVENTION

The present invention relates to an automated image duplicating apparatus and, more particularly, to an automated image duplicating apparatus which includes not only a main module implemented by a duplicator module but also a subsidiary module implemented by an automatic document feed module.

BACKGROUND OF THE INVENTION

An automated image duplicating apparatus of the type having an automatic document feed module in addition to a duplicator module is known. The automatic document feed module includes a lid structure to be opened and closed over the document table of the duplicator module and is adapted to automatically transport a document sheet to and from an exposure position on the table before and after duplication of the document sheet. When spread pages of a book or other form of bound volume of sheet mediums are to be copied, the lid structure of the automatic document feed module is opened out over the document table to provide access of the book to the exposure position on the table.

An automated image duplicating apparatus of this type ordinarily has not only such an automatic paper feed function but also other additional capabilities such as the automatic paper-size select function and automatic magnification/reduction ratio select function. The automatic paper-size select function is used to automatically select the size of copy sheets to be used upon detection of the size of a given document sheet when a certain magnification/reduction ratio is selected. The automatic magnification/reduction ratio select function is used to automatically calculate and establish a ratio in which the original image on a given document sheet is to be magnified or reduced on a copy sheet on which the original image is to be printed. The ratio of magnification or reduction is calculated also through detection of the size of the document sheet to be copied.

To perform either of these additional automatic functions, it is thus necessary to detect the size of the document sheet to be copied. For this reason, a duplicating apparatus having the automatic paper-size and magnification/reduction ratio select functions further has a capability of automatically measuring the sizes of document sheets to be copied. Such a paper-size detect function of the apparatus is effectively when, and only when, the automatic document feed module is in a state ready to operate with, for example, its lid structure closed on the document table. When the automatic document feed module is not in such a state, the paper-size detect function and accordingly each of the automatic paper-size and magnification/reduction ratio select functions of the apparatus could not be performed.

In the meantime, a newly developed version of an automated duplicating apparatus of the described type has further additional capabilities by means of which certain prescribed copying conditions and modes of operations are programmed as a package and stored in a memory device. Such capabilities are usefuly particularly where specific copying conditions and modes of operations are to be frequently or predominantly used. In order that the specifically selected copying conditions and modes of operation be programmed and stored into the memory device, it is also required that the automatic document feed module be in a state ready to operate. For this reason, to establish the ready state of the automatic document feed module is counted as one of the items included in the program consisting of the package of the selected copying conditions and modes of operation stored in the memory. When the data representative of such a program is fetched therefrom, the contents of the program are shown on a display area of the apparatus without respect to the modes of operation currently established in the apparatus. With all the programmed conditions and modes of operation thus displayed, a certain mode of operation such as, for example, the automatic paper-size select mode is inevitably included in the items on display although currently the automatic document feed module is not in a state ready to operate. On such an occasion, the operator of the apparatus would erroneously understand that the automatic document feed function is in effect and that he or she need not take an action to select the size of the copy sheets to be used. The result might be that the operator fails to perform the copying operation properly.

The present invention contemplates elimination of these drawbacks which have thus far been encountered in an automated duplicating apparatus equipped with an automatic document feed module and having various optionally selectable copying conditions and modes of operation.

SUMMARY OF THE INVENTION

In accordance with one outstanding aspect of the present invention, there is provided an image duplicating apparatus which comprises (a) image producing means for producing a visible image corresponding to an original image, (b) memory means, (c) data input means for entering into the memory means data representative of conditions in which the visible image is to be produced by the image producing means, (d) instruction output means for producing an instruction to fetch at least a portion of the data from the memory means, (e) discriminating means for determining whether or not the image producing means is, at a given point of time, in a state operable under the conditions represented by the data fetched from the memory means and discriminating at least one condition under which the image producing means is operable at the given point of time and at least one condition under which the image producing means is inoperable at the given point of time, (f) first control means for establishing, in the image producing means and substantially at the given point of time, the condition under which the image producing means is operable at the given point of time, (g) the memory means being further operative to memorize, substantially at the given point of time, the condition under which the image producing means is inoperable at the given point of time, and (h) second control means for establishing, in the image producing means, the condition under which the image producing means is inoperable at the given point of time, wherein the condition under which the image producing means is inoperable at the given point of time is established in the image producing means by the second control means if and when the image producing means is thereafter determined by the discriminating means to be in a state operable under the condition under which the image producing means is inoperable at the given point of time.

In accordance with another outstanding aspect of the present invention, there is provided an image duplicating apparatus which comprises (a) image producing means for producing a visible image corresponding to an original visible image on a sheet medium, the image producing means comprising a support member on which the sheet medium is to be placed, (b) transport means for automatically moving the sheet medium into and out of a desired position on the support member, the transport means being movable between a first position operative to move the sheet medium into and out of the desired position and a second position allowing manual placement of the sheet medium on the support member, (c) the image producing means and the transport means being operatively coupled together under a predetermined state, (d) mode designating means for designating a mode of operation to be performed through cooperation between the image producing means and the automatic transport means, (e) means for detecting whether the transport means is in the first position or in the second position, (f) first control means responsive to the designation by the mode designating means and operative, when the transport means is detected to be in the first position thereof, for establishing in both of the image producing means and the transport means, the mode of operation designated by the mode designating means, and (g) second control means responsive to the designation by the mode designating means and operative, when the transport means is detected to be in the second position thereof, for memorizing the mode of operation designated by the mode designating means and, when the transport means is thereafter detected to be in the first position thereof, establishing in both of the image producing means and the transport means the mode of operation designated by the mode designating means.

In accordance with still another outstanding aspect of the present invention, there is provided an image duplicating apparatus which comprises (a) a main module for producing a visible image corresponding to an original image, (b) a subsidiary module having a first state operable in combination with the main module and a second state operatively uncoupled from the main module, (c) memory means, (d) data input means for entering into the memory means data representative of conditions in which the visible image is to be produced by the main module, (e) instruction output means for producing an instruction to fetch at least a portion of the data from the memory means, (f) detecting means for detecting whether the subsidiary module is in the first condition or in the second condition, (g) discriminating means responsive to the instruction produced by the instruction output means for discriminating out of the conditions represented by the data fetched from the memory means, those conditions which are related to the subsidiary module, and (h) means for establishing the conditions related to the subsidiary module depending on the first or second state of the subsidiary module.

BRIEF DESCRIPTION OF THE DRAWINGS

The features and advantages of an automated image duplicating apparatus according to the present invention will be more clearly appreciated from the following description taken in conjunction with the accompanying drawings in which:

FIG. 15 is a flowchart of a book/duplex-document copying mode subroutine program included in the main routine program illustrated in FIG. 5;

DESCRIPTION OF THE PREFERRED EMBODIMENTS

Figure 1:
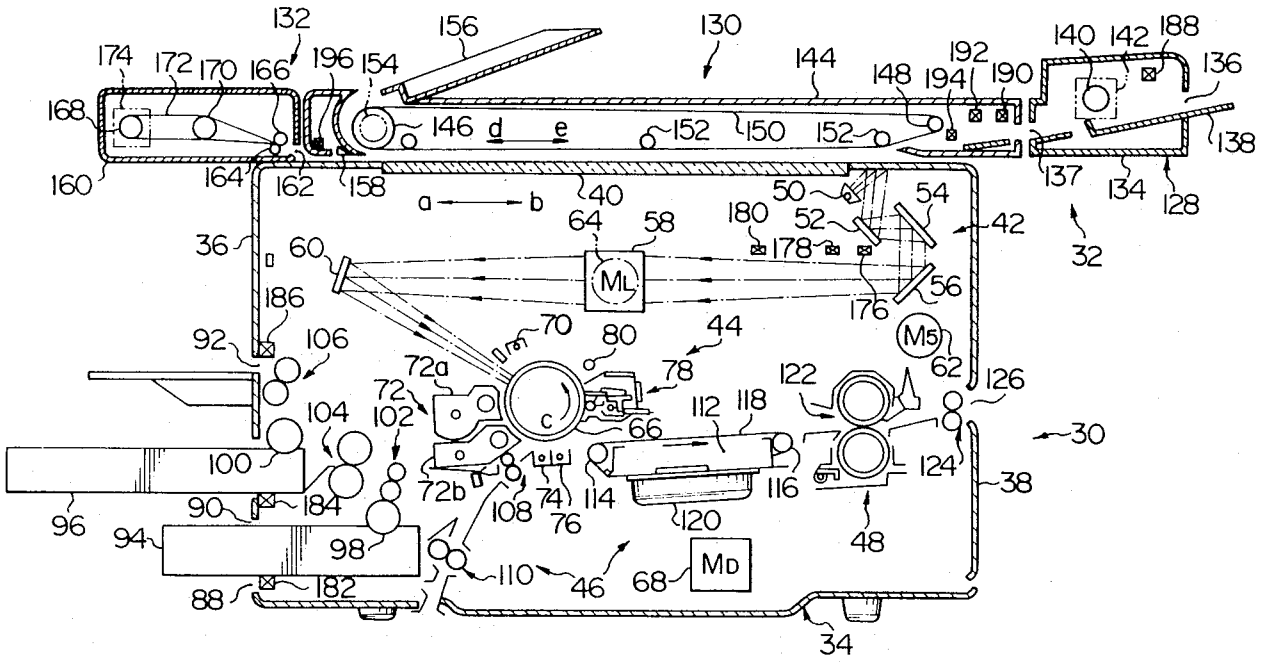
FIG. 1 is a side elevation view showing the general mechanical construction and arrangement of a preferred embodiment of an automated image duplicating apparatus according to the present invention.

A preferred embodiment of an automated image duplicating apparatus according to the present invention will be hereinafter described with reference to the drawings, first particularly to FIG. 1 which shows the general mechanical construction and arrangement of such an embodiment.

The automated image duplicating apparatus herein shown is of the type incorporating an automatic document feed (ADF) function and largely consists of a main module implemented by an electrophotographic duplicator module 30 and a subsidiary module implemented by an automatic document feed module 32 positioned on the duplicator module 30.

MAIN OR DUPLICATOR MODULE 30

The electrophotographic duplicator module 30 implementing the main module of the apparatus embodying the present invention comprises a housing structure 34 having vertical front and rear panel portions 36 and 38. The housing structure 34 further has a horizontal upper panel portion which is in part provided by a stationary, transparent document table 40 of, typically, glass. A sheet of document bearing images to be reproduced is to be placed on this document table 40 with the image bearing face of the sheet directed downward, as indicated at S. In the description to follow, a "document sheet" refers to a sheet medium bearing a printed, written or otherwise visible image on at least one side of the medium and "document" refers to a plurality of such document sheets which may be stacked on one another. On the other hand, a "copy sheet" refers to an output of the image duplicating apparatus and accordingly to a sheet medium bearing an image duplicated from a document sheet.

The main module 30 of the image duplicating apparatus further comprises an optical scanning system 42, an image reproducing arrangement 44, a paper feed-in and feed-out mechanism 46 and an image fixing assembly 48. The optical scanning system 42 is provided for optically scanning the image-bearing page of a document sheet S placed on the document table 40 and supplying the image reproducing arrangement 44 with light carrying the image information thus read from the document sheet S. The image reproducing arrangement 44 is responsive to this image information and is operative to reproduce or print the images visibly on a supplied copy sheet by an electrophotographic process. The copy sheet is supplied from the paper feed-in and feed-out mechanism 46, which is further operative to transport the printed copy sheet to the image fixing assembly 48 so that the images on the copy sheet are stabilized or fixed by application of heat and/or pressure. These optical scanning system 42, image reproducing arrangement 44, paper feed-in and feed-out mechanism 46 and image fixing assembly 48 are all accommodated within the housing structure 34.

Optical scanning system 42

The optical scanning system 42 as a whole is positioned below the upper panel portion of the housing structure 34 and comprises an exposure light source implemented by, for example, a halogene exposure lamp 50 positioned immediately below the document table 40 and an object mirror 52 positioned below and slightly at the rear of the lamp 50. The exposure lamp 50 is located and directed to be capable of illuminating the lower face of the document sheet S placed on the document table 40 through the transparent document table 40 when electrically energized. Thus, the light emitted from the lamp 50 is incident on and reflected from the lower face of the document sheet S through the document table 40 and is downwardly incident, backwardly through the document table 40, onto the object mirror 52 from which the light is re-directed rearwardly. The exposure lamp 50 and object mirror 52 are supported on a common carrier, or lamp carrier, which is movable back and forth in parallel with the document table 40 as indicated by arrows a and b. The lamp carrier thus supporting the lamp 50 and mirror 52 has, with respect to the document table 40, a predetermined home position having the lamp 50 and mirror 52 positioned slightly off one longitudinal end of the document table 40 as shown. Guide means is provided which includes a guide rod horizontally extending between the front and rear panel portions 36 and 38 of the housing structure 34. The lamp carrier supporting the lamp 50 and mirror 52 is movable on and along this guide rod, though not shown in the drawings. The distance of movement of the lamp carrier out of and back into its home position is such that a practically entire area of the document table 40 can be covered by the illumination from the lamp 58.

The optical scanning system 42 further comprises a mirror 54 positioned at the rear of the object mirror 52, and a mirror 56 positioned below the mirror 54. The mirrors 54 and 56 are supported on a common carrier, or mirror carrier (not shown), which is also movable in parallel with the document table 40 into and out of a home position having the mirrors 54 and 56 located as shown. The light reflected rearwardly by the object mirror 52 is thus re-directed toward the mirror 54, which further re-directs the light downwardly toward the mirror 56. From the mirror 56, the light travels forwardly in parallel with the document table 40 and is passed through an image magnification/reduction lens unit 58 to a projecting mirror 60. The lens unit 58 is supported on a carrier, or lens carrier, (not shown) which is also movable in parallel with the document table 40 independently of the exposure lamp 50 and mirrors 52, 54 and 56 with the projecting mirror 60 held stationary with respect to the housing structure 34. Movement of the lens unit 58 in either direction with respect to the stationary projecting mirror 60 results in a change in the ratio of magnification or reduction of the images to be reproduced. It is assumed that a life-sized or one-to-one copying mode is to be established when the lens unit 58 is held in its home position as shown.

In the optical scanning system 42 thus constructed and arranged, the exposure lamp 50 and object mirror 52 and the movable mirrors 54 and 56 implement a document scanner or document scanning means. It may be herein noted that, in the description to follow, the document scanner thus implemented by the lamp 50 and mirrors 52, 54 and 56 has a home position represented by the home position of the lamp carrier supporting the lamp 50 and mirror 52. The lamp carrier and the carrier supporting the mirrors 54 and 56 are coupled to appropriate common drive means and are driven for movement such that the former travels at a speed doubling the speed of movement of the latter. Such common drive means is assumed to include a reversible d.c. motor 62 which will be herein referred to as scanner drive motor ($M_S$). The lens carrier supporting the lens unit 58 is also coupled to appropriate drive means provided indepedently of the scanner drive motor 62. The drive means thus coupled to the lens carrier is assumed to include a pulse-driven stepper motor 64 which will be herein referred to as lens drive motor ($M_L$).

Image reproducing arrangement 44

The image reproducing arrangement 44 of the apparatus embodying the present invention is largely positioned below the path of light through the lens unit 58 and comprises a cylindrical, photosensitive image transfer drum 66 having an electrically conductive peripheral surface layer coated with a photoconductive substance such as typically selenium. The light incident on the image reproducing arrangement 44 is re-directed toward this image transfer drum 66 and is focused onto the peripheral surface of the drum 66. Thus, a change in the position of the lens unit 58 with respect to the stationary projecting mirror 60 results in a change in the position of the lens unit 58 with respect to the peripheral surface of the image transfer drum 66. The image transfer drum 66 is rotatable about its center axis in a direction indicated by arrow c and is supported on a horizontally elongated drive shaft (not shown) coupled to appropriate drive means. The drive means for the image transfer drum 66 may be provided independently of the scanner drive motor 62 and is assumed to include a main drive motor ($M_D$) as schematically indicated at 68. The lamp 50 and mirror 52 and accordingly the mirrors 54 and 56 are driven for movement at speeds proportional to the peripheral speed (V) of rotation of the image transfer drum 66. On the other hand, a change in the position of the lens unit 58 with respect to the peripheral surface of the image transfer drum 66, in turn, results in alteration in the locations of the focal points of the lens unit 58 on a path of light from the lens unit 58 to the peripheral surface of the drum 66 and accordingly in a magnification or reduction ratio (N) of the images to be reproduced. In the embodiment herein shown, it is assumed by way of example that the lamp carrier supporting the lamp 50 and mirror 52 is driven for movement at a speed V/N and the mirror carrier supporting the mirrors 54 and 56 is driven for movement at a speed V/2N as is customary in the art. While the projecting mirror 60 of the optical scanning system 42 herein shown is assumed to be fixed with respect to the image transfer drum 58 as above noted, the mirror 60 may be arranged to be movable and/or rockable with respect to the drum 66 to allow adjustment of the path of light from the lens 58 to the drum 66. The image reproducing arrangement 44 further comprises charging, image developing, image transferring, drum cleaning and charge erasing stages which are all arranged around the image transfer drum 66. A main charging stage 70 is provided which is operative to sensitize the photoconductive peripheral surface of the image transfer drum 66 by applying positive electrostatic charges uniformly to the surface of the drum 66. The main charging stage 70 is located anterior, in the direction of rotation of the drum 66, to an exposure area through which the light from the projecting mirror 60 of the optical scanning system 42 is to be incident on the rotating image transfer drum 66. As well known in the art, positive electrostatic charges are dissipated in areas exposed to light and, for this reason, electrostatic latent images are created by remaining charges on the peripheral surface of the image transfer drum 66 upon illumination with the light from the mirror 60.

Posterior to the path of light to the drum 66 is positioned an image developer stage 72 which is shown consisting of two, upper and lower developing units **72*a* and 72*b* having respective stocks of printing powders or toner particles of different colors, respectively. The toner particles stored in a selected one of these developing units 72*a* and 72*b* are charged negatively by appropriate means and are applied to the photoconductive peripheral surface of the image transfer drum 66 thus carrying the electrostatic latent images. Visible toner images are in this manner produced conformingly to the latent images on the photoconductive peripheral surface of the drum 66. As will be described, a copy sheet (not shown) is fed by means of the paper feed-in and feed-out mechanism 46 and is brought into contact with the peripheral surface of the rotating image transfer drum 66 through a paper feed-in area immediately posterior to the image developer stage 72. The means for charging the toner particles stored in each of the developing units 72*a* and 72*b*** may comprise a magnetic brush (not shown) which may be actuated by a motor (not shown).

Posterior to this paper-feed area is positioned an image transfer charging stage 74 which is operative to charge the copy sheet positively so that the toner images produced on the peripheral surface of the image transfer drum 66 are transferred to the copy sheet. The copy sheet thus having the toner images carried thereon is cleared of charges by means of a separation charging stage 76 which is located posterior to the image transfer charging stage 74. Further posterior to the area where the copy sheet is separated from the image transfer drum 66, there is provided a drum cleaner unit 78 having a cleaning blade as shown or a cleaning brush which removes any residual toner particles from the peripheral surface of the drum 66. Posterior to this drum cleaner unit 78 in turn is positioned a charge eraser lamp 80 which irradiates the cleaned peripheral surface of the drum 66 to eliminate the positive charges which are likely to be left thereon. The photosensitive image transfer drum 66 now has a refreshed uniform surface potential throughout its width and is ready for a subsequent image reproducing process.

It will be apparent that the main charging stage 70, image developer stage 72, image transfer charging stage 74, separation charging stage 76, drum cleaner unit 78 and charge eraser lamp 80 include or are associated with appropriate drive or actuator means, though not shown in the drawings.

Paper feed-in and feed-out mechanism 46

The paper feed-in and feed-out mechanism 46 is provided in conjunction with lower and upper automatic paper supply slots 88 and 90 and a manual paper supply slot 92 which are formed through the front panel portion 36 of the housing structure 34. First and second paper supply cassettes 94 and 96 are detachably fitted to the housing structure 34 through the lower and upper paper supply slots 88 and 90, respectively, and have stocks of copy sheets of different sizes encased therein. The manual paper supply slot 92 is located above the upper automatic paper supply slot 90 and is provided to permit manual insertion of a copy sheet into the duplicating apparatus.

The paper feed-in and feed-out mechanism 46 per se comprises first and second paper feed rollers 98 and 100 rotatable on the stacks of copy sheets in the first and second automatic paper-feed cassettes 94 and 96, respectively. Each of the paper-feed rollers 98 and 100 is driven for rotation to pick up copy sheets one after another from the stack of paper in the cassette 94 or 96. A copy sheet picked up by the first paper feed roller 98 is guided directly toward the image transfer drum 66. The feed roller 98 is held in rollable contact with one of a first pair of guide rollers 102 which are held in rollable contact with each other, both of the rollers 102 being provided as idlers which are to be driven for rotation by means of the feed roller 98. The guide rollers 102 are located in the vicinity of a second pair of guide rollers 104 which are held in rollable contact with each other and which are located between the second paper feed roller 100 and the first pair of guide rollers 102. One of the second pair of guide rollers 104 is provided as an idler and the other as a driven roller. A copy sheet picked up by the second paper feed roller 100 is first passed between the second pair of guide rollers 104 and subsequently between the first pair of guide rollers 102 and is thereafter directed toward the image transfer drum 66. A third pair of guide rollers 106 is provided past the manual paper supply slot 92 and is adapted to guide a manually supplied copy sheet from the slot 92 to the second pair of guide rollers 104 for transportation through the first pair of guide rollers 102 toward the image transfer drum 66. One of the third pair of guide rollers 106 is also provided as an idler and the other as a driven roller. Each of the first and second paper feed rollers 98 and 100 is operatively connected to the main drive motor 68 through appropriate actuator means such as a solenoid-operated clutch (not shown).

In the vicinity of the paper feed-in area located immediately posterior to the image developer stage 72 of the image reproducing arrangement 44 is provided a pair of timing rollers 108 which are held in rollable contact with each other, one of the rollers 108 being provided as an idler and the other as a driven roller. A copy sheet passed directly from the first paper feed roller 98 or through the first pair of guide rollers 102 is passed to the timing rollers 108. The timing rollers 108 are driven for rotation at a timing synchronized with the movement of the optical scanning system 42 and are thus held at rest until such a timing is reached. If the copy sheet happens to skew while travelling toward the timing rollers 108, the copy sheet is caused to buckle with its leading edge detained at the nip between the rollers 108. The skewed copy sheet is in this fashion enabled to correct its path of travel when the rollers 108 are actuated to turn and the copy sheet is allowed to pass between the rollers 108. Thus, the timing rollers 108 implement not only means for timing the attachment of a copy sheet to the image transfer drum 66 but also copy-sheet registration means for correcting the path of travel of a copy sheet toward the image transfer drum 66.

Indicated at 110 is a fourth pair of guide rollers which may be provided to guide toward the timing rollers 108 a copy sheet supplied through the bottom of the housing structure 34 from any additional paper storage unit or units. Such an additional paper storage unit or units may be accommodated within any structure underlying or supporting the image duplicating apparatus, though not shown in the drawings. Accordingly, the paper feed-in and feed-out mechanism 46 of the duplicator module 30 herein shown has a total of four different paths available for feeding a copy sheet to the image transfer drum 66 of the image reproducing arrangement 44. A first path of travel toward the drum 66 extends from the first paper feed roller 98 directly to the timing rollers 108. A second path of travel extends from the second paper feed roller 100 to the timing rollers 108 past the first pair of guide rollers 102. A third path of travel extends from the third pair of guide rollers 106 to the timing rollers 108 through the second pair of guide rollers 104 and past the first pair of guide rollers 102. A fourth path of travel toward the drum 66 extends from the fourth pair of guide rollers 110 directly to the timing rollers 108.

It will be apparent that each of the paper feed rollers 98 and 100, guide rollers 102, 104 and 106 and timing rollers 108 as above described has an axis of rotation parallel with the axis of rotation of the image transfer drum 66. The driven rollers among these various rollers are driven for rotation from the main motor 68 through appropriate belt-and-pulley, chain-and-sprocket or gear arrangements, though not shown in the drawings. Each of the first and second paper feed rollers 98 and 100 and one of the timing rollers 108 in particular is operatively connected to the main drive motor 68 through a solenoid-operated clutch (not shown) in addition to such mechanical transmission arrangements.

The paper feed-in and feed-out mechanism 46 further comprises a copy-sheet transport belt assembly 112 positioned posterior to the area where the copy sheet with the toner images carried thereon is separated from the image transfer drum 66. The copy-sheet transport belt assembly 112 comprises spaced, parallel, driven and idler rollers 114 and 116 and an endless transport belt 118 passed between the rollers 114 and 116. The transport belt 118 may be formed with perforations (not shown) for use in combination with any suction generator unit 120 such as a suction fan. The suction induced by such a suction generator unit 120 acts, through the perforations in the belt 118, on the copy sheet being transported on the belt 118 and retains the copy sheet to the surface of the belt 118 until the copy sheet is released from the belt 118.

Image fixing assembly 48

The image fixing assembly 48 is provided immediately posterior to the transport belt assembly 112 arranged as above described and comprises a pair of heater rollers 122 arranged to have a nip aligned with the path of travel of a copy sheet from the transport belt assembly 112. The copy sheet transported on the transport belt 118 is thus nipped between the heater rollers 122 so that the toner particles carried on the copy sheet are fused and accordingly the toner images are fixed on the copy sheet. The copy sheet released from the rollers 122 is withdrawn out of the duplicator module 30 through a pair of paper discharge rollers 124 positioned posterior to the heater rollers 122 and a paper discharge slot 126 provided in the rear panel portion 36 of the housing structure 34.

SUBSIDIARY OR ADF MODULE 32

The automatic document feed module 32 implementing the subsidiary module of the image duplicating apparatus embodying the present invention is positioned on the duplicator module 30 constructed and arranged as hereinbefore described.

The automatic document feed module 32 largely comprises a document supply unit 128, a document transport unit 130 and a document recirculation unit 132 which are arranged horizontally in this sequence in a direction of forward advancement of document sheet as indicated by arrow d. The document supply unit 128 comprises a housing 134 having inlet and outlet slots 136 and 137, a document supply tray 138 extending into the housing 134 through the inlet slot 136, and a document feed roller 140 positioned on top of the document supply tray 138. The document feed roller 140 is driven for rotation by means of a roller drive motor also positioned within the housing 134 as schematically indicated at 142. A stock of document sheets (not shown) each of which is to be copied is placed on the document supply tray 138 through the inlet slot 136 so that the individual document sheets can be supplied one after another to the document transport unit 130 through the outlet slot 137 in the housing 134.

This document transport unit 130 comprises a lid structure 144 and is arranged to be rockable in its entirety away from and toward the document table 40 about an axis extending lengthwise of the unit 130. The lid structure 144 has carried on its lower or inner face a conveyor mechanism comprising driven and idler rollers 146 and 148 spaced apart in parallel from each other and positioned in the vicinity of the front and rear ends, respectively, of the document transport unit 130. An endless transport belt 150 is passed between these rollers 146 and 148 and has a lower travelling path portion which extends in parallel with the document table 40 and which is to travel in the direction of advancement d of document sheet. The document transport unit 130 as a whole is thus rockable between a "closed" or first angular position having the lower travelling path portion of the belt 150 held in slidable contact with the upper face of the document table 40 as herein shown and an "open" or second angular position angularly spaced apart from the document table 40. When the document transport unit 130 is turned into the open position, manual access is allowed to the upper face of the document table 40 so that the operator is permitted to manually place a document sheet on the document table 40. Between the driven and idler rollers 146 and 148 are arranged guide and pressing rollers 152 which are held in rollable contact with the inner surface of the lower travelling path portion of the belt 150. The guide and pressing rollers 152 serve to press the lower travelling path portion of the belt 150 slidably against the upper face of the document table 40 when the document transport unit 130 is maintained in the closed position. The driven roller 146 is driven for rotation about its center axis by means of a belt drive motor which is schematically indicated at 154. A document sheet supplied from the document supply unit 128 to the document transport unit 130 is moved by the transport belt 150 to a correct "exposure position" on the document table 40 and is ready to be scanned by the optical scanning system 42 of the duplicator module 30. After the document sheet set on the document table 40 is thus scanned by the optical scanning system 42, the particular document sheet is either withdrawn to a document recovery tray 156 forming part of the lid structure 144 or passed over to the document recirculation unit 132. The selection between these two modes of handling is automatically made by shift means which includes a solenoid-operated document withdraw/recirculate shifter 158 located between the document feed and recirculation units 130 and 132. The withdraw/ recirculate shifter 158 may be provided in the form of an array of pawls arranged in a direction perpendicular to the direction of advancement d of document sheet. Typically a document sheet bearing images only on one side thereof is to be withdrawn to the document recovery tray 156 and a duplexed document which bears images on both sides thereof may be carried over to the document recirculation unit 132.

Such a document recirculation unit 132 comprises a housing 160 having a document inlet/outlet slot 162 located adjacent the foremost end of the document transport unit 130. Immediately posterior to the document inlet/outlet slot 162 in the direction of advancement d of document sheet are provided feed-in and feed-out rollers 164 and 166 spaced apart from each other and an additional feed roller (not shown) which is held in rollable contact with each of the feed-in and feed-out rollers 164 and 166. Within the housing 160 are further provided drive and idler rollers 168 and 170 spaced apart in part from each other and from the additional feed roller with an endless turnover belt 172 passed round the rollers 168 and 170 and the additional feed roller. The driven roller 168 is driven for rotation by means of a document recirculation drive motor which is schematically indicated at 174.

A duplexed document sheet having one of its image bearing pages scanned on the document table 40 may thus be forwarded toward the document recirculation unit 132 past the document withdraw/recirculate shifter 158 and enters the recirculation unit 132 through the document inlet/outlet slot 162. The document sheet is first passed between the feed-in roller 164 and the additional feed roller for being conveyed on the outer surface of the turnover belt 172 with the aid of appropriate guide means (not shown). The document sheet thus conveyed on the turnover belt 172 is turned back round the driven roller 168 and is passed between the feed-out roller 166 and the additional feed roller toward the document inlet/outlet slot 162. By this point of time, the belt drive motor 148 is actuated to turn in the opposite direction indicated by arrow e so that the document sheet fed back to the document transport unit 130 is caused to travel on the document table 40 backwardly toward the rear end of the document table 40. Upon arrival of the document sheet at the correct exposure position on the document table 40, the image bearing reverse side of the document sheet is scanned by the optical scanning system 42 of the duplicator module 30 and is thereafter transported forwardly on the document table 40 for being withdrawn to the document recovery tray 156.

SENSORS AND DETECTORS

The automated image duplicating apparatus embodying the present invention further comprises various sensors and detectors arranged within the main and subsidiary modules. These sensors and detectors include a home position sensor 176 and first and second scan timing sensors 178 and 180 which are located in association with, for example, the lamp carrier supporting the lamp 50 and mirror 52. The home position sensor 176 is responsive to the home position of the document scanner as represented by the home position of the lamp carrier as previously noted and is operative to produce an output signal in the presence of the lamp carrier in the home position of the scanner. On the other hand, the first and second scan timing sensors 178 and 180 are responsive to the movement of the document scanner including the exposure lamp 50 and object mirror 52. These sensors 176, 178 and 180 are operative to produce signals successively as the lamp carrier is driven for movement from its home position with respect to the document table 40. These sensors 178 and 180 are thus operative to produce signals successively at different timings as the lamp carrier is driven for movement from its home position with respect to the document table 40. At an instant the lamp carrier is initiated into movement from the home position, the first scan timing sensor 176 produces a digital output signal indicative of the timing at which the scanning operation is started. Upon movement of the lamp carrier over a first predetermined distance from the home position, the second scan timing sensor 178 produces a digital output signal indicative of the timing at which the lamp carrier has reached such a position from the home position. At a point of time the lamp carrier is thereafter moved a second predetermined distance from the home position, the third scan timing sensor 180 produces a digital output signal indicative of the particular point of time.

The sensors and detectors provided in the image duplicating apparatus further include first and second paper size sensors 182 and 184 located in the vicinity of the lower and upper automatic paper supply slots 88 and 90, respectively, in the housing structure 34. These paper size sensors 182 and 184 are responsive to the sizes of the copy sheets stored in the first and second paper supply cassettes 94 and 96, respectively, and operative to produce digital output signals indicating the detected sizes of copy sheets. Each of such paper size sensors 182 and 184 may be such as to detect any discernible feature such as the pattern in which magnetic elements are attached to the associated one of the cassettes 94 and 96 or characterizing lugs are provided on the cassette. A sensor 186 may also be provided which is responsive to insertion of a copy sheet through the manual paper supply slot 92.

In the automatic document feed module 32 of the image duplicating apparatus is further provided a document sensor 188 located in conjunction with the document supply tray 138 of the document supply unit 128. The document sensor 188 is responsive to the presence or absence of at least one document sheet on the document supply tray 138 and is operative to produce a digital output signal in the presence of a document sheet on the tray 138. On the other hand, the document transport unit 130 has provided therein a document size sensor 190 and a document feed sensor 192. The document size sensor 190 is located adjacent the inlet of the document transport unit 130 and is responsive to the size, viz., the length and width of a document sheet passed from the document supply unit 128 for producing a digital output signal representative of the detected size of the supplied document sheet. The document feed sensor 192 is responsive to passage of a document sheet into the document transport unit 130 to produce a digital output signal in response to a document sheet advancing into the document transport unit 130. Also provided in or associated with the document transport unit 130 is a transport unit position sensor 194 which is responsive to angular movement of the document transport unit 130 between the closed and open positions thereof and which is operative to produce a digital output signal in response to movement of the document transport unit 130 to the open position thereof. Further provided in the document transport unit 130 is a document recirculation detector 196 located in the vicinity of the document withdraw/recirculate shifter 158 and responsive to passage of a document sheet from the document transport unit 130 to the document recirculation unit 132 for producing a digital output signal in the presence of a document sheet being passed from the former to the latter unit.

The various functions achievable by the automated image duplicating apparatus embodying the present invention will be understood from the following description regarding the general configuration of a control panel forming part of the image duplicating apparatus. The control panel, denoted in its entirety by reference numeral 200 has various switches, indicators and display areas. Such a control panel 200 generally comprises a main module control section 202 which is predominant over or relating to the functions achievable by the duplicator module 30, and a subsidiary module control section 204 which is predominant over or relating to the functions achievable by the automatic document feed module 32.

In the main module control section 202 is provided a print start switch 206 (START) to start duplicating operation and a set of numerical switches 208 allocated to numerals 1, 2, . . . and 0, respectively. The numerical switches 208 may be used for entering a desired quantity of copy sheets to be printed for one or each of the document sheets to be duplicated, and a desired ratio in which the original image on the document sheet is to be magnified or reduced in size on a copy sheet. The quantity of copy sheets to be printed is displayed on a seven-segment display window 210 and can be cleared from a clear/stop switch 212 (C/S) also provided in the control section 202. The clear/stop key 212 is used also for cancelling the instruction once entered from the print start switch 206. During printing of a preset quantity of copy sheets for a given document sheet, another document sheet may be duplicated in an interrupt mode entered at an interrupt demand switch 214 (ID). The interrupt mode thus enabled from the interrupt demand switch 214 is displayed by an interrupt mode indicator **214*a* which is to be activated to illuminate when the switch 214 is depressed. The size of copy sheets to be used can be manually selected at a manual paper-size select switch 216 (SZ) from among a predetermined number of sizes available. The selected size of copy sheets is displayed by any one of first, second, third and fourth paper-size indicators 216*a*, 216*b*, 216*c* and 216*d* which are herein assumed to be assigned to the standardized A3, B4, A4 and B5 sizes, respectively, as shown. The paper-size select switch 216 is, in effect, operative to select one of the paper supply cassettes 94** and 96 currently assembled to the duplicator module 30 shown in FIG. 1.

Print density increment and decrement switches 218 and 220 (labelled as UP and DN, respectively) are provided to permit manual selection of a desired print density for the copy sheets to be printed. The print density for printing is stepwise incremented with the increment switch 218 depressed or decremented with the decrement switch 220 depressed. In conjunction with these switches 218 and 220 is provided a series of print density display sections 222 which are to be activated to illuminate successively in one direction with the increment switch 218 kept depressed and in the other direction with the decrement switch 220 kept depressed. The print density may be selected and displayed automatically at an automatic density select/display switch 224.

Various copying conditions and modes of operation are available and can be selected at option in addition to the quantity and size of copy sheets to be printed and the density of the images to be printed. In accordance with the selected ones of these optional conditions and modes of operation available, a particular copying program is formulated and is established until the program is cleared. Such a program can be loaded into the system with a program enable switch 226 (PE) depressed preliminarily and the program thus loaded can be called from the system with depression of a program call switch 228 (PC). Furthermore, any optional program which has once been entered into the system can be cleared at an all-clear switch 230 (AC) which initializes the system.

The operational parameters which can be selected on the control panel 200 further include the ratio of magnification or reduction for magnified or reduced copying, the color of printed images and so forth. In the main module control section 202 of the control panel 200 are thus further provided a magnification/reduction control switch 232 (M/R) and associated indicators **232*a*, 232*b* and 232*c*. The magnification/reduction ratio indicators 232*a*, 232*b* and 232*c* as shown are, by way of example, assumed to be activated to illuminate respectively when lifesize or one-by-one copying, A3-to-A4 reduced copying and A4-to-A3 magnified copying are selected, respectively. The indicators 232*a*, 232*b* and 232*c* illuminate recursively as the switch 232 is manually depressed repeatedly. The color of printed images can be selected from among, for example, black, red (or magenta) and blue (or cyan) at a color select switch 234 (CS) associated with color indicators 234*a*, 234*b* and 234*c* allocated to these specific colors, respectively, as shown. These color indicators 234*a*, 234*b* and 234*c* also are to be activated to illuminate recursively as the switch 234 is depressed repeatedly. The color select switch 234 is, in effect, operative to select one of the developing units 72*a* and 72*b* of the image developer stage 72 in the duplicator module 30 of the apparatus shown in FIG. 1**.

On the other hand, the subsidiary module control section 204 predominant over the functions achievable by the automatic document feed module 32 (FIG. 1) comprises an automatic document feed ready state indicator 236 (hereinafter referred to as ADF-mode ready state indicator) which is to be activated to illuminate when the automatic document feed module 32 (FIG. 1) is found ready to operate or in operation. Whether or not the automatic document feed module 32 is ready to operate is determined on the basis of the signal from the transport unit position sensor 194 in the document transport unit of the automatic document feed module 32 (FIG. 1). When the transport unit position sensor 194 is held in the closed position, it is determined from the signal from the sensor 194 that the automatic document feed module 32 is ready for operation so that any of such different modes of operation as an automatic paper-size select mode (APS), an automatic magnification select mode (AMS) and a manually controlled mode (MANUAL) can be selected at a mode select switch 238 (MD). With this mode select switch 238 depressed repeatedly, indicators **238*a*, 238*b* and 238*c*** respectively allocated to these different modes of operation are activated to illuminate recursively, each indicating that the mode of operation allocated thereto is currently selected provisionally.

In the subsidiary module control section 204 are further provided a book copying mode select switch 240 (BK) and a duplex-document copying mode select switch 242 (DX). The duplex-document copying mode select switch 242 is provided to inform the system that the document sheet to be duplicated in the current automatic document feed mode is a duplex document sheet bearing images on both sides thereof. Once the switch 242 is depressed, an associated mode indicator **242*a* is activated to illuminate until the switch 242 is depressed for a second time. The book copying mode select switch 240 is provided to inform the system that the document sheet to be duplicated in the current automatic document feed mode consists of opposite two pages spread out of a book or of any bound volume of image-bearing pages. Such two pages of a bound volume of image-bearing pages will be herein referred to as "book area". Once the switch 240 is depressed for the copying of a book area, an associated indicator 240*a* is also activated to illuminate until the switch 240** is depressed again.

The desired quantity and size of copy sheets to be printed, the desired density and color of the images to be printed, the desired ratio of magnification or reduction for copying, and any desired one or ones of the modes of operation which can be selected at option from the control panel 200 are loaded into a memory device of the system with the program enable switch 226 depressed. The optional program or "copying conditions and modes of operation" (as hereinafter so referred to) thus loaded and stored into the system memory can be called from the memory with the program call switch 228 depressed and may be cleared with the all-clear switch 230 depressed. When the all-clear switch 230 is depressed and the program stored in the system is reset, the control panel 200 is initialized and all the indicators that may have been kept turned on are turned off.

It may be apparent that the number of the indicators associated with each of the control switches herein shown and described is simply for the purpose of illustration and may thus be altered as desired. Each of these indicators may be implemented by a light emitting diode (LED).

Figure 2:
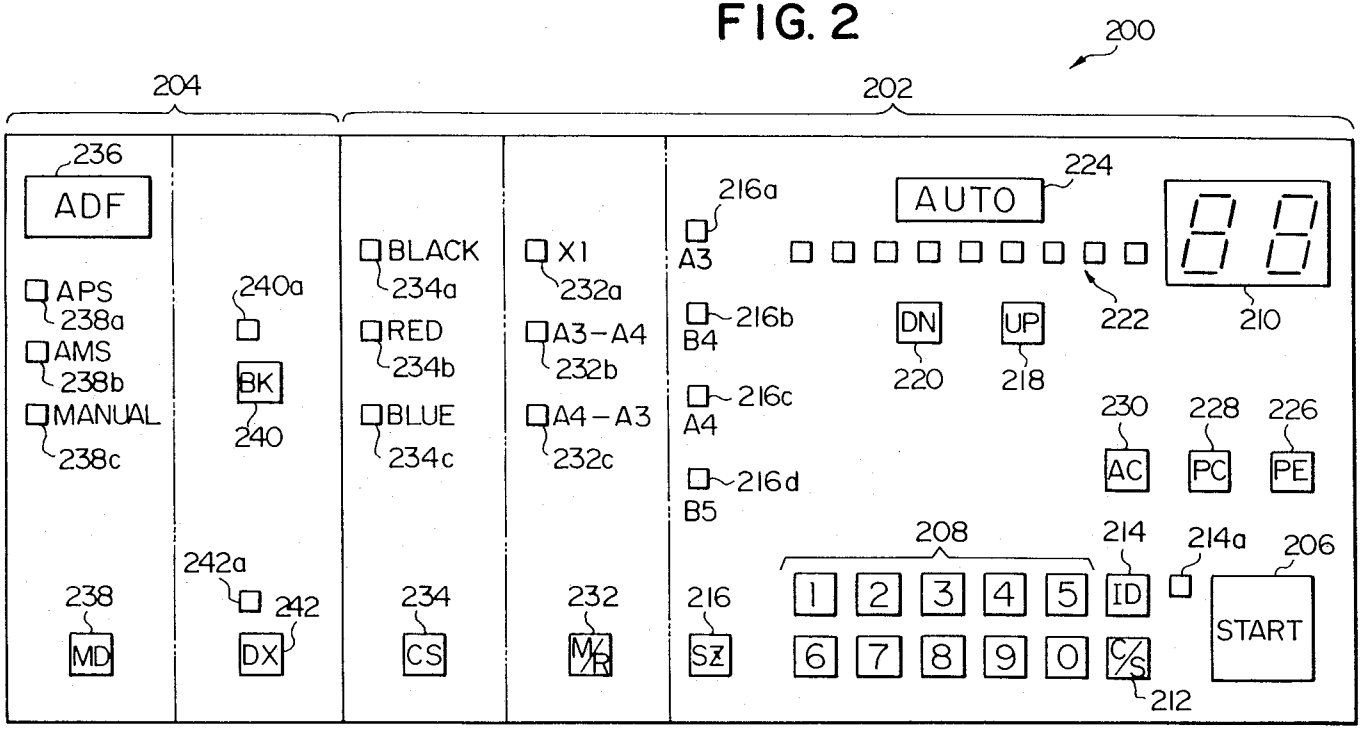
FIG. 2 is a plan view schematically showing the general configuration of a control panel forming part of the image duplicating apparatus illustrated in FIG. 1.
Figure 3:
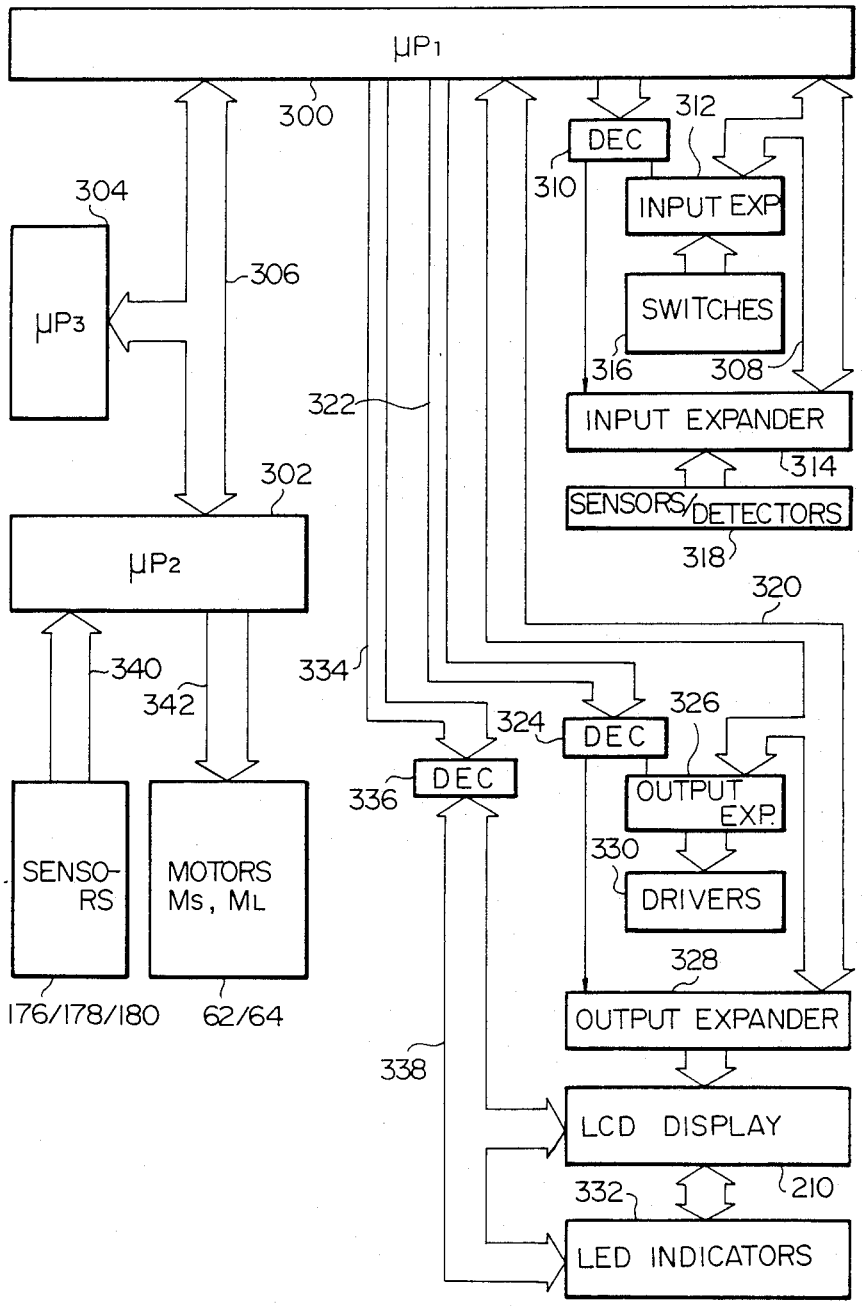
FIG. 3 is a block diagram schematically showing the general arrangement of a control circuit which may be incorporated in the image duplicating apparatus illustrated in FIG. 1.

FIG. 3 schematically shows the general arrangement of the control circuit which may be used to achieve the functions hereinbefore described with reference to FIG. 2.

The control circuit comprises first, second and third microprocessors 300, 302 and 304 (labelled as $uP_1$, $uP_2$ and $uP_3$, respectively). The first microprocessor 300 is mainly operative to control the operation of the image reproducing arrangement 44 and paper feed-in and feed-out mechanism 46 of the duplicator module 30. The second microprocessor 302 is mainly predominant over the operation of the optical scanning system 42 of the duplicator module 30. The third microprocessor 304 is mainly operative to control the operation of the automatic document feed module 32. The second and third microprocessors 302 and 304 are connected to interrupt and data input and output ports of the first microprocessor 300 through a common bus 306.

The first microprocessor 300 to control the operation of the image reproducing arrangement 44 and paper feed-in and feed-out mechanism 46 is further connected through a data bus 308 and an address decoder 310 to first and second input expander circuits 312 and 314, respectively. The first input expander circuit 312 has input terminals connected to various switches on the control panel 200 shown in FIG. 2. The switches connected to the input expander circuit 312, as herein represented by reference numeral 316, include the numerical switches 208, clear/stop switch 212, interrupt demand switch 214, manual paper-size select switch 216, print density increment and decrement switches 218 and 220, automatic density select/display switch 224, program enable and call switches 226 and 228, all-clear switch 230, magnification/reduction control switch 232, color select switch 234, mode select switch 238, book copying mode select switch 240, and duplex-document copying mode select switch 242. The second input expander circuit 314 has input terminals electrically connected to various sensors and detectors, now represented by reference numeral 318, provided in the duplicator module 30 shown in FIG. 1. The sensors and detectors connected to the input expander circuit 314 include the first and second paper size sensors 182 and 184 provided in conjunction with the first and second paper supply cassettes 94 and 96, respectively, and the sensor 186 provided in conjunction with the manual paper supply slot 92 of the paper feed-in and feed-out mechanism 46.

The first microprocessor 300 is further connected through data buses 320 and 322 and an address decoder 324 to first and second output expander circuits 326 and 328. The first output expander circuit 326 has output terminals connected to the driver circuits for the various electrically driven units incorporated in the duplicator module 30 and automatic document feed module 32 shown in FIG. 1. The driver circuits, herein represented by reference numeral 330, connected to the first output expander circuit 326 include those for the main motor 68, the clutches for the paper feed rollers 98 and 100 and timing rollers 108, the charging stages 70, 74 and 76 and lamp 80 as well as the chargers which may be provided in the image developing units **72*a* and 72*b* of the image reproducing arrangement 44, and the belt drive motor 154 of the automatic document feed module 32. The second output expander circuit 328 has output terminals electrically connected to driver circuits (not shown) for the display indow 210 and the various LED indicators, herein represented by reference numeral 332, provided in the control panel 200 shown in FIG. 2. The LED indicators 332 connected to the second output expander circuit 328 include interrupt mode indicator 214*a*, paper-size indicators 216*a* to 216*a*, print density display sections 222, automatic density select/display switch 224, magnification/reduction ratio indicators 232*a* to 232*c*, color indicators 234*a* to 234*c*, ADF-mode ready state indicator 236, mode indicators 238*a* to 238*c*, book copying mode indicator 240*a*, and duplex-document copying mode indicator 242*a*. These display window 210 and LED indicators 328 may be accessed through an address bus 334, an address decoder 336 and an address bus 338 as shown. Each of the input and output expander circuits 312, 314, 326 and 328** may be implemented by the INTEL's integrated circuit, Product No. 8423.

The first microprocessor 300 is thus responsive to signals from the various switches on the control panel 200 and sensors and detectors associated with the paper feed-in and feed-out mechanism 46 to control the operation of the image reproducing arrangement 44 as well as the paper feed-in and feed-out mechanism 46. In the first microprocessor 30 is incorporated an internal read-only memory (ROM) and an internal random-access memory (RAM) into which the program dictating the copying mode of operation as loaded from the program enable switch 226 on the control panel 200 (FIG. 2) may be stored. For the first microprocessor 300 may thus be provided a backup power supply source (not shown) for uninterruptedly refreshing the memory device so that the content of the device can be maintained as when it happens that the system is disconnected from the main power supply The internal read-only memory incorporated in the first microprocessor 300 will be hereinafter referred to simply as system memory.

On the other hand, the second microprocessor 302 predominant over the operation of the optical scanning system 42 of the duplicator module 30 shown in FIG. 1. The second microprocessor 302 is responsive through a bus 340 to the home position sensor 176 and scan timing sensors 178 and 180 provided in association with the optical scanning system 42 and is, through a bus 342, operative to control the driver circuits for the scanner drive motor 62 and the stepper motor 64 for the magnification/reduction lens unit 58 of the system 42. Thus, the second microprocessor 302 is responsive to signals from the home position sensor 176 and scan timing sensors 178 and 180 to control the operation of the motors 62 and 64 of the optical scanning system 42 under the control of the first microprocessor 300.

Figure 4:
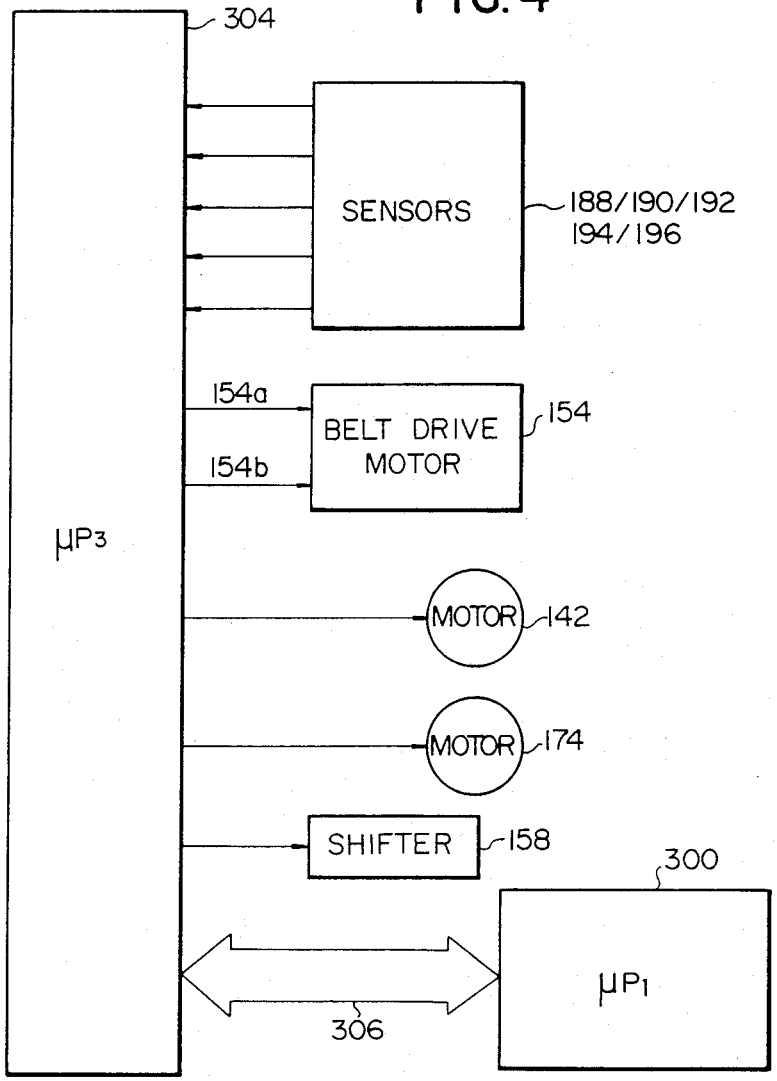
FIG. 4 is a block diagram schematically showing the arrangement in which one of the microprocessors forming part of the control circuit shown in FIG. 3 is coupled to various sensors and driven units incorporated in the automatic document feed module of the image duplicating apparatus illustrated in FIG. 1.

In FIG. 4 is shown the connections between the third microprocessor 306 forming part of the control circuit shown in FIG. 3 and various sensors and driven units incorporated in the automatic document feed module 32. The third microprocessor 304 is responsive to signals from the various sensors provided in the automatic document feed module 32 and is operative to control the driver circuits for the various electrically driven units incorporated in the automatic document feed module 32. The sensors thus associated with the third microprocessor 304 include the document sensor 188, document size sensor 190, document feed sensor 192, transport unit position sensor 194 and document recirculation detector 196 provided in the automatic document feed module 32. The driver circuits for the electrically driven units controlled by the microprocessor 304 controlled by the third microprocessor 304 include those for the document feed roller drive motor 142, belt drive motor 154, document recirculation drive motor 174, and solenoid-operated document withdraw/recirculate shifter 158 of the automatic document feed module 32. To the belt drive motor 154 is to be supplied a signal **154*a* for operation in a normal or forward direction of rotation (as indicated by arrow d in FIG. 1) or a signal 154*b* for operation in a reverse direction of rotation (as indicated by arrow e in FIG. 1). The third microprocessor 304 is thus responsive to signals from the sensors 190 to 196 in the automatic document feed module 32 and is operative to control the operation of the motors 142, 154 and 174, and document withdraw/-recirculate shifter 158 of the automatic document feed module 32 under the control of the first microprocessor 300**.

Description will now be made with reference to FIGS. 5 to 7 which show preferred examples of the general routine programs to be respectively executed by the first, second and third microprocessors 300, 302 and 304 of the control circuit hereinbefore described with reference to FIGS. 3 and 4. Before entering into description of such routine programs, it may be noted that the term "ADF-mode ready state" as will be used hereinafter refers to a condition or state of the apparatus in which the document transport unit 130 of the automatic document feed module 32 shown in FIG. 1 is "closed", viz., held in the previously mentioned first angular position having the lower travelling path portion of the belt 150 held in slidable contact with the document table 40. Under such an ADF-mode ready state, the automatic document feed module 32 is permitted to execute an automatic document feed operation if and as soon a document sheet is inserted into the document supply unit 128 of the automatic document feed module 32 and is detected by the document sensor 188.

First Microprocessor 300

Figure 5:
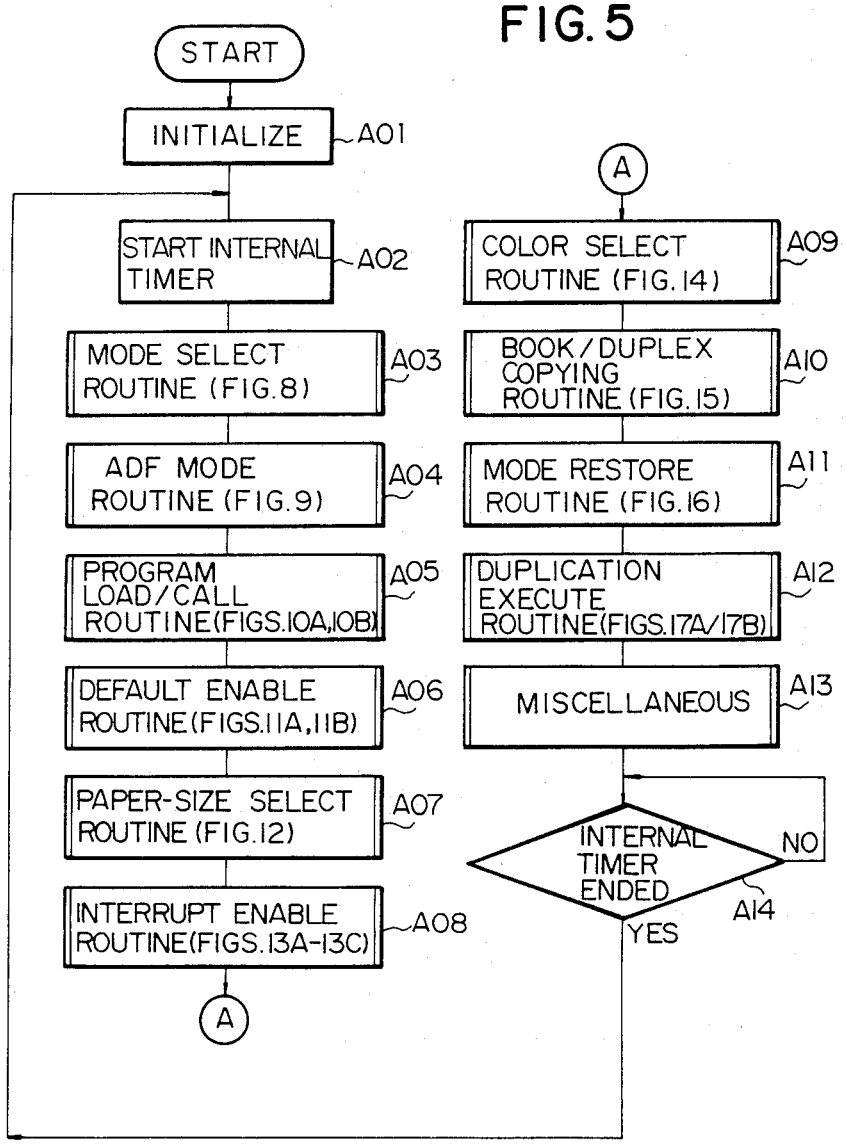
FIG. 5 is a chart showing a preferred example of the main routine program to be executed by a first microprocessor included in the control circuit illustrated in FIG. 3.

FIG. 5 shows a preferred example of the main routine program to be executed by the first microprocessor 300. The main routine program for the first microprocessor 300 starts with a step A01 to initialize the whole system of the microprocessor 300, whereupon an internal timer of the system is initiated at a step A02 to count the time interval predetermined for a single complete iteration through the routine program. During this predetermined time interval, a timer used for each of the individual subroutine programs is to be set and reset repeatedly so that each subroutine program is itinerated a predetermined number of times until the internal timer of the system is reset upon termination of the complete flow of the main routine program.

Subroutine A03

The first microprocessor 300 further has a mode select subroutine program A03 to select either the automatic paper-size select mode (APS) or any of the modes of operation manually selected at the mode select switch 238 on the control panel 200 (FIG. 2) on condition that the apparatus is in an ADF-mode ready state. As noted previously, the modes of operation selectable from the mode select switch 238 consist of the automatic magnification select mode (AMS) and manually controlled mode in addition to the automatic paper-size select mode. The selection of any of these modes of operation under ADF-mode ready state is to be shifted from the paper-size select mode to the magnification select mode, from the magnification select mode to the manually controlled mode, and from the manually controlled mode back to the paper-size select mode. The automatic paper-size select mode is to be selected exclusively during the first iteration through the routine program, while any of the automatic paper-size select mode, automatic magnification select mode and manually controlled mode is selected during each iteration subsequent to the first iteration through the routine program. When there currently is no ADF-mode ready state established, none of the automatic paper-size select, automatic magnification select and manually controlled modes of operation could be selected with all of the mode indicators 238*a*, 238*b* and 238*c* turned off.

For further details of the mode select subroutine program A03, description will be hereinafter made with reference to the flowchart of FIG. 8.

Subroutine A04

The first microprocessor 300 further has an automatic document feed mode enable subroutine program A04 by which the automatic document feed mode is to be enabled with the indicator 236 on the control panel 200 (FIG. 2) activated to illuminate. This mode of operation is enabled either when a document sheet is present in the document supply unit 128 of the automatic document feed module 32 with the document transport unit 130 closed under ADF-mode ready state or when the allclear switch 230 on the control panel 200 (FIG. 2) is open with the document transport unit 130 closed under ADF-mode ready state.

For further details of the automatic document feed enable mode subroutine program A04, description will be hereinafter made with reference to the flowchart of FIG. 9.

Subroutine A05

The first microprocessor 300 further has a program enable/call subroutine program A05 which is started with depression of the program enable switch 226 on the control panel 200 (FIG. 2). Any optional quantity and size of copy sheets to be printed, any optional density and color of the images to be printed, and any optional ratio of magnification or reduction for copying may be loaded into the system. Also, any one or ones of the modes of operation which can be selected at option from the switches 238, 240 and 242 on the control panel 200 (except for the manually controlled mode) may be loaded into the system with the program enable switch 226 depressed preliminarily. The program thus entered into the system can be called from the system with the program call switch 228 depressed so that copying operation is to be executed under the programmed optional conditions.

For further details of the program enable/call subroutine program A05, description will be hereinafter made with reference to the flowcharts of FIGS. 10A and 10B.

Subroutine A06

The first microprocessor 300 further has a default enable subroutine program A06 to initialize the various copying conditions and modes of operation available in the apparatus in accordance with predetermined "default" rules. By these default rules, the quantity of copies is set to be one page for each document sheet, the automatic density select/display mode is set active, the printing color is determined to be black, the magnification/reduction ratio is set for one-by-one or lifesize copying, and the book copying and duplex-document copying modes are set inactive. Furthermore, the automatic paper-size select mode is selected under ADF-mode ready state and, if there is no ADF-mode ready state currently established, a particular one of the developing units 72*a* and 72*b* such as the upper developing unit 72*a* is selected in accordance with the default rules in the image developer stage 72 (FIG. 1).

For further details of the default enable subroutine program A06, description will be hereinafter made with reference to the flowcharts of FIG. 11A or 11B.

Subroutine A07

The first microprocessor 300 further has a paper-size select subroutine program A07. In accordance with this subroutine program A07, the first, second, third and fourth paper size indicators 216a, 216b, 216c and 216d associated with the paper-size select switch 216 are activated to illuminate recursively provided the program enable switch 226 is turned on. The indicators 216a, 216b, 216c and 216d are to be activated in this sequence with the first paper-size indicator 216a activated subsequently to the fourth paper-size indicator 216d. If the paper-size select switch 216 is depressed with the program enable switch 226 turned off, a particular one of the first and second paper supply cassettes 94 and 96 such as the second paper supply cassette 96 (FIG. 1) is selected in accordance with the default rules.

For further details of the paper-size select subroutine program A07, description will be hereinafter made with reference to the flowchart of FIG. 12.

Subroutine A08

The first microprocessor 300 further has an interrupt enable subroutine program A08 which is started with the interrupt demand switch 214 on the control panel 200 depressed. With the interrupt demand switch 214 depressed, the data representative of the currently established optional copying conditions and modes of operation which are currently in use are temporarily withdrawn into the system memory of the microprocessor 300. With the interrupt copying mode thus established, the previously noted default rule conditions are selected in substitution for the optional copying conditions and modes of operation withdrawn into the system memory. Furthermore, the automatic paper-size select mode is selected under ADF-mode ready state and, if there is no ADF-mode ready state currently established, a particular one of the paper supply cassettes 94 and 96 such as the latter (FIG. 1) is selected in accordance with the default rules.

The interrupt copying mode which has once been entered into the system is cancelled when the interrupt demand switch 214 is depressed for a second time after the switch 214 has once been depressed. In this instance, the optional conditions and modes of operation which had been selected before the interrupt demand switch 214 was first depressed are called back or restored from the system memory and the copying operation which has been interrupted is re-opened under the optional conditions and modes of operation.

When the copying operation which has been interrupted is to be re-opened, all the optional conditions and modes of operation that had been valid until the interrupt copying mode of operation was enabled may be restored unconditionally, provided an ADF-mode ready state is established in the apparatus at the particular point of time. These optional conditions and modes of operation may include the automatic paper-size select mode, automatic magnification select mode, book copying mode and duplex-document copying mode of operation. If an ADF-mode ready state is not established at the time of termination of the interrupt copying operation and if the automatic paper-size select mode or the automatic magnification select mode is included in the selected optional conditions and modes of operation restored from the system memory, the particular mode of operation is inhibited unless or until an ADF-mode ready state is established. Also, the book copying and duplex-document copying modes of operation, if included in the selected optional conditions and modes of operation restored from the system memory, are inhibited unless or until an ADF-mode ready state is established. On any of such occasions, the desired mode of operation is enabled at the point of time an ADF-mode ready state is detected to be established in the apparatus. Each of the automatic paper-size and magnification select modes and book and duplex-document copying modes of operation is inhibited by means of or in the presence of a mode inhibitive signal, or flag, which indicates that the particular mode of operation is unexecutable without an ADF-mode ready state being established in the apparatus.

For further details of the interrupt enable subroutine program A08, description will be hereinafter made with reference to the flowcharts of FIGS. 13A, 13B and 13C.

Subroutine A09

The first microprocessor 300 further has a color select subroutine program A09. If the program enable switch 226 has been depressed, the color indicators 234a, 234b and 234c associated with the color select switch 234 are activated to illuminate recursively with the switch 234 depressed repeatedly. The indicators 234a, 234b and 234c are to be activated in this sequence with the first color indicator 234a activated subsequently to the color indicator 234c. If the color select switch 234 is depressed without the program enable switch 226 depressed preliminarily, any one of the developing units 72a and 72b in the image developer stage 72 (FIG. 1) is selected from the color select switch 234.

For further details of the subroutine program A09, description will be hereinafter made with reference to the flowchart of FIG. 14.

Subroutine A10

The first microprocessor 300 further has a book/duplex-document copying mode subroutine program A10. By this subroutine program is established either the book copying mode as selected from the switch 240 or the duplex-document copying mode as selected from the switch 242 on the control panel 200 (FIG. 2). If the book copying mode is selected from the switch 240, corresponding information is transmitted to the second microprocessor 302 and, if the duplex-document copying mode is selected from the switch 242, corresponding information is transmitted to the third microprocessor 304.

For further details of the book/duplex-document copying mode subroutine program A10, description will be hereinafter made with reference to the flowchart of FIG. 15.

Subroutine A11

The first microprocessor 300 further has a mode restore subroutine program A11. Under conditions in which an ADF-mode ready state is newly brought into effect, either the automatic paper-size select mode or the automatic magnification select mode, or the duplex-document copying mode may be set up. Furthermore, the book copying mode may be set up when the ADF-mode ready state which has been in effect is cancelled with, for example, the document transport unit 130 of the automatic document feed module 32 (FIG. 1) opened out after the unit 130 has once been closed. It may happen that any of these modes of operation could not be set up immediately after the ADF-mode ready state is newly established or cancelled. On such an occasion, the desired mode of operation is enabled as soon as the events or situations which have inhibited the use of the particular mode are eliminated. Such events or situations are represented by mode inhibitive signals, or flags, which are set to indicate that any modes of operation potentially available in the apparatus according to the present invention are temporarily unexecutable for any reasons. In the apparatus according to the present invention, the modes of operation which may be inhibited by such signals or flags icclude the automatic paper-size select, automatic magnification select, book copying and duplex-document copying modes of operation. Thus, the mode inhibitive flags used in the more restore subroutine program A11 include automatic paper-size select mode-inhibitive, automatic magnification select mode-inhibitive, book copying mode inhibitive and duplex-document copying mode inhibitive flags. It will be seen that these mode inhibitive flags are similar to those used in the interrupt enable subroutine program A08. The automatic paper-size select mode-inhibitive and automatic magnification select mode-inhibitive flags will be hereinafter referred to simply as APS-mode inhibitive and AMS-mode inhibitive flags, respectively.

Figure 16:
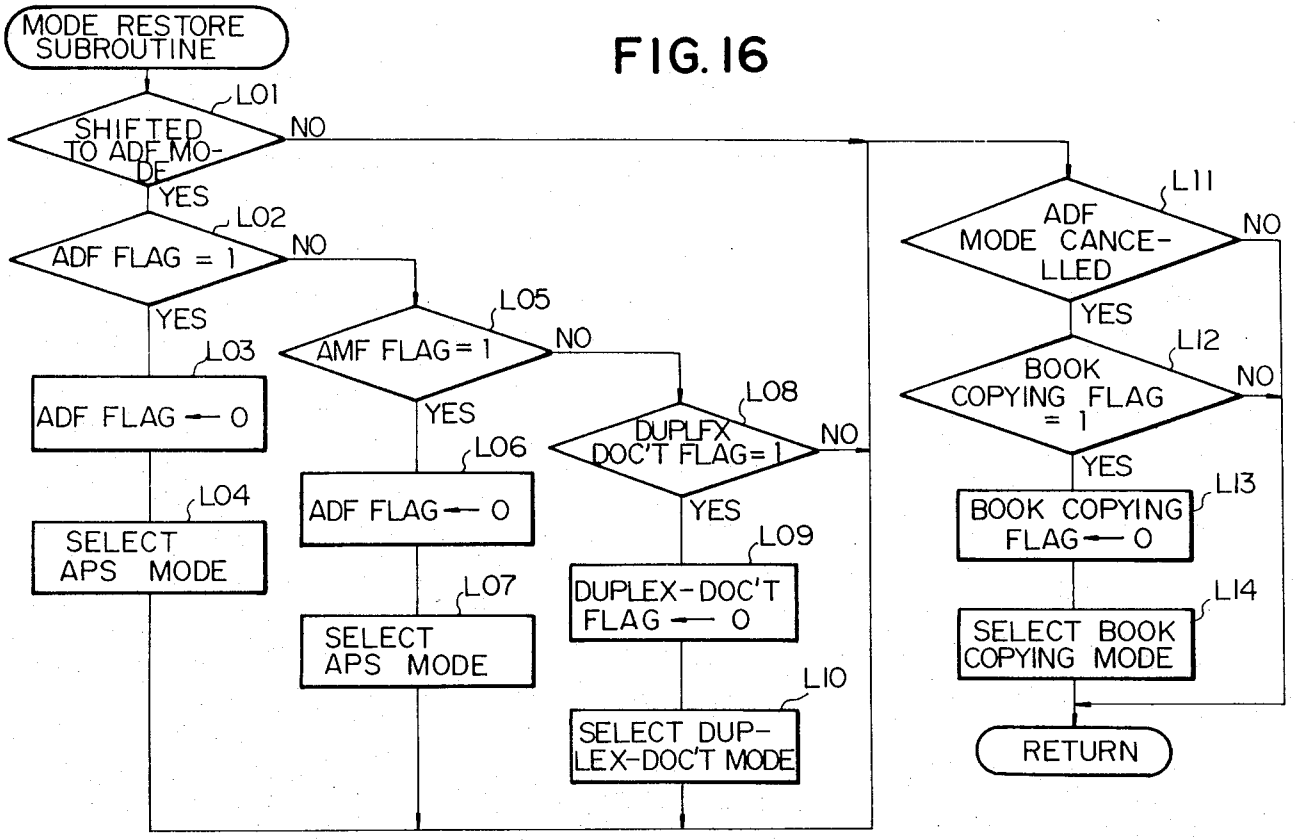
FIG. 16 is a flowchart of a mode restore subroutine program included in the main routine program illustrated in FIG. 5.

For further details of the mode restore subroutine program A11, description will be hereinafter made with reference to the flowchart of FIG. 16.

Subroutine A12

The first microprocessor 300 further has a duplication execute subroutine program A12 to execute copying operation under optionally selected or default rule conditions. This subroutine program is started with the print start switch 206 on the control panel 200 (FIG. 2) depressed.

For further details of the duplication execute subroutine program A12, description will be hereinafter made with reference to the flowcharts of FIGS. 17A to 17G.

Subroutine A13

In the main routine program for the first microprocessor 300 is further included a subroutine program A13 predominant over some other miscellaneous requirement of the control circuit described with reference to FIG. 3. Such miscellaneous requirements may include communication of the first microprocessor 300 with each of the second and third microprocessors 302 and 304. A subroutine program to perform such inter-microprocessor communication being per se well known in the art and being rather immaterial to the understanding of the present invention, description thereof will not be herein incorporated.

Upon lapse of the predetermined time interval after the internal timer of the system has been initiated, the system reverts from step A14 to the A03 so that the internal timer of the system is initiated for a second time as by the step A02.

Second Microprocessor 302

Figure 6:
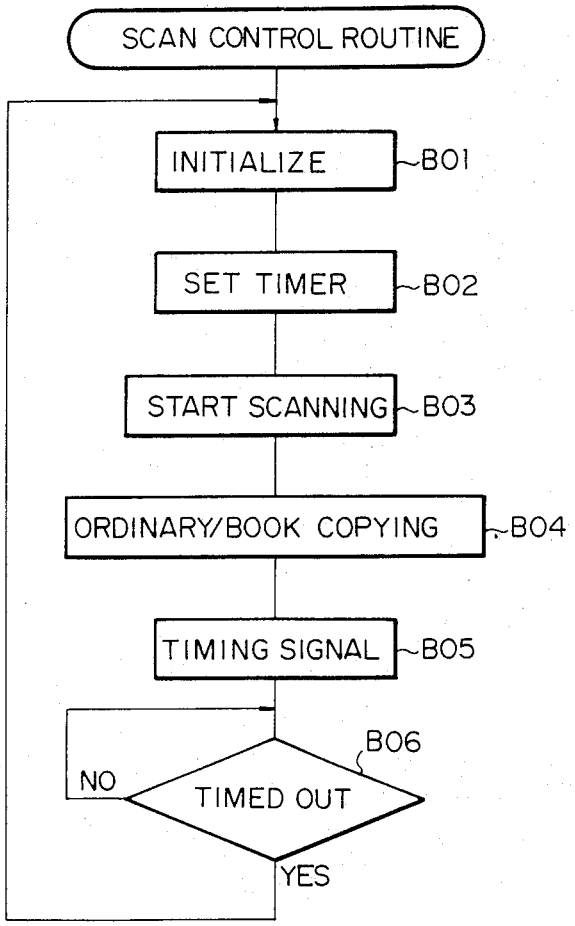
FIG. 6 is a chart showing a preferred example of the routine program to be executed by a second microprocessor included in the control circuit illustrated in FIG. 3.

FIG. 6 is a chart showing a preferred example of a scan control routine program to be executed by the second microprocessor 302 included in the control circuit described with reference to FIG. 3. The routine program herein shown is particularly an optical scan control routine program by which scanning operation is started by initializing the whole system as by a subroutine B01 and thereafter setting a predetermined period of time as by step B02. The step B02 is followed by a subroutine B03 in response to an instruction signal which the microprocessor 302 receives from the first microprocessor 300. A scan start signal is thus supplied to the optical scanning system 42 so that a document sheet placed on the document table 40 begins to be scanned by the document scanner comprised of the exposure lamp 50 and mirrors 52, 54 and 56.

The second microprocessor 302 may further receive from the first microprocessor 300 an enable signal for the book copying mode of operation and related signals. In the presence of such a book copying mode enable signal, scanning is performed first for one of the two pages of the "book area" previously defined and thereafter for the other of the pages through execution of a subroutine program B04. Alternatively, the document sheet may be scanned in an ordinary fashion in the absence of the book copying mode enable signal also in accordance with the subroutine program B04. The second microprocessor 302 is further responsive to a signal indicative of the magnification or reduction ratio. On the basis of this magnification or reduction ratio signal and in response to output signals from the home position and scan timing sensors 176, 178 and 180 (FIG. 1), the microprocessor 302 produces as by subroutine program B03 a signal to be predominant over the timing at which the timing rollers 108 of the paper feed-in and feed-out mechanism 46 (FIG. 1) are to be actuated into operation. The microprocessor 302 then controls the movement of the document scanner to its home position as by the subroutine program B05. It is then tested at step B06 whether or not the time set by the step B02 has lapsed and, if this is not the case, the step B06 is repeated. When it is proved that the time set by the step B02 has lapsed, then the routine program recycles to the step B02. Communication of data from each of the first and third microprocessors 300 and 304 to the second microprocessor 302 is effected independently of the scanning control routine program herein shown on the basis of interrupt demand signals respectively issued from the first and third microprocessors 300 and 304.

For further details of the scan control routine program for the second microprocessor 302, description will be hereinafter made with reference to FIGS. 18A and 18B.

Third Microprocessor 304

Figure 7:
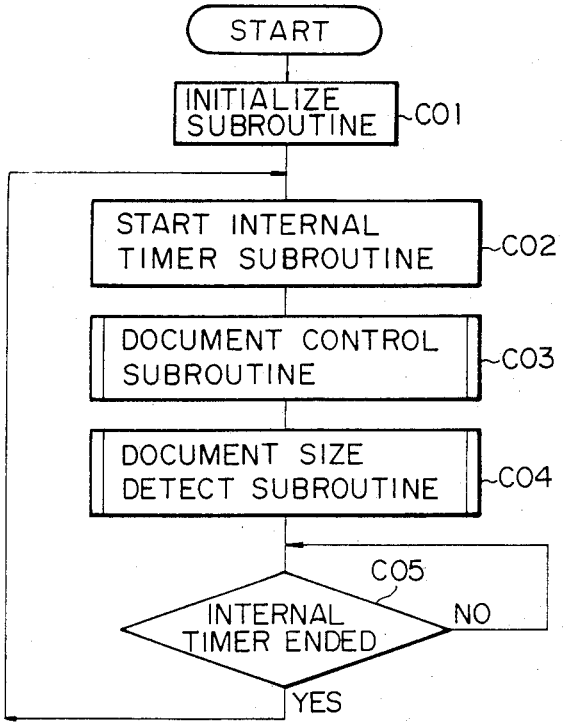
FIG. 7 is a chart showing a preferred example of the main routine program to be executed by a third microprocessor included in the control circuit illustrated in FIGS. 3 and 4.

In FIG. 7 is shown a preferred example of the main routine program to be executed by the third microprocessor 304 included in the control circuit described with reference to FIGS. 3 and 4. The main routine program for the second microprocessor 304 also starts with a step C01 to initialize the whole system of the microprocessor 304, whereupon an internal timer of the system is initiated by a step C02 to count the time interval predetermined for a single complete iteration through the routine program. During this predetermined time interval, a timer used for each of the individual subroutine programs is to be set and reset repeatedly so that each subroutine program is recycled a predetermined number of times until the internal timer of the system is reset upon termination of the complete flow of the main routine program.

Subroutine C03

The third microprocessor 304 is predominant over the operation of the automatic document feed module 32 (FIG. 1) and further has a document feed/recirculate/discharge subroutine program C03. This document feed/recirculate/discharge subroutine program C03 controls the operation of the automatic document feed module 32 to supply a document sheet from the document supply unit 128 to the previously defined correct exposure position on the document table 40, transport the document sheet through the document transport unit 130 upon scanning by the optical scanning system 42, and discharge the document sheet out of the document transport unit 130. During the duplex-document copying mode selected from the switch 242 on the control panel 200 (FIG. 2), the subroutine program C03 further controls the operation of the automatic document feed module 32 to pass the scanned document sheet from the document transport unit 130 to the document recirculation unit 132, reverse the document sheet in the recirculation unit 132, carry the reversed document sheet to the document transport unit 130, transport the document sheet back to the correct exposure position on the document table 40, transport the document sheet through the document transport unit 130 upon scanning by the scanning system 42, and discharge the document sheet out of the document transport unit 130.

For further details of the document feed/recirculate/discharge subroutine program C03, description will be hereinafter made with reference to FIG. 19 and further to FIGS. 20 to 23.

Subroutine C04

The third microprocessor 304 further has a document size detect subroutine program C04 to detect the size of a document sheet under ADF-mode ready state. The time interval intervening between the turn-on and turn-off times of a signal from the document size sensor 190 provided in the document transport unit 130 of the automatic document feed module 32. The sensor 190 is responsive to a document sheet being passed into the unit 130 from the document supply unit 128 and, thus, the time interval detected by the sensor 190 is indicative of and accordingly calculated into the measurement, in the direction of advancement, of the document sheet admitted into the document transport unit 130. It is then determined whether such a measurement is either the length or the width of the document sheet which is assumed to be of any standardized size.

For further details of the document size detect subroutine program C04, description will be hereinafter made with reference to FIG. 24.

Communication of data from each of the first and second microprocessors 300 and 302 to the third microprocessor 304 is also effected independently of the routine program herein shown on the basis of interrupt demand signals respectively issued from the first and second microprocessors 300 and 302.

Description will now be made with reference to FIGS. 1 to 4 and further to FIGS. 8 to 24 in regard to the details of each of the subroutine programs forming the main routine program of each of the first, second and third microprocessors 300, 302 and 304.

FIRST MICROPROCESSOR 300

Mode Select Subroutine (A03; FIG. 8)

Figure 8:
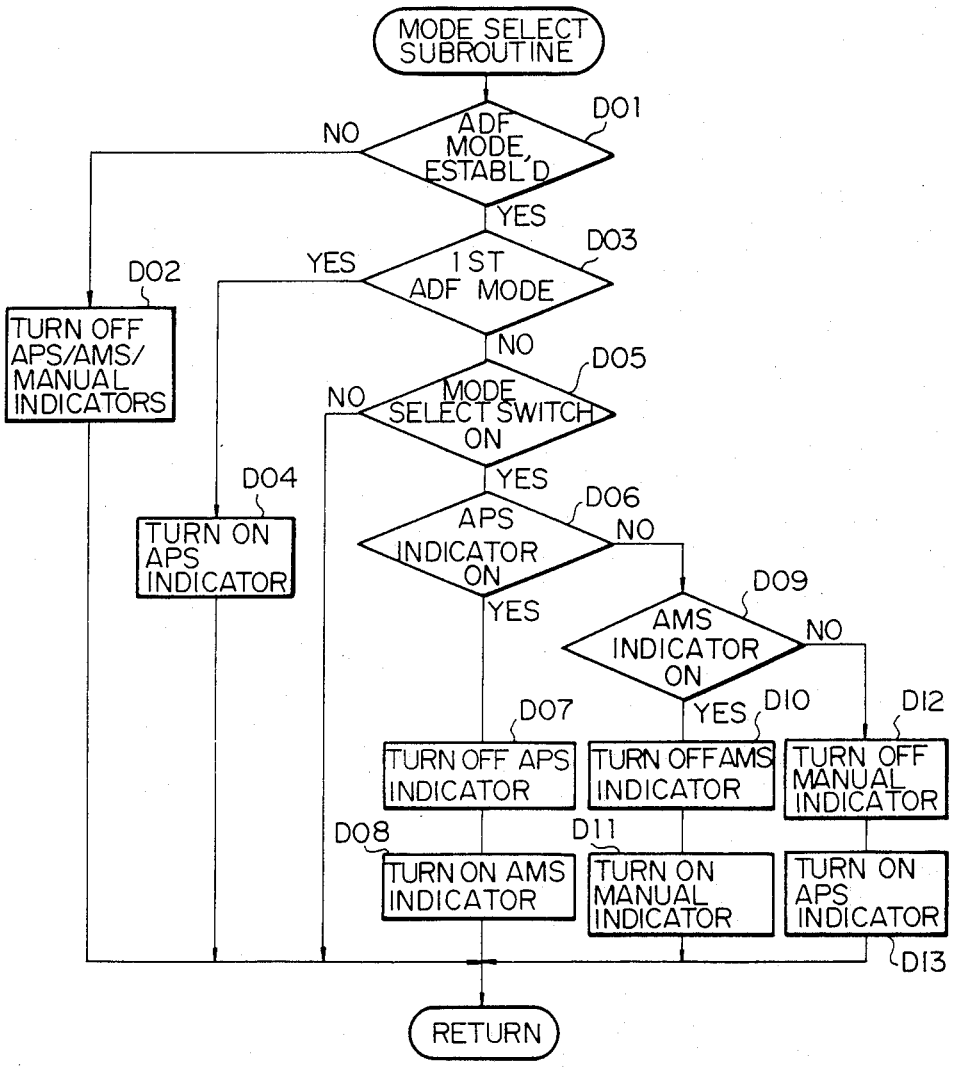
FIG. 8 is a flowchart of a mode select subroutine program included in the main routine program illustrated in FIG. 5.

Referring to FIG. 8, the mode select subroutine program A03 starts with a decision step D01 to determine whether or not the ADF-mode ready state indicator 236 on the control panel 200 (FIG. 2) is turned on. As noted previously, this ADF-mode ready state indicator 236 is turned on when the ADF-mode ready state is established in the apparatus with the document transport unit 130 of the automatic document feed module 32 (FIG. 1) closed on the document table 40 of the duplicator module 30.

If it is determined at the decision step D01 that the indicator 236 is turned off, the step D01 proceeds to a process step D02 to issue instruction signals to de-activate all the indicators **238*a*, 238*b* and 238*c* associated with the mode select switch 238 to turn off so that none of the automatic paper-size select, automatic magnification select, and manual control modes could not be established. After the mode indicators 238*a*, 238*b* and 238*c* are thus turned off, the subroutine program reverts to the initial decision step D01 and thereafter the status thus established at the step D02 is maintained until the answer for the decision step D01** turns affirmative.

If it is determined at the decision step D01 that the ADF-mode ready state indicator 236 is turned on, the step D01 proceeds to another decision step D03 to ascertain whether or not the ADF-mode ready state detected through the step D01 is the first one after the subroutine program A03 has been started. If it is found that this is the case, the automatic paper-size select mode is selected with the corresponding mode indicator **238*a* activated to turn on at a step D04. With the mode indicator 238*a* thus activated to turn on, the subroutine program also reverts to the initial decision step D01. When the decision step D03 is reached thereafter, the answer for the step must be given in the negative so that the decision step D03 automatically proceeds to a subsequent step D05** which is also a decision step.

By this decision step D05 is determined whether or not there is present a signal produced with the mode selector switch 238 depressed. In the absence of such a signal produced from the switch 238, the subroutine program also returns to the initial decision step D01 so that the loop consisting of the steps D05, D01 and D03 is recycled until or unless the mode select switch 238 is depressed to close. When it is thus found at the decision step D03 that there is present a signal produced with the mode selector switch 238 depressed, then it is further tested at a decision step D06 whether or not the automatic paper-size select mode indicator **238*a* is turned on. If the mode indicator 238*a* is found to be turned on, an instruction signal is issued from the system to de-activate the particular indicator 238*a* is to turn off at a step D07 and, in turn, an instruction signal is issued from the system to activate the automatic magnification select mode indicator 238*b* to turn on at a step D08, whereupon the subroutine program recycles to the initial decision step D01**.

If it is determined at the decision step D06 that the automatic paper-size select mode indicator **238*a* is turned off, then the step D06 proceeds to another decision step D09 to question whether or not the automatic magnification select mode indicator 238*b* is turned on. If the answer for this decision step D09 is given in the affirmative, an instruction signal is issued from the system to de-activate the mode indicator 238*b* to turn off at a step D10 and, in turn, an instruction signal is issued from the system to activate the manually controlled mode indicator 238*c* to turn on at a step D11 and the subroutine program reverts to the initial decision step D01. If the answer for the decision step D09 is given in the negative, an instruction signal is issued from the system to de-activate the mode indicator 238*c* to turn off at a step D12 and, in turn, an instruction signal is issued from the system to activate the automatic paper-size select mode indicator 238*a* to turn on at a step D13 and the subroutine program also reverts to the initial decision step D01**.

Thus, the automatic paper-size select mode is selected exclusively during the first iteration through the routine program A03 under ADF-mode ready state. During each iteration subsequent to the first iteration through the routine program A03 under the ADF-mode ready state, modes of operation are shifted sequentially from the automatic paper-size select mode to the magnification select mode, from the automatic magnification select mode to the manually controlled mode, and from the manually controlled mode back to the automatic paper-size select mode. When there is no ADF-mode ready state currently established, none of the automatic paper-size select, automatic magnification select and manually controlled modes of operation could be selected with all of the mode indicators 238*a*, 238*b* and 238*c* turned off.

ADF Mode Enable Subroutine (A04; FIG. 9)

Figure 9:
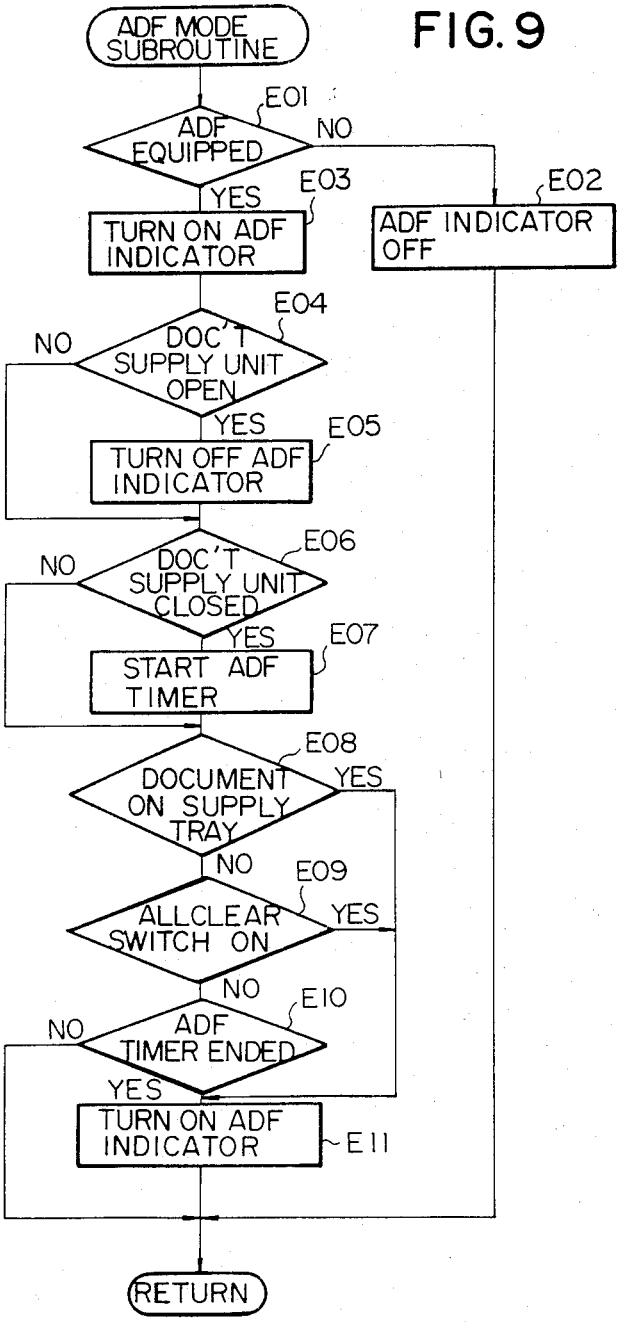
FIG. 9 is a view showing a flowchart of an automatic document feed mode enable subroutine program included in the main routine program illustrated in FIG. 5.

Referring to FIG. 9, the automatic document feed mode enable subroutine program A04 starts with a decision step E01 to check whether or not the apparatus in use is of the type equipped with the automatic document feed module 32. The answer for this decision step E01 is herein assumed to be in the affirmative. In the case of an apparatus devoid of such a subsidiary module, however, the answer for the step E01 will be given in the negative. In this instance, the step E01 proceeds to a subsequent process step E02, at which an instruction signal is issued from the system to de-activate the ADF-mode ready state indicator 236 to turn off, whereupon the subroutine program reverts to the preceding decision step E01 and the state thus established by the step E02 is maintained insofar as the answer for the decision step E01 remains negative.

The answer for the decision step E01 being given in the affirmative in the present case, the step E01 proceeds to a subsequent process step E03 at which an instruction signal is issued from the system to activate the ADF-mode ready state indicator 236 on the control panel 200 (FIG. 2) to turn on. It is then queried at a decision step E04 whether or not the document transport unit 130 of the automatic document feed module 32 (FIG. 1) is in the open position. If it is found that this is currently the case, an instruction signal is issued from the system to de-activate the ADF-mode ready state indicator 236 to turn off at a step E05 and, thereupon, it is confirmed at a decision step E06 whether or not the document transport unit 130 of the automatic document feed module 32 is in the closed position. This confirmation is made subsequently to the decision step E04 if the document transport unit 130 is found closed at the step E04. Whether the document transport unit 130 of the automatic document feed module 32 is open or closed is determined on the basis of a signal from the transport unit position sensor 194 provided in the document transport unit 130 of the automatic document feed module 32.

If it is found at the step E06 that the document transport unit 130 is closed, then an instruction signal is issued from the system to enable an automatic document feed timer to start at a process step E07 and, if the answer for the step E06 is given in the negative, the process step E07 is skipped over. Subsequently to the decision step E06 or to the process step E07, it is tested whether or not a document sheet has been inserted into the document supply unit 128 of the automatic document feed module 32. Whether or not a document sheet is present in the document supply unit 128 is determined on the basis of a signal from the document sensor 188 provided in the document supply unit 128 of the automatic document feed module 32.

If it is found at the decision step E08 that there is no document sheet present in the document supply unit 128, the step E08 proceeds to another decision step E09 to question whether the all-clear switch 230 on the control panel 200 (FIG. 2) is closed or open. If the all-clear switch 230 is found open at this step E09, it is confirmed at a subsequent decision step E10 whether or not the automatic document feed timer has completed its counting operation which started at the step E07. If the operation of the automatic document feed timer is found complete, then an instruction signal is issued from the system to activate the ADF-mode ready state indicator 236 to turn on at a step Ell with the ADF-mode ready state established in the apparatus and the subroutine program reverts to the initial decision step E01. If the automatic document feed timer is found to be still in operation at the step E10, the subroutine program recycles to the initial decision step E01 without activating the ADF-mode ready state indicator 236 to turn on. On the other hand, if it is found at the step 08 that a document sheet is present in the document supply unit 128 or at the step E09 that the all-clear switch 230 is closed, the step E08 or E09 jumps over to the step E11 to activate the ADF-mode ready state indicator 236 to turn and the subroutine program also reverts to the step E01.

By the automatic document feed mode enable subroutine program A04 is thus enabled an automatic document feed mode, provided a document sheet is present in the document supply unit 128 of the automatic document feed module 32 with the document transport unit 130 of the automatic document feed module 32 closed or the all-clear switch 230 on the control panel 200 (FIG. 2) is open with the document feed unit 130 closed.

Program Load/Call Subroutine (A05; FIGS. 10A and 10B)

Figure 10A:
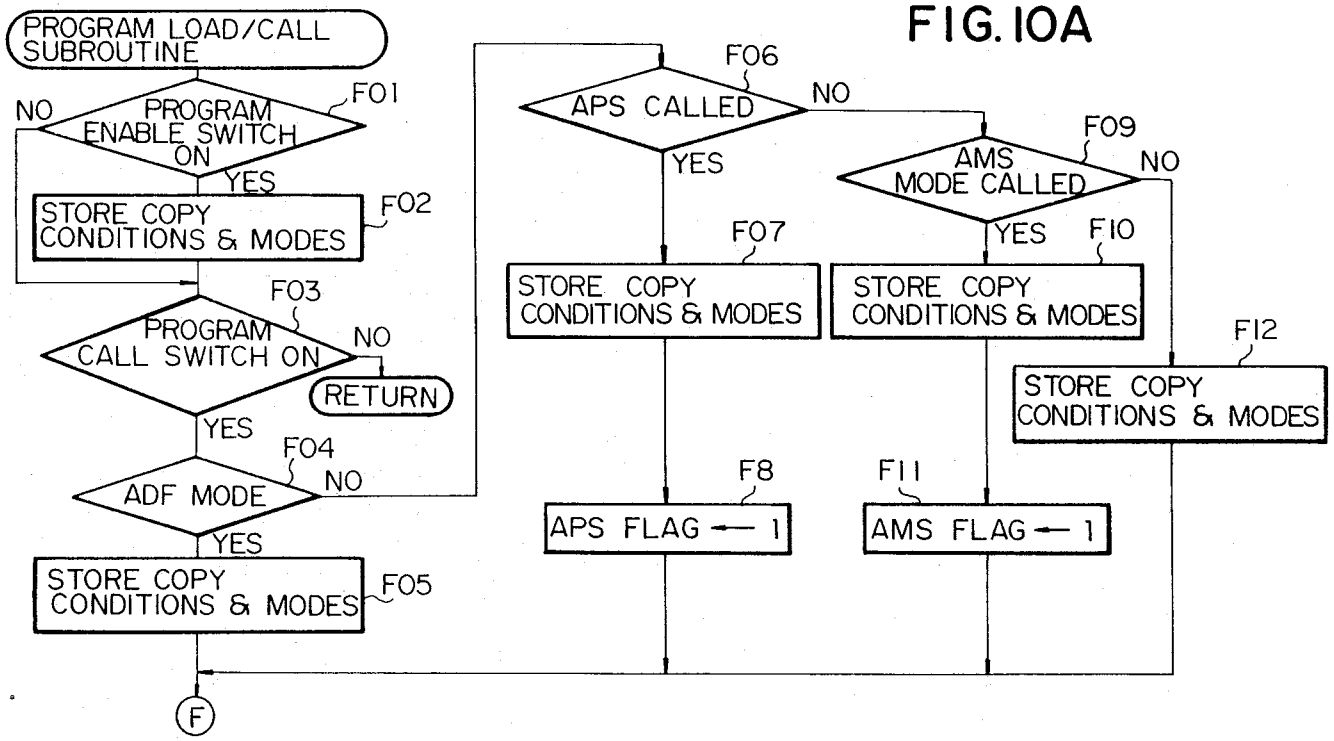
FIGS. 10A and 10B are flowcharts of a program load/call subroutine program included in the main routine program illustrated in FIG. 5.
Figure 10B:
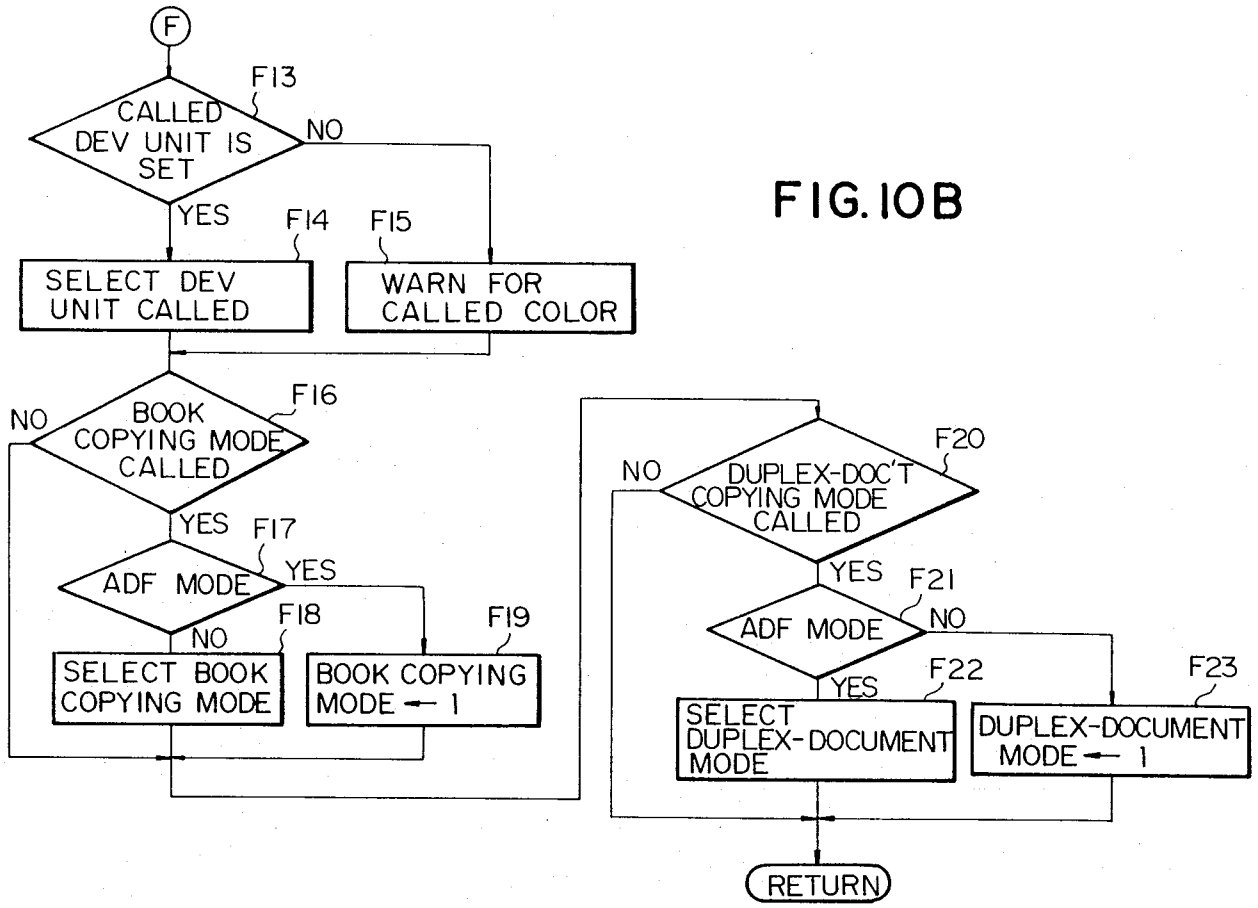

Referring to FIGS. 10A and 10B, first to FIG. 10A, the program enable/call subroutine program A05 starts with a decision step F01 to confirm whether or not there currently is a signal produced with the program enable switch 226 on the control panel 200 (FIG. 2) depressed. If it is determined at this decision step F01 that there is such a signal, instruction signals are issued from the system so that any optional conditions and modes of operation may be loaded into the system by a process step F02. Thus, any optional quantity of copy sheets to be printed may be loaded into the system from the numerical switches 208 on the control panel 200 (FIG. 2), and any optional size of copy sheets to be printed may be loaded into the system from the manual paper-size select switch 216 on the control panel 200. Any optional density of the images to be printed may be loaded into the system from the image density increment and decrement switches 218 and 220 on the control panel 200, and any optional ratio of magnification or reduction for copying may be loaded into the system from the magnification/reduction control switch 232 on the control panel 200. Any optional color of the images to be printed may be loaded into the system from the color select switch 234 on the control panel 200. In addition, any one or both of the automatic paper-size and magnification select modes of operation may be selected and loaded into the system from the mode select switch 238 and, furthermore, one or both of the book and duplex-document copying modes may be selected and loaded into the system from the respectively corresponding switches 240 and 242 on the control panel 200. All the optional conditions and modes of operation selected are stored in the system memory of the first microprocessor 300 (FIG. 3). The program thus entered into the system can be called from the system with the program call switch 228 depressed.

Subsequently to the process step F02 or if the answer for the initial decision step F01 is given in the negative in the absence of a signal produced with the program enable switch 226 depressed, it is thus confirmed at a decision step F03 whether or not there currently is a signal produced with the program call switch 228 on the control panel 200 depressed. In the absence of such a signal, the subroutine program reverts to the initial decision step F01 and the status established by the process step F02 is maintained until the answer for the decision step F03 turns affirmative. If it is determined at the decision step F03 that there is such a signal, it is tested at a decision step F04 whether or not the ADF-mode ready state indicator 236 on the control panel 200 is turned on with the ADF-mode ready state established in the apparatus. If it is found by this decision step F04 that the ADF-mode ready state indicator 236 is turned on, the data excluding those for the color of the images to be printed and the book and duplex-document copying modes which may have been stored into the system memory by the previous step F02 are called from the memory at a process step F05 and the apparatus is conditioned in accordance with the data thus fetched. The optional conditions and modes of operation thus established in the apparatus may include those for the quantity and size of copy sheets to be printed, the density of the images to be printed, the ratio of magnification or reduction for copying, and the automatic paper-size and magnification select modes of operation.

If it is determined at the decision step F04 that the ADF-mode ready state indicator 236 on the control panel 200 is turned off to mean that the ADF-mode ready state is currently not established, it is confirmed at a decision step F06 whether or not the program stored in the system memory by the previous process step F02 includes an instruction demanding the automatic paper-size select mode of operation. If the answer for this decision step F06 is given in the affirmative, then the data excluding those for the size of copy sheets to be printed, the color of the images to be printed, the automatic paper-size and magnification select modes, and the book copying and duplex-document copying modes which may have been stored in the memory are called at a step F07. In the apparatus are now established the optional copying conditions and modes of operation which may include those for the quantity of copy sheets to be printed, the density of the images to be printed, and the ratio of magnification or reduction for copying. In this instance, the instruction effective to select the size of copy sheets is assumed to be such that the second paper supply cassette 96 in particular is to be predominantly used in the paper feed-in and feed-out mechanism 46 (FIG. 1). After the conditions read from the system memory have thus been established in the apparatus, an instruction signal is issued from the system to set an APS mode inhibitive flag of, for example, a logic "1" bit as at a step F08 to indicate that the automatic paper-size select mode of operation is currently unexecutable under the condition in which the ADF-mode ready state is not established.

If it is found at the decision step F04 that an instruction demanding the automatic paper-size select mode of operation is not included in the program stored in the system memory by the previous process step F02, it is now confirmed at a decision step F09 whether or not the program stored in the memory of the system includes an instruction demanding the automatic magnification select mode of operation. If the answer for this decision step F09 is given in the affirmative, then the data excluding those for the ratio of magnification or reduction for copying, the color of the images to be printed, the automatic paper-size and magnification select modes, and the book copying and duplex-document copying modes which may have been stored in the memory are called at a step F10. In the apparatus are thus established the optional copying conditions and modes of operation which may include those for the quantity and size of copy sheets to be printed, and the density of the images to be printed. In this instance, the instruction effective to select the ratio of magnification or reduction for copying is assumed to be such as to select the one-by-one or lifesize copying. After the conditions read from the system memory have thus been established in the apparatus, an instruction signal is issued from the system to set an AMS mode inhibitive flag of, for example, a logic "1" bit as at a step Fll to indicate that the automatic magnification select mode of operation is currently unexecutable under the condition in which the ADF-ready state is not established.

If it is determined at the decision step F09 that an instruction demanding the automatic magnification select mode of operation is not included in the program stored in the system memory by the previous process step F02, then the data excluding those for the color of the images to be printed, the automatic paper-size and magnification select modes, and the book copying and duplex-document copying modes which may have been stored in the memory are called at a step F12. In the apparatus are now established the optional copying conditions and modes of operation which may include those for the quantity and size of copy sheets to be printed, the density of the images to be printed, and the ratio of magnification or reduction for copying.

Subsequently to each of the steps F05, F08, F11 and F12 thus performed, the subroutine program jumps over to a decision step F13 shown in FIG. 10B through a connector "F". By this decision step F13 is queried whether cr not the color designated by the color data included in the program stored in the system memory is currently available in the image developing stage 72 of the image reproducing arrangement 44 (FIG. 1). If it is determined at this step F13 that either the upper developing unit **72*a* or the lower developigg unit 72*b* of the image developer stage 72 stores a toner of the designated color, an instruction signal is issued from the system to select the particular developing unit 72*a* or 72*b* at a process step F14. In case it is found at this step F13 that neither the upper developing unit 72*a* nor the lower developing unit 72*b* of the image developing stage 72 stores a toner of the designated color, then an instruction signal is issued from the system so that the corresponding one of the color indicators 234*a*, 234*b* and 234*c* on the control panel 200 is activated to flicker at a step F15 to request the operator to exchange one of the developing units 72*a* and 72*b*** to exchange with a proper developing unit storing a toner of the designated color.

Subsequently to the step F14 or step F15, it is questioned at a decision step F16 whether or not the program stored in the system memory includes an instruction demanding the book copying mode of operation. If the answer for the decision step F16 is given in the affirmative, then it is further questioned at a subsequent decision step F17 whether or not the ADF-mode ready state indicator 236 on the control panel 200 is turned on with the ADF-mode ready state established. If the answer for this decision step F17 is also given in the affirmative, an instruction signal is issued from the system to have the automatic document feed module 32 (FIG. 1) conditioned to be ready for the book copying mode of operation at a process step F18. If it is determined at the decision step F17 that the ADF-mode ready state indicator 236 is turned off, then a book copying mode (BCM) inhibitive flag of, for example, a logic "1" bit is set at a step F19.

Either the process step F18 or step F19 is followed at a subsequent decision step F20 at which it is tested whether or not the program stored in the system memory includes an instruction demanding the duplex-document copying mode of operation. If it is found at the decision step F16 that an instruction demanding the book copying mode of operation is not included in the program stored in the system memory, the subroutine program also proceeds to the decision step F20. If the answer for the decision step F20 is given in the affirmative, then it is further questioned at a subsequent decision step F21 whether or not the ADF-mode ready state indicator 236 on the control panel 200 is turned on with the ADF-mode ready state established. If the answer for this decision step F21 is also given in the affirmative, an instruction signal is issued from the system at a process step F22 to have the automatic document feed module 32 conditioned to be ready for the duplex-document copying mode of operation. If it is determined at the decision step F21 that the ADF-mode ready state indicator 236 is turned off, then a duplex-document copying mode inhibitive flag of, for example, a logic "1" bit is set at a step F23.

Default Enable Subroutine (A06; FIGS. 11A or 11B)

Figure 11A:
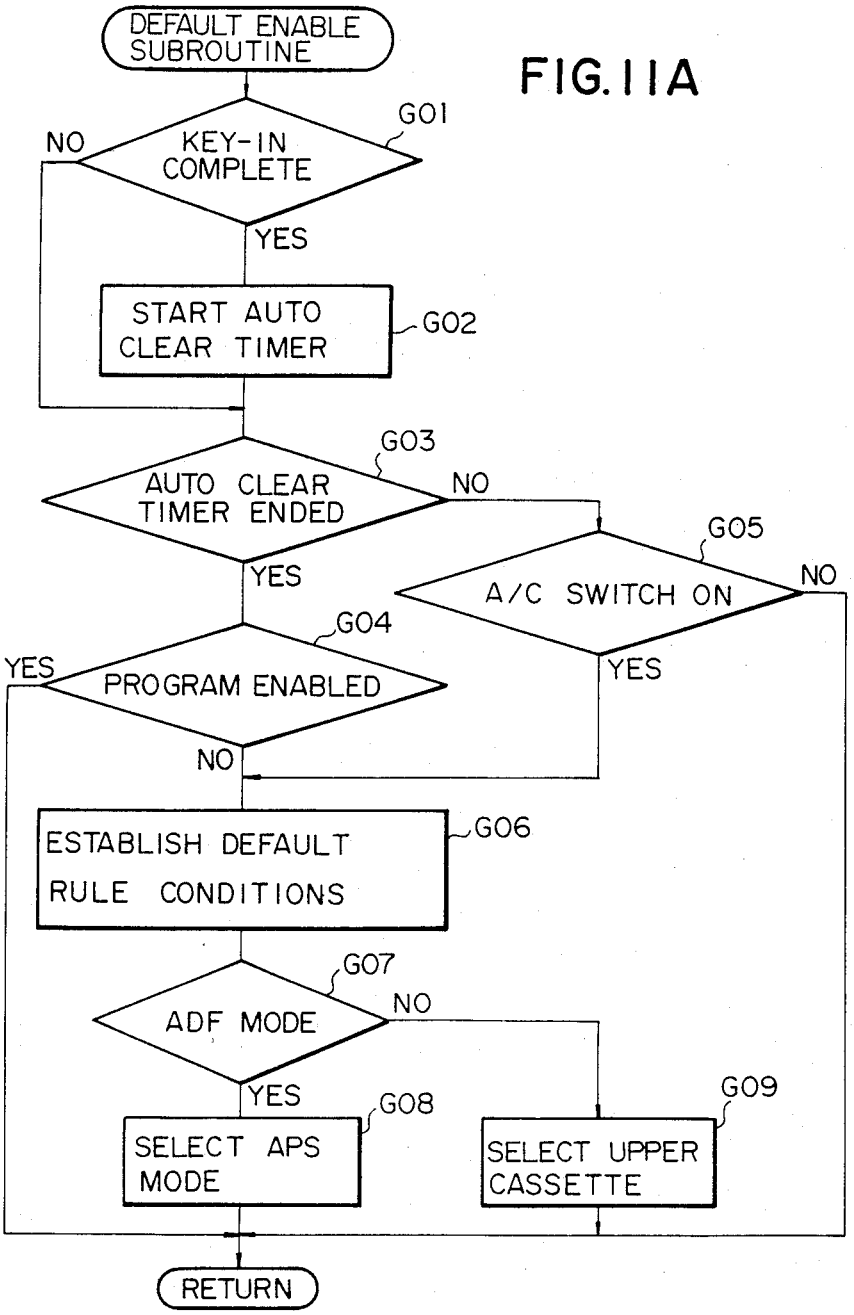
FIG. 11A is a flowchart which shows a default enable subroutine program included in the main routine program illustrated in FIG. 5.

Referring to FIG. 11A, the default enable subroutine program A06 is executed to initialize the various copying conditions and modes of operation available in the apparatus in accordance with predetermined yet alterable default rules. This subroutine program starts with a decision step G01 by which it is queried whether or not the operator has completed the key-in operation with the control panel 200 (FIG. 2). If it is found at this decision step G01 that the operator has completed the key-in operation, an instruction signal is issued from the system to enable the automatic clear timer of the system start counting operation at a step G02. Thereupon, it is tested at a subsequent decision step G03 whether or not the automatic clear timer has completed its counting operation. This decision step G03 is followed also when it is found at the preceding decision step G01 that the operator's key-in operation is still incomplete. If the answer for the decision step G03 is given in the affirmative, then it is further questioned at a decision step G04 whether or not there are data representative of any optional copying conditions and modes of operation stored in the system memory in accordance with the subroutine program A05 described with reference to FIGS. 10A and 10B and have been called from the memory and established in the apparatus. If it is found at the decision step G03 that the automatic clear timer is still in operation, it is queried at a decision step G05 whether or not there is present a signal produced as result of the all-clear key 230 on the control panel 200 (FIG. 2) having been depressed. If the answer for the decision step G04 is given in the affirmative or if the answer for the subsequent decision step G05 is given in the negative, the subroutine program recycles to the initial decision step G01.

If it is found at the decision step G04 that there currently are no data representative of optional copying conditions and modes of operation stored and established or if it is found at the step decision step G05 that the all-clear key 230 has been depressed, then the subroutine program proceeds to a process step G06 at which instruction signals are issued from the system so that the various copying conditions and modes of operation available in the apparatus are initialized in accordance with predetermined default rules. In the subroutine program A06 herein shown, it is assumed that these default rule conditions are prescribed to be such that the quantity of copies is one page for each document sheet, the automatic density select/display mode active, the printing color is black, the magnification/reduction ratio the one-by-one or lifesize ratio, and the book copying and duplex-document copying modes are inactive.

Upon completion of the execution of the process step G06, it is queried at a decision step G07 whether or not the ADF-mode ready state is currently established in the apparatus with the ADF-mode ready state indicator 236 on the control panel 200 turned on. If the answer for this decision step G07 is given in the affirmative, the step G07 is followed at a step G08 by which an instruction signal is issued from the system to establish the automatic paper-size select mode with the corresponding mode indicator 238*a* activated to turn on the control panel 200. If it is found at the step G07 that there is no ADF-mode ready state established in the apparatus, particular one of the developing units 72*a* and 72*b* such as the upper developing unit 72*a* is selected in the image developing stage 72 (FIG. 1) by a step G09 and, thereupon, the subroutine program reverts to the initial decision step G01.

Figure 11B:
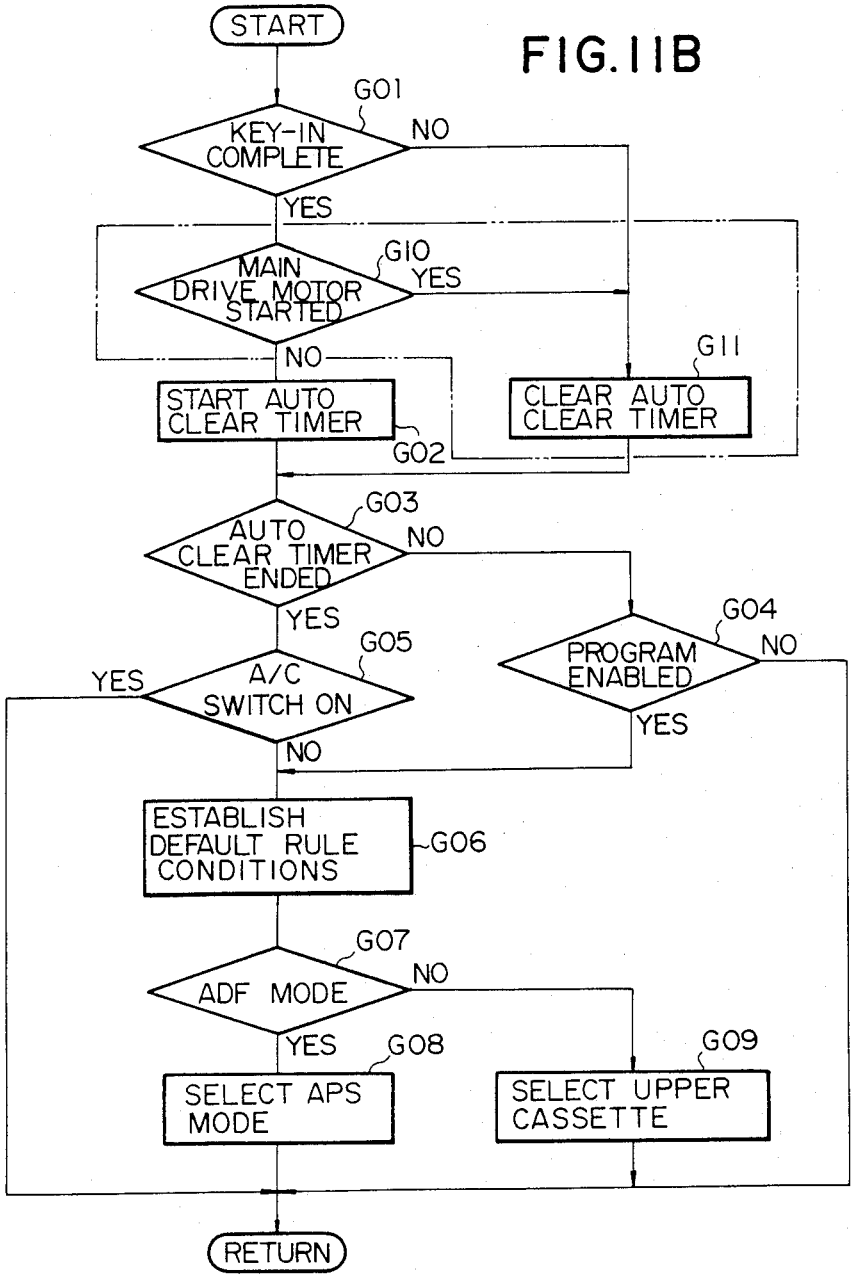
FIG. 11B is a flowchart similar to that of FIG. 11A but shows a modification of the default enable subroutine program illustrated in FIG. 11A.

The flowchart of FIG. 11B shows a modification, A06', of the subroutine program A06 which has been hereinbefore described with reference to FIG. 11A.

In the subroutine program A06' shown in FIG. 11B are provided steps G10 and Gll in addition to the steps G01 to G09 of the subroutine program A06 shown in FIG. 11A. The step G10 is a decision step subsequent to the initial decision step G01 and is to be followed when the answer for t:he steps G01 is given in the affirmative, viz.,it is found at the step G01 that the operator's key-in operation is complete. At this additional decision step G10 is questioned whether or not the main drive motor 68 of the duplicator module 30 (FIG. 1) is in a condition energized. If it is proved at this step G10 that the main drive motor 68 is in a de-energized condition, the automatic clear timer of the system is started at the step G02. If it is found at this step G10 that the main drive motor 68 is in an energized condition, an instruction signal is issued from the system to reset the automatic clear timer of the system at the step G11. This step G11 is followed also when it is found at the decision step G01 that the answer for the initial decision step G01 is given in the negative with the operator's key-in operation found to be still incomplete. After the automatic clear timer of the system is thus started at the step G02 or is reset at the step G11, the subroutine program A06' proceeds to the decision step G03 and thereafter it is tested by the decision step G05 whether or not there is present a signal produced as rsult of the all-clear key 230 having been depressed, as in the subroutine program A06 described with reference to FIG. 11A.

Paper-Size Select Subroutine (A07; FIG. 12)

Figure 12:
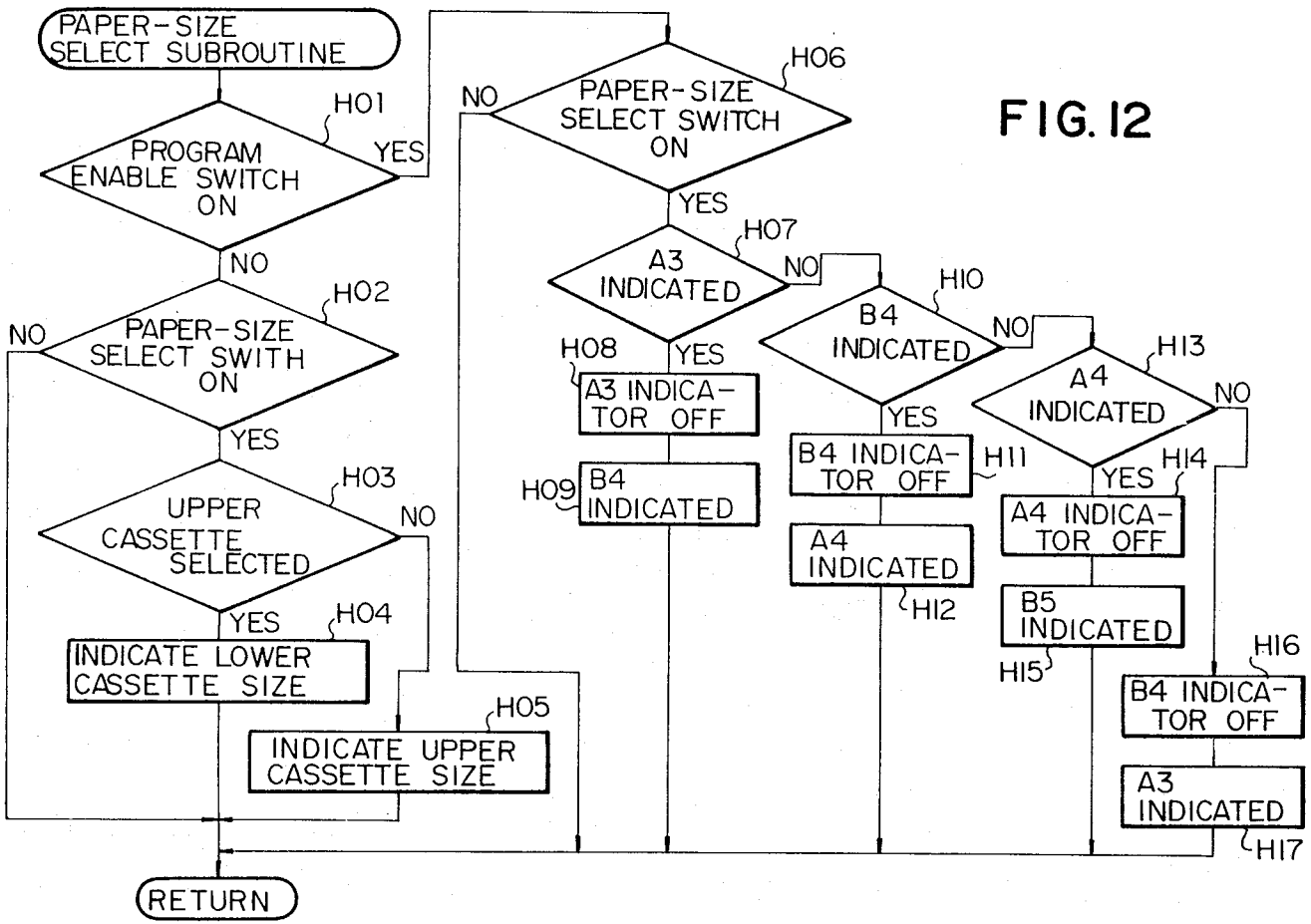
FIG. 12 is a flowchart of a paper-size select subroutine program included in the main routine program illustrated in FIG. 5.

Referring to FIG. 12, the paper-size select subroutine program A07 starts with a decision step H01 in which it is tested whether or not the program enable switch 226 on the control panel 200 (FIG. 2) is turned on. If it has turned out at this step H01 that the program enable switch 226 is turned off, it is further queried at another decision step H02 whether or not there is a signal produced with the paper-size select switch 216 on the control panel 200 turned on. If the answer for this decision step H02 is given in the negative, it is determined that there is currently no request for automatic selection of paper size so that the subroutine program returns to the initial decision step H01 and recycles the loop consisting of the steps H01 and H02 until the answer for the decision step H02 turns affirmative. If it is found at the decision step H02 that the paper-size select switch 216 is turned on, it is further questioned at a subsequent decision step H03 whether or not there is present a signal indicating that a particular one of the first and second paper supply cassettes 94 and 96 such as the latter one of the duplicator module 30 (FIG. 1) is currently selected for use. If it is found at the step H03 that this is the case, viz., the second paper supply cassette 96 is currently selected, an instruction signal is issued from the system at a process step H04 to activate any one of the paper-size select indicators 216*a* to 216*d* which is associated with the other of the paper-size cassettes 94 and 96. With the first paper-size cassette 94 thus newly selected in this case, the subroutine program reverts to the initial decision step H01. If it is found at the decision step H03 that not the second paper supply cassette 96 but the first paper supply cassette 94 is currently selected, an instruction signal is issued from the system at another process step H05 to activate the paper-size select indicator associated with the second paper supply cassette 96. With the second paper-size cassette 96 thus newly selected, the subroutine program recycles to the initial decision step H01. In these manners, either the first paper supply cassette 94 or the second paper supply cassette 96 is newly selected depending upon the paper supply cassette found to be selected when it is detected that the paper-size select switch 216 is depressed with the program enable switch 226 turned off.

If it is found at the initial decision step H01 that the program enable switch 226 is turned on, it is also queried at a decision step H06 whether or not there is the signal produced with the paper-size select switch 216 turned on. If the answer for this decision step H06 is given in the negative, the subroutine program returns to the preceding decision step H01 so that the loop consisting of the decision steps H01 and H06 is recycled until the answer for the step H06 turns affirmative. When it is found at the decision step H06 that the paper-size select switch 216 is turned on, it is further questioned at a subsequent decision step H07 whether or not there is present a signal indicating that any predetermined one of the paper size indicators 216*a* to 216*d* on the control supply panel 200 such as, for example, the first paper size indicator 216*a* assigned to the standardized A3 size is turned on. If it is found at the step H07 that this is the case, viz., the indicator 216*a* assigned to the A3 size is turned on, instruction signals are issued from the system at successive process steps H08 and H09 to de-activate the first paper size indicator 216*a* to turn off and activate another predetermined one of the paper size indicators 216*a* to 216*d* to turn on. The paper size indicator ths activated to turn on at the step H09 is herein assumed to be the second paper size indicator 216*b* assigned to the standardized B4 size. With the second paper size indicator 216*b* activated to turn on, the subroutine program reverts to the initial decision step H01.

If it is found at the decision step H07 that the indicator 216*a* assigned to the A3 size is turned off, then it is further questioned at a decision step H10 whether or not there is present a signal indicating that the second paper size indicator 216*b* is turned on. If it is found at the step H10 that this is the case, viz., the indicator 216*b* assigned to the B4 size is turned on, instruction signals are issued from the system at successive process steps H11 and H12 to de-activate the second paper size indicator 216*b* to turn off and activate one of the third and fourth paper size indicators 216*c* and 216*d* such as, for example, the third paper size indicator 216*c* assigned to the standardized A4 size. With the third paper size indicator 216*c* thus activated to turn on, the subroutine program also reverts to the initial decision step H01.

On the other hand, if it is found at the decision step H10 that the indicator 216*b* assigned to the B4 size is turned off, it is further tested at a decision step H13 whether or not there is present a signal indicating that the third paper size indicator 216*c* is turned on. If it is found at this step H13 that the indicator 216*c* assigned to the A4 size is turned on, then instruction signals are issued from the system at successive process steps H14 and H15 to de-activate the third paper size indicator 216*c* to turn off and activate the remaining one of the paper size indicators 216*a* to 216*d* to turn on. This particular indicator is in this instance the fourth paper size indicator 216*d* assigned to the standardized B5 size. With the fourth paper size indicator 216*d* thus activated to turn on, the subroutine program also returns to the initial decision step H01. If it is found at the decision step H13 that the indicator 216*c* assigned to the A4 size is turned off, then instruction signals are issued from the system at successive process steps H16 and H17 to de-activate the fourth paper size indicator 216*d* to turn off and activate the first paper size indicator 216*a* to turn on. With the first paper size indicator 216*a* thus activated to turn on, the subroutine program returns to the initial decision step H01.

In these manners the first, second, third and fourth paper size indicators 216*a*, 216*b*, 216*c* and 216*d* associated with the paper-size select switch 216 are activated to turn on recursively with the first indicator 216*a* activated to turn on subsequently to the fourth indicator 216*d*, when the program enable switch 226 is found to be turned on.

Interrupt Enable Subroutine (A08; FIGS. 13A, 13B and 13C)

Figure 13A:
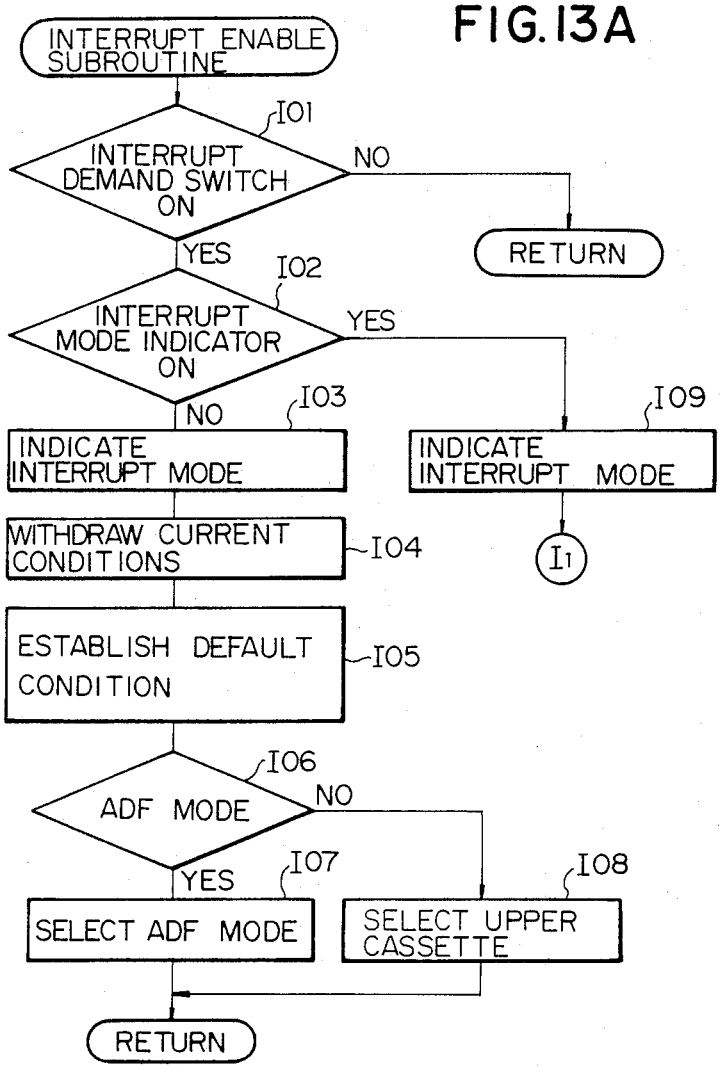
FIGS. 13A, 13B 13C are flowcharts of an interrupt enable subroutine program included in the main routine program illustrated in FIG. 5.

Referring to FIG. 13A, the interrupt enable subroutine program A08 which is started with the interrupt demand switch 214 on the control panel 200 depressed on the control panel 200 (FIG. 2). It is thus first tested at a decision step I01 whether or not the interrupt demand switch 214 is turned on. If it is found at this step I01 that the interrupt demand switch 214 is turned off, the subroutine program repeats the decision step I01 until the switch 214 is depressed. When the interrupt demand switch 214 is depressed so that the answer for the decision step I01 is given in the affirmative, it is further queried at a decision step I02 whether or not the interrupt mode indicator 214a associated with the switch 214 is turned on.

If it is found at the decision step I02 that the interrupt mode indicator 214a is turned off, an instruction signal is issued from the system at a step I03 for activating the indicator 214a to turn on and an instruction signal is issued from the system at a step I04 so that the data representative of the currently valid optional copying conditions and modes of operation which have been loaded with the program enable switch 226 depressed are temporarily withdrawn into the system memory. The interrupt copying mode being now established, the previously noted default rule conditions are selected in substitution for these optional copying conditions and modes of operation. Thus, instructions are further issued from the system at a process step I05 so that the various copying conditions and modes of operation available in the apparatus are initialized in accordance with the default rules. As described previously in regard to the default enable subroutine program A06 shown in FIG. 11, these default rule conditions are herein assumed to be prescribed to be such that the quantity of copies is one page for each document sheet, the automatic density select/display mode is active, the printing color is black, the magnification/reduction ratio is the one-by-one or lifesize ratio, and the book copying and duplexdocument copying modes are inactive.

The process step I05 is followed at a decision step I06 at which it is questioned whether or not the ADF-mode ready state is currently established in the apparatus with the ADF-mode ready state indicator 236 on the control panel 200 (FIG. 2) turned on. If the answer for this decision step I06 is given in the affirmative, the step I06 is followed at a step I07 by which an instruction signal is issued from the system to establish the automatic paper-size select mode with the corresponding mode indicator 238a activated to turn on the control panel 200. If it is found at the step I06 that there is no ADF-mode ready state established in the apparatus, particular one of the developing units 72a and 72b such as the upper developing unit 72a is selected in the image developing stage 72 (FIG. 1) also by a default rule at a step I08 and, thereupon, the subroutine program reverts to the initial decision step F01. By the steps I03 to I07 or the steps I03 to I06 and I08 is thus established the interrupt enable mode. The interrupt copying mode can be cancelled with the interrupt demand switch 214 depressed for a second time after the switch 214 has once depressed. In this instance, the interrupt mode indicator 214a is turned on to inform that the demand for interrupt as has been entered from the interrupt demand switch 214 has been cancelled.

Figure 13B:
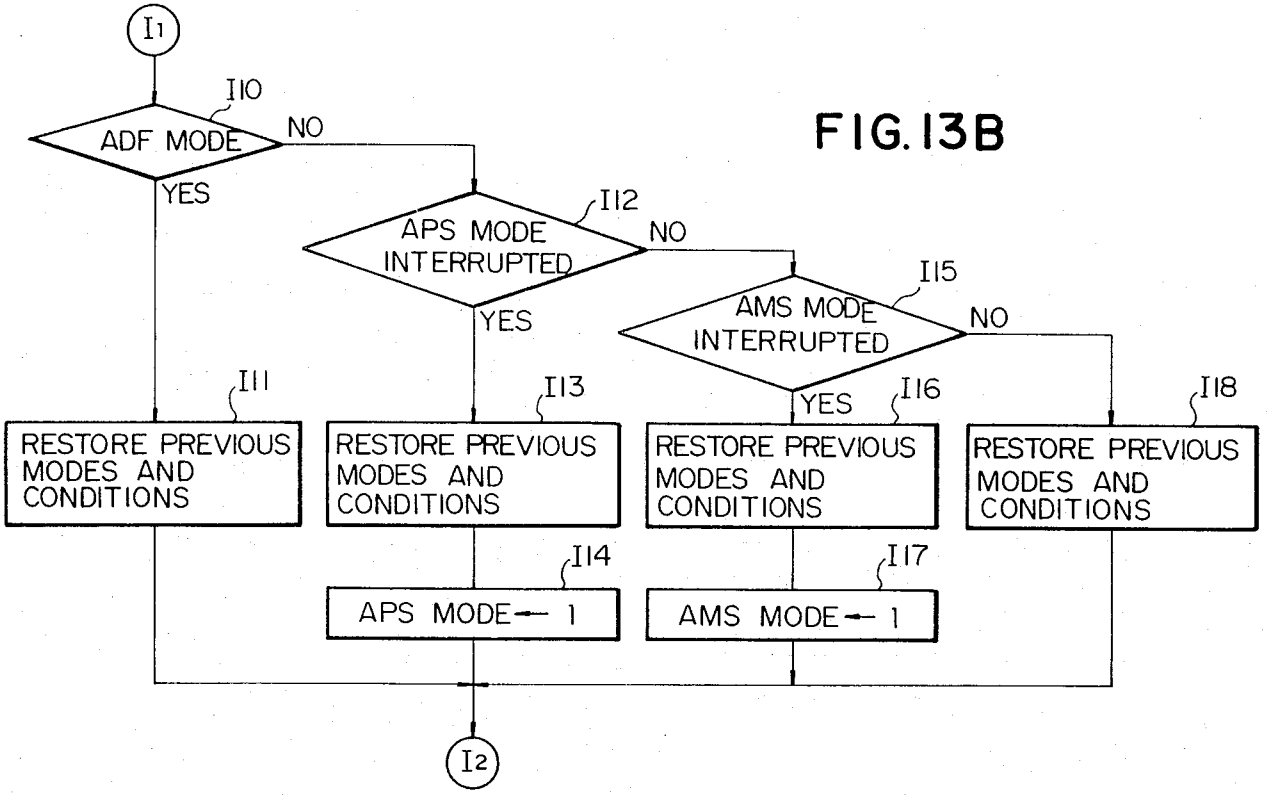
Figure 13C:
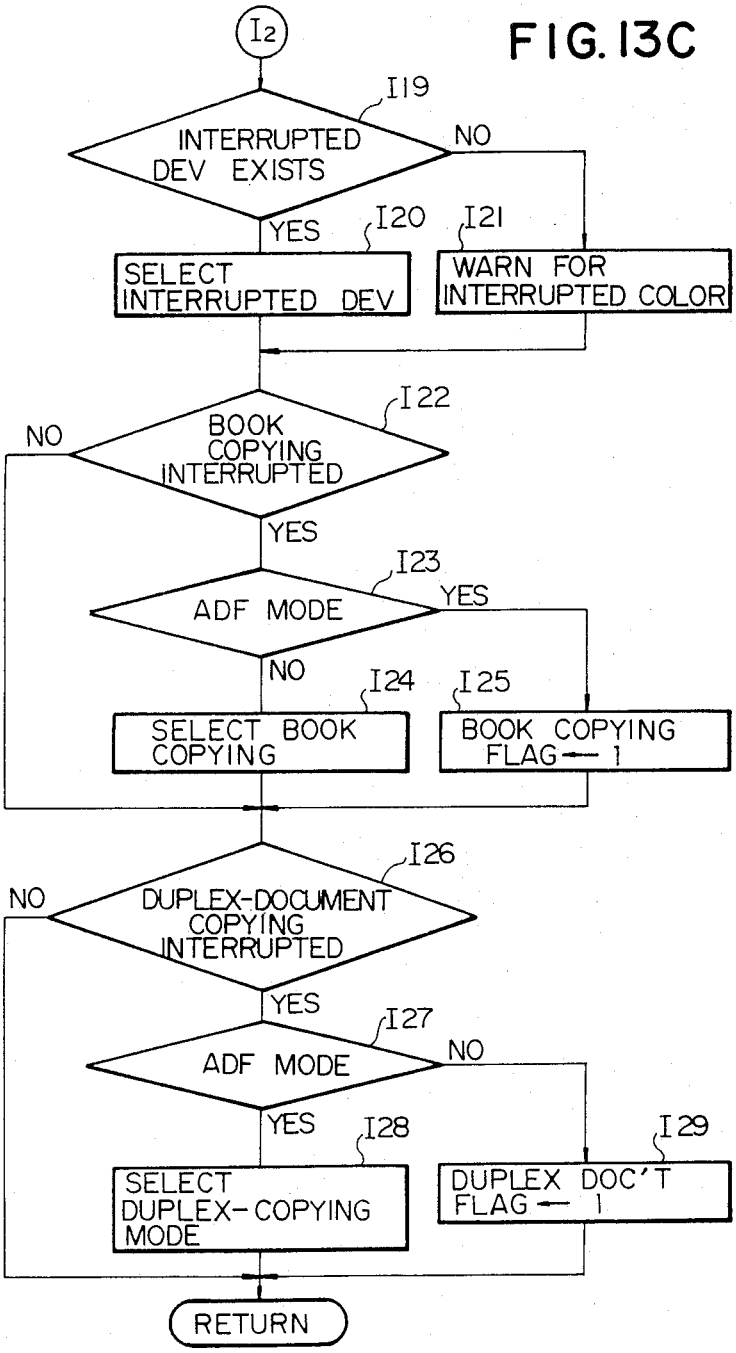

When it is thus found at the decision step I02 that the interrupt mode indicator 214a is turned on, the step I02 proceeds to a step I09 in which an instruction signal is issued from the system to de-activate the interrupt mode indicator 214a to turn off and thereafter the subroutine program jumps over to a decision step I10 shown in FIG. 13B through a connector "$I_1$". By the decision step 10 is tested whether or not the ADF-mode ready mode is currently established in the apparatus. If it is found by this decision step I10 that the ADF-mode ready mode is established with the ADF-mode ready state indicator 236 turned on, the step I10 is followed by a process step I11 by which are restored the data representative of the optional copying conditions and modes of operation temporarily withdrawn into the system memory by the previous step I04 (FIG. 13A). The default rule conditions which have been established by the preceding step I05 (FIG. 13A) are thus substituted by the optional copying conditions and modes of operation which had been selected before the interrupt demand switch 214 was depressed. The optional copying conditions and modes of operation thus called back from the system memory were stored into the system memory by the step F02 in the subroutine program A05 described with reference to FIG. 10 and include those for the quantity and size of copy sheets to be printed, the density of the images to be printed, the ratio of magnification or reduction for copying, and the automatic paper-size and magnification select modes of operation.

If it is determined at the decision step I10 that the ADF-mode ready state indicator 236 on the control panel 200 is turned off to mean that the ADF-mode ready state is currently not established, it is confirmed at a decision step I12 whether or not the program restored from the system memory includes an instruction demanding the automatic paper-size select mode of operation. If the answer for this decision step I12 is given in the affirmative, then the data excluding those for the size of copy sheets to be printed, the color of the images to be printed, the automatic paper-size and magnification select modes, and the book copying and duplex-document copying modes which may have been stored in the memory are established at a process step I13. In the apparatus are now established the optional copying conditions and modes of operation which may include those for the quantity of copy sheets to be printed, the density of the images to be printed, and the ratio of magnification or reduction for copying. In this instance, the instruction effective to select the size of copy sheets is assumed to be such that the second paper supply cassette 96 in particular is to be predominantly used in the paper feed-in and feed-out mechanism 46 (FIG. 1). After the conditions represented by the data restored from the system memory have thus been established in the apparatus, an APS mode inhibitive flag in the form of a logic "1" bit is set at a step I14 to indicate that the automatic paper-size select mode of operation is currently unexecutable under the condition in which the ADF-mode ready state is not established.

If it is found at the decision step I12 that an instruction demanding the automatic paper-size select mode of operation is not included in the program restored from the system memory, it is now confirmed at a decision step I15 whether or not the program stored in the system memory includes an instruction demanding the automatic magnification select mode of operation. If the answer for this decision step I15 is given in the affirmative, then the data excluding those for the ratio of magnification or reduction for copying, the color of the images to be printed, the automatic paper-size and magnification select modes, the book copying and duplex-document copying modes which may have been restored from the system memory are established at a step I16. In the apparatus are now established the optional copying conditions and modes of operation which may include those for the quantity and size of copy sheets to be printed, and the density of the images to be printed. In this instance, the instruction effective to select the ratio of magnification or reduction for copying is assumed to be such as to select the one-by-one or lifesize copying. After the conditions restored from the system memory have thus been established in the apparatus, an AMS mode inhibitive flag in the form of a logic "1" bit is set to indicate that the automatic magnification select mode of operation is currently unexecutable under the condition in which the ADF-mode ready state is not established.

If it is determined at the decision step I15 that an instruction for the automatic magnification select mode of operation is not included in the program restored from the system memory, then the data excluding those for the color of the images to be printed, the automatic paper-size and magnification select modes, and the book copying and duplex-document copying modes which may have been restored from the memory are established at a step I18. In the apparatus are now established the optional copying conditions and modes of operation which may include those for the quantity and size of copy sheets to be printed, the density of the images to be printed, and the optional ratio of magnification or reduction for copying.

Subsequently to each of the steps I11, I14, I17 and I18 thus performed, the subroutine program jumps over to a decision step I19 shown in FIG. 13C through a connector "$I_2$". Thus, any of the steps I05, I08, I11 and I12 is followed by the decision step I19 at which is queried whether or not the color designated by the color data included in the program restored from the system memory is currently available in the image developing stage 72 of the image reproducing arrangement 44 (FIG. 1). If it is determined at this step I19 that either the upper developing unit 72*a* or the lower developing unit 72*b* of the image developing stage 72 stores a toner of the designated color, an instruction signal is issued from the system to select the particular developing unit 72*a* or 72*b* at a process step I20. In case it is found at this step I20 that neither the upper developing unit 72*a* nor the lower developing unit 72*b* of the image developing stage 72 stores a toner of the designated color, then an instruction signal is issued from the system so that the corresponding one of the color indicators 234*a*, 234*b* and 234*c* on the control panel 200 is activated to flicker at a step I21 to request the operator to exchange one of the developing units 72*a* and 72*b* to exchange with a proper developing unit storing a toner of the designated color.

The step I20 or step I21 is followed by a decision step I22 at which it is questioned whether or not the program restored from the system memory includes an instruction demanding the book copying mode of operation. If the answer for the decision step I22 is given in the affirmative, then it is further questioned at a subsequent decision step I23 whether or not the ADF-mode ready state indicator 236 on the control panel 200 is turned on with the ADF-mode ready state established. If the answer for this decision step I23 is also given in the affirmative, an instruction signal is issued from the system to have the automatic document feed module 32 (FIG. 1) conditioned to be ready for the book copying mode of operation by a process step I24. If it is determined at the decision step I23 that the ADF-mode ready state indicator 236 is turned off, then a book-copying mode (BCM) inhibitive flag in the form of a logic "1" bit is set at a step I25.

Either the process step I24 or step I25 is followed by a subsequent decision step I26 at which is questioned whether or not the program restored from the system memory includes an instruction demanding the duplex-document copying mode of operation. If it is found at the decision step I22 that an instruction demanding the book copying mode of operation is not included in the program restored from the system memory, the subroutine program also proceeds to the decision step I26. If the answer for the decision step I26 is given in the affirmative, then it is further questioned at a subsequent decision step I27 whether or not the ADF-mode ready state indicator 236 on the control panel 200 is turned on with the ADF-mode ready state established. If the answer for this decision step I27 is also given in the affirmative, an instruction signal is issued from the system to have the automatic document feed module 32 conditioned to be ready for the duplex-document copying mode of operation at a process step I22. If it is determined at the decision step I21 that the ADF-mode ready state indicator 236 is turned off, then a duplex-document copying mode inhibitive flag in the form of a logic "1" bit is set at a step I29.

Color Select Subroutine (A09; FIG. 14)

Figure 14:
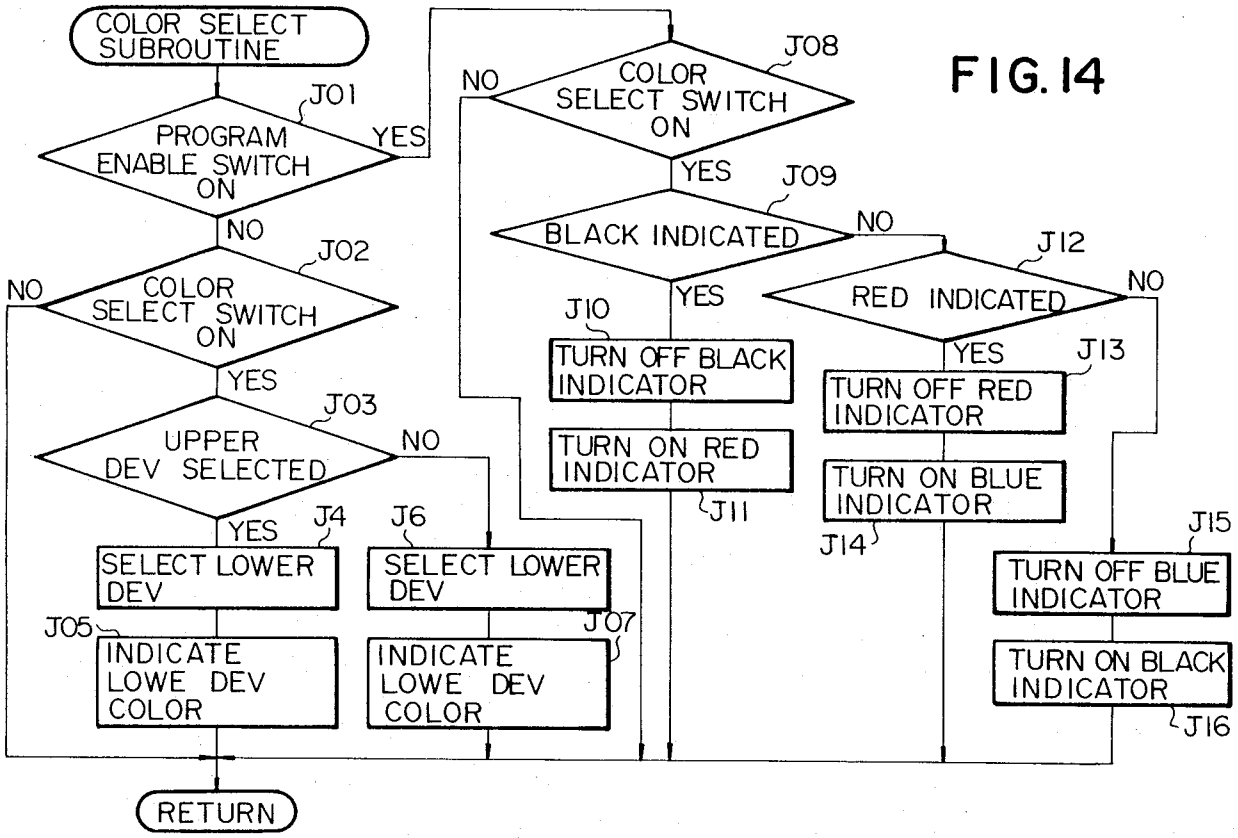
FIG. 14 is a flowchart of a color select subroutine program included in the main routine program illustrated in FIG. 5.

Referring to FIG. 14, the color select subroutine program A09 starts with a decision step J01 in which it is tested whether or not the program enable switch 226 on the control panel 200 (FIG. 2) is turned on. If it has turned out at this step J01 that the program enable switch 226 is turned off, it is further queried at another decision step J02 whether or not there is a signal produced with the color select switch 234 on the control panel 200 turned on. If the answer for this decision step J02 is given in the negative, it is determined that there is currently no request for automatic selection of color so that the subroutine program returns to the initial decision step J01 and recycles the loop consisting of the steps J01 and J02 until the answer for the decision step J02 turns affirmative. If it is found at the decision step J02 that the color select switch 234 is turned cn, it is further questioned at a subsequent decision step J03 whether or not there is present a signal indicating that a particular one of the lower and upper developing units 72*a* and 72*b* such as the latter one in the developer state 72 (FIG. 1) is currently selected for use. If it is found at the step J03 that this is the case, viz., the lower developing unit 72*b* is currently selected, an instruction signal is issued from the system at a process step J04 to select the other of the developing units 72*a* and 72*b* and an instruction signal is issued from the system at a subsequent process step J05 to activate the color indicator associated with the newly selected developing unit. With the upper developing unit 72*a* thus selected in this case, the subroutine program reverts to the initial decision step J01. If it is found at the decision step J03 that not the lower developing unit 72*b* but the upper developing unit 72*a* is currently selected, then an instruction signal is issued from the system at a process step J06 to select the other of the developing units 72*a* and 72*b*, viz., the lower developing unit 72*b* and an instruction signal is issued from the system at a subsequent process step J07 to activate the color indicator associated with the lower developing unit 72*b*. With the second paper-size cassette 96 thus selected and, the subroutine program recycles to the initial decision step J01. In these manners, either the upper developing unit 72*a* or the lower developing unit 72*b* is newly selected depending upon the developing unit found to have been selected when it is found that the color select switch 234 is depressed with the program enable switch 226 turned off.

If it is found at the initial decision step J01 that the program enable switch 226 is turned on, it is also queried at a decision step J08 whether or not there is the signal produced with the color select switch 234 turned on. If the answer for this decision step J08 is given in the negative, the subroutine program returns to the preceding decision step J01 so that the loop consisting of the decision steps J01 and J08 is recycled until the answer for the step J08 turns affirmative. When it is found at the decision step J08 that the color select switch 234 is turned on, it is further questioned at a subsequent decision step J09 whether or not there is present a signal indicating that any predetermined one of the color indicators 234*a* to 234*d* on the control supply panel 200 such as, for example, the first color indicator 234*a* assigned to black is turned on. If it is found at the step J09 that this is the case, viz., the indicator 234*a* assigned to black is turned on, instruction signals are issued from the system at successive process steps J10 and J11 to de-activate the first color indicator 234*a* to turn off and activate another predetermined one of the color indicators 234*a* to 234*d* to turn on. The color indicator thus activated to turn on at the step J11 is herein assumed to be the second color indicator 234*b* assigned to red (magenta). With the second color indicator 234*b* activated to turn on, the subroutine program reverts to the initial decision step J01.

If it is found at the decision step J09 that the indicator 234*a* assigned to black is turned off, then it is further questioned at a decision step J12 whether or not there is present a signal indicating that the second color indicator 234*b* is turned on. If it is found at the step J12 that this is the case, viz., the indicator 234*b* assigned to red is turned on, instruction signals are issued from the system at successive process steps J13 and J14 to de-activate the second color indicator 234*b* to turn off and activate the third color indicator 234*c* assigned to blue (cyan). With the third color indicator 234*c* thus activated to turn on, the subroutine program also reverts to the initial decision step J01. On the other hand, if it is found at the decision step J12 that the indicator 234*b* assigned to red, instruction signals are issued from the system at successive process steps J15 and J16 to de-activate the third color indicator 234*c* to turn off and activate the first color indicator 234*a* to turn off. With the first color indicator 234*a* thus activated to turn on, the subroutine program returns to the initial decision step J01.

In these manners, the color indicators 234*a*, 234*b* and 234*c* associated with the color select switch 234 are activated to illuminate recursively with the switch 234 depressed repeatedly, provided the program enable switch 226 has been depressed. The indicators 234*a*, 234*b* and 234*c* are activated to turn on in this sequence with the first indicator 234*a* activated subsequently to the third indicator 234*c*. If the color select switch 234 is depressed without the program enable switch 226 depressed preliminarily, any one of the developing units 72*a* and 72*b* in the image developing stage 72 (FIG. 1) is seleted from the color select switch 234.

Book/Duplex-Document Copying Mode Subroutine (A10; FIG. 15)

Referring to FIG. 15, the book/duplex-document copying mode subroutine program A10 starts with a decision step K01 in which it is tested whether or not there is a signal produced with the book copying mode select switch 240 on the control panel 200 (FIG. 2) turned on. If the answer for this decision step K01 is given in the negative, it is determined that there is currently no request for automatic selection of color. If it is found at the decision step K01 that the book copying mode select switch 240 is turned on, it is further questioned at a subsequent decision step K02 whether or not the indicator 240*a* associated with the switch 240 is turned on. If it is found at the step K02 that the indicator 240*a* is turned off, an instruction signal is issued from the system at a process step K03 to activate the indicator 240*a* to turn on and a book copying enable signal of, for example, logic "1" bit is issued from the system at a process step K04 and is transmitted to the second microprocessor 302 of the control circuit shown in FIG. 3. If it is found at the decision step K02 that the indicator 240*a* is turned on, an instruction signal is issued from the system at a process step K05 to de-activate the indicator 240*a* to turn turned off and a book copiing disable signal of, for example, logic "0" bit is issued from the system at a process step K06 and is transmitted to the second microprocessor 302 of the control circuit.

If it is found at the initial decision step K01 that the book copying mode select switch 242 is turned off, the step K01 is followed by a decision step K08 which may also follow either the process step K04 or K06. At this decision step K07 is detected whether or not there is a signal produced with the duplex-document copying mode select switch 242 on the control panel 200 turned on. If the answer for this decision step K07 is given in the negative, it is determined that there is currently no request for automatic selection of color so that the subroutine program returns to the initial decision step K01. If the decision step K07 is reached directly from the initial decision step K01, it is determined that there is neither a request for book copying mode of operation not a request for duplex-document copying mode of operation. In this instance, the subroutine program will recycle the loop consisting of the steps K01 and K07 until the answer for at least one of the decision steps K01 and K07 turns affirmative.

If it is found at the decision step K07 that the duplex-document copying mode select switch 242 is turned on, it is further questioned at a subsequent decision step K08 whether or not the indicator 242*a* associated with the switch 242 is turned on. If it is found at the step K08 that the indicator 242*a* is turned off, a instruction signal is issued from the system at a process step K09 to activate the indicator 242*a* to turn on and a duplex-document copying enable signal of, for example, logic "1" bit is issued from the system at a process step K10 and is transmitted to the third microprocessor 304 of the control circuit shown in FIGS. 3 and 4. If it is found at the decision step K08 that the indicator 242*a* is turned on, an instruction signal is issued from the system at a process step K11 to de-activate the indicator 242*a* to turn turned off and a duplex-document copying disable signal of, for example, logic "0" bit is issued from the system at a process step K12 and is transmitted to the third microprocessor 304 of the control circuit. The book/duplex-document copying mode subroutine program A10 is thus used to establish either the book copying mode or the duplex-document copying mode when the book copying mode select switch 240 or the duplex-document copying mode switch 242 is depressed. An instruction signal for the book copying mode of operation is passed to the second microprocessor 302 and an instruction signal for the duplex-document copying mode of operation is transmitted to the third microprocessor 304, as above described.

Mode Restore Subroutine (A11; FIG. 16) Referring to FIG. 16, the mode restore subroutine program A11 is to be executed when a shift is made from an ADF-mode of operation to a non-ADF mode of operation. Thus, the mode restore subroutine program starts with a decision step L01 to confirm whether or not the ADF-mode ready state is newly brought into effect with the ADF-mode ready state indicator 236 on the control panel 200 (FIG. 2) turned on. If it is determined at this decision step L01 that the ADF-mode ready state is established, it is further queried at a subsequent decision step L02 whether or not there is present the APS mode inhibitive flag of a logic "1" bit indicating that the automatic paper-size select mode of operation is currently unexecutable. If the answer for this decision step L02 is given in the affirmative, instruction signals are issued from the system at steps L03 and L04 to clear the APS mode inhibitive flag and to set up the automatic paper-size select mode of operation in the apparatus.

If it is found at the decision step L02 that there is present no APS mode inhibitive flag of logic "1" bit, it is questioned at another decision step L05 whether or not there is present the AMS mode inhibitive flag of a logic "1" bit indicating that the automatic magnification select mode of operation is currently unexecutable. If the answer for this decision step L05 is given in the affirmative, instruction signals are issued from the system at steps L06 and L07 to clear the AMS mode inhibitive flag and to set up the automatic magnification select mode of operation in the apparatus. If it is found at the decision step L05 that there is present no AMS mode inhibitive flag of logic "1" bit, it is questioned at still another decision step L08 whether or not there is present a duplex-document copying inhibitive flag of, for example, a logic "1" bit indicating that the duplex-document copying mode of operation is currently unexecutable. If the answer for this decision step L08 is given in the affirmative, instruction signals are issued from the system at steps L09 and L10 to clear the duplex-document copying inhibitive flag and to set up the duplex-document copying mode of operation in the apparatus.

Subsequently to any of the steps L04, 107 and L10 or if the answer for the initial decision step L01 is given in the negative without the ADF-mode ready state established in the apparatus, it is confirmed at a decision step L11 whether or not the ADF-read state is absent or has been cancelled. If it is determined at the decision step L11 that this is the case, then it is queried at a subsequent decision step L12 whether or not there is present a book copying mode inhibitive flag of, for example, a logic "1" bit indicating that the book copying mode of operation is currently unexecutable. If the answer for this decision step L12 is given in the affirmative, instruction signals are issued from the system at steps L13 and L14 to clear the book copying mode inhibitive flag and to set up the book copying mode of operation in the apparatus, whereupon the subroutine program recycles to the initial decision step L01. If it is found at the decision step L11 that there currently is no ADF-mode ready state established in the apparatus or if it is determined at the decision step L12 there is present no book copying mode inhibitive flag, the subroutine program recycles to the initial dec.ision step L01.

Duplication Execute Subroutine (A12; FIGS. 17A to 17G)

Figure 17A:
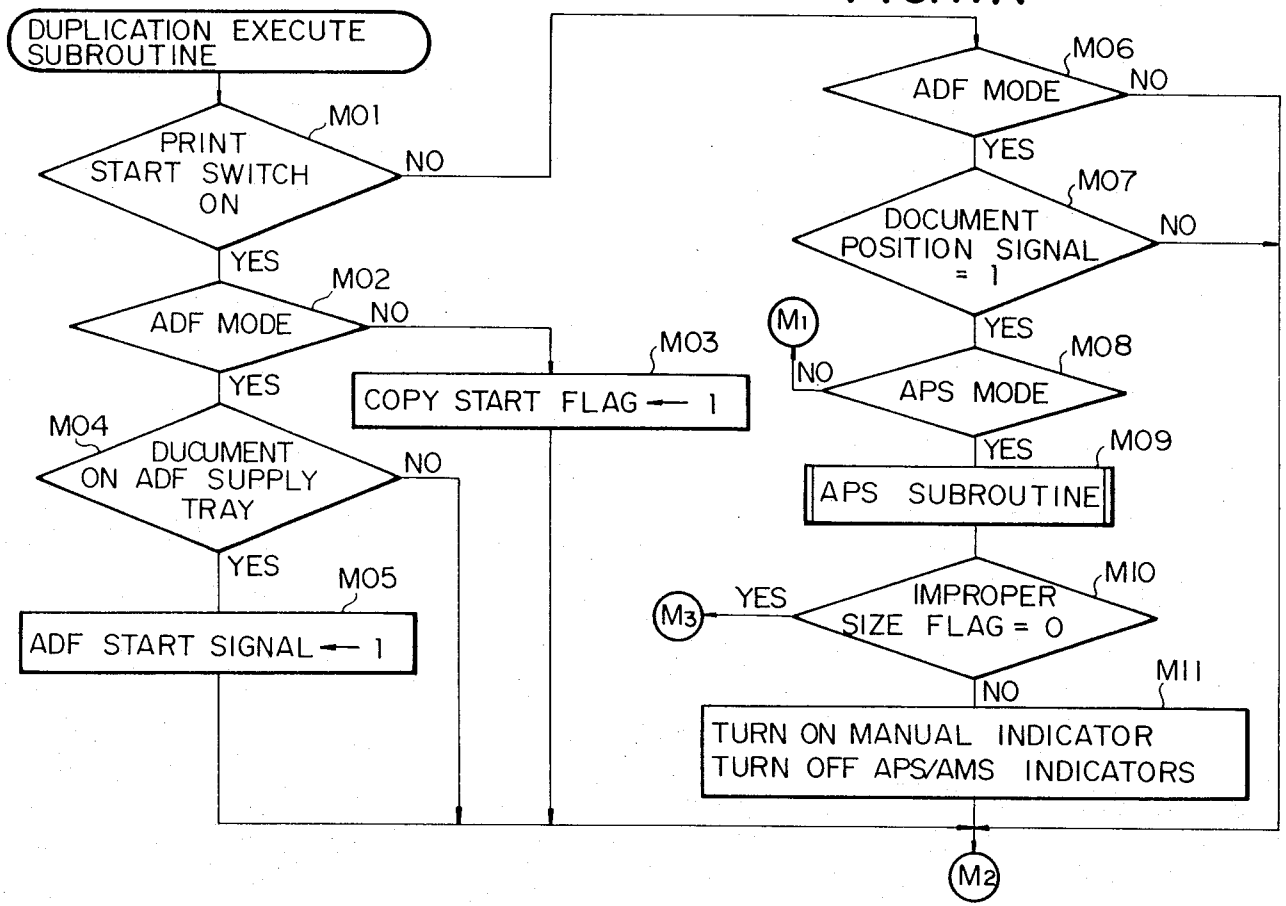
FIGS. 17A to 17G are flowcharts of a duplication execute subroutine program included in the main routine program illustrated in FIG. 5.
Figure 17D:
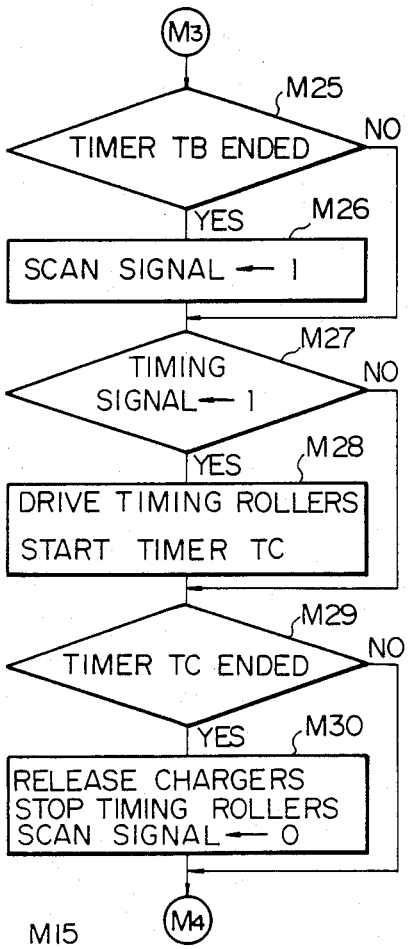

Referring to FIGS. 17A to 17G, first particularly to FIG. 17A, the duplication execute subroutine program A12 starts with a decision step M01 to determine whether or not there is a signal produced with the print start switch 206 on the control panel 200 (FIG. 2) depressed. If it is found at this step M01 that this is the case, it is further queried at a subsequent decision step M02 whether or not an ADF-mode ready state is currently established with the ADF-mode ready state indicator 236 turned on. If the answer for this decision step M02 is given in the negative, a print-start flag of, for example, a logic "1" bit is set at a step M03 to indicate that a copying operation for a manually supplied document sheet may be started. If, on the other hand, it is found at the decision step M02 that there is established an ADF-mode ready state, then it is further questioned at a subsequent decision step M04 whether or not there is a document sheet inserted into the document supply unit 128 of the automatic document feed module 32 (FIG. 1). This decision is made on the basis of a signal supplied from the document sensor 188 located within the document supply unit 128. If it is determined at the step M04 that there is a document sheet in the document supply unit 128, then an instruction signal of, for example, a logic "1" bit is supplied at a step M05 to the third microprocessor 304 of the control circuit shown in FIGS. 3 and 4. In response to this instruction signal, the third microprocessor 302 is enabled to execute the document feed control subroutine program C03 in the main routine program shown in FIG. 6 so that the document feed roller 142 in the document supply unit 128 is driven for rotation to transfer the detected document sheet into the document transport unit 130 of the automatic document feed module 32.

In the absence of a signal produced with the print start switch 206 on the control panel 200 depressed, the answer for the initial decision step M01 is given in the negative. In this instance, it is also queried at a decision step M06 whether or not an ADF-mode ready state is established with the ADF-mode ready state indicator 236 turned on. If the answer for this decision step M06 is given in the affirmative, it is further tested at a decision step M07 whether or not the document sheet transferred into the document transport unit 130 of the automatic document feed module 32 has reached the correct document position on the document table 40 of duplicator module 30. This test is made through detection of a signal of a logic "1" bit or "0" supplied from the third microprocessor 304 executing the document feed/recirculate/discharge discharge subroutine program C03 in its main routine program shown in FIG. 7 as will described in more detail. If such a signal supplied from the third microprocessor 304 is found to be of the logic "1" bit meaning that the document sheet is correctly placed on the document table 40, it is now detected at a decision step M08 whether or not the automatic paper-size select mode of operation has been selected with the corresponding indicator 238*a* on the control panel 200 turned on. If the answer for this decision step M08 is given in the affirmative, the subroutine program proceeds to an automatic papersize select subroutine program M09 the details of which will be hereinafter described with reference to FIG. 17F.

Upon completion of the automatic paper-size select subroutine program M09, the subroutine program further proceeds to a decision step M10 to question whether or not there is present an improper size flag of, for example, a logic "0" bit. This improper size flag is produced in the automatic paper-size select subroutine program M09 and, with the logic "0" bit, indicates that the size of the copy sheets currently stored in one of the first and second paper supply cassettes 94 and 96 (FIG. 1) conforms to the size of the supplied document sheet on the document table 40. Thus, if it is found that the size of the copy sheets in none of the paper supply cassettes 94 and 96 (FIG. 1) conforms to the size of the supplied document sheet, the improper size flag produced in the automatic paper-size select subroutine program M09 is of a logic "1" bit. If it is determined at th decision step M10 that there is present such an improper size flag of logic "1" bit so that the answer for the step M10 is given in the negative, the step M10 is followed by a process step M11 at which the manually controlled mode of operation is selected to activate the mode indicator **238*c* on the control panel 200 to turn on. Simultaneously, the automatic paper-size select mode and automatic magnification select modes of operation are disabled with the respectively corresponding mode indicators 238*a* and 238*b*** de-activated to turn off.

Figure 17B:
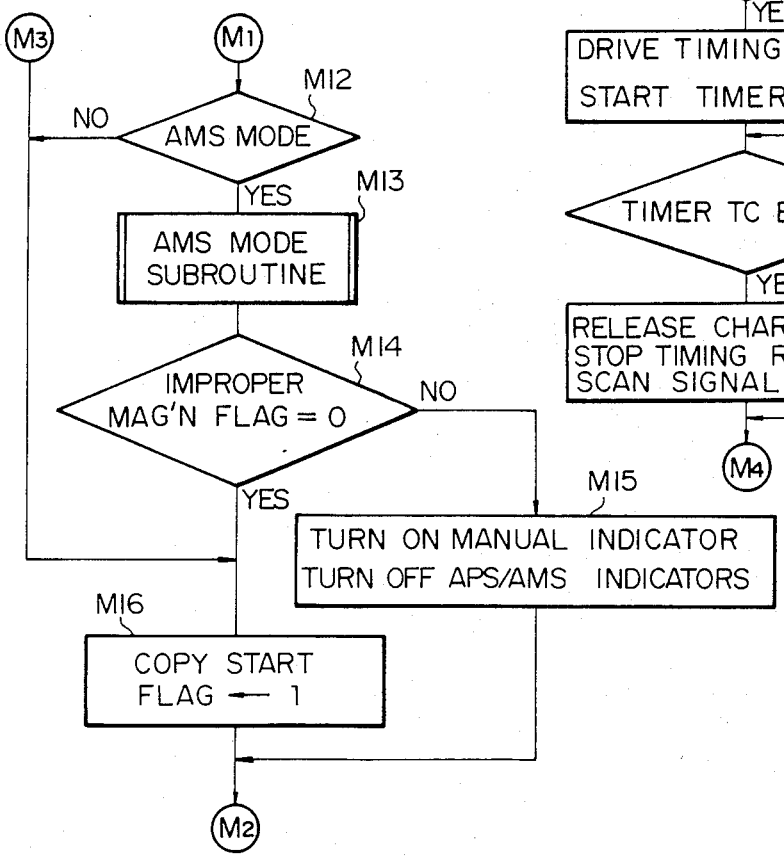

If it is determined at the decision step M10 that there is present an improper size flag of logic "0" bit so that the answer for the step M10 is given in the affirmative, the subroutine program jumps from the step M10 to a decision step M12 shown in FIG. 17B through a connector $M_1$. This decision step M12 is also followed when it is found at the preceding step M08 that the automatic paper-size select mode of operation is not selected with the corresponding indicator **238*a* on the control panel 200 turned off. At this step M12 is queried whether or not the automatic magnification select mode of operation has been selected with the corresponding mode indicator 238*b* turned on. If the answer for the decision step M12 is given in the affirmative, the subroutine program proceeds to an automatic magnification select subroutine program M13 through which the ratio of magnification or reduction as calculated on the basis of the detected size of the document sheet is, if determined to be acceptable for the capacity of the apparatus informed to the second microprocessor 302. The details of such a subroutine program M13 will be hereinafter described with reference to FIG. 17G. When the automatic magnification select subroutine program M13 is complete, the subroutine program further proceeds to a decision step M14 to question whether or not there is present an improper magnification/reduction flag of, for example, a logic "0" bit. This improper magnification/reduction flag is produced in the automatic magnification select subroutine program M13 and, with the logic "0" bit, indicates that the size of the copy sheets currently stored in one of the first and second paper supply cassettes 94 and 96 (FIG. 1) is allowable for the magnification or reduction ratio calculated from the size of the supplied document sheet on the document table 40. Thus, if it is found that the size of the copy sheets in none of the paper supply cassettes 94 and 96 (FIG. 1) is allowable for the calculated magnification or reduction ratio, the improper magnification/reduction flag produced in the automatic magnification select subroutine program M13 is of a logic "1" bit. If it is determined at the decision step M10 that there is present such an improper magnification/reduction flag of logic "1" bit so that the answer for the step M14 is given in the negative, the step M10 is followed by a process step M15 at which the manually controlled mode of operation is selected to activate the mode indicator 238*c* on the control panel 200 to turn on. Simultaneously, the automatic paper-size select mode and automatic magnification select modes of operation are disabled with the respectively corresponding mode indicators 38*a* and 238*b*** de-activated to turn off.

If it is determined at the decision step M12 that there is present an improper magnification/reduction flag of logic "0" bit so that the answer for the step M12 is given in the affirmative, the step M12 is now followed by a process step M16 at which a copying start flag of, for example, a logic "1" bit is set. This decision step M16 is also followed when it is found at the preceding decision step M12 that the automatic magnification select mode of operation is not selected with the corresponding indicator **238*b*** turned off. Thus, the copying start flag of logic "1" bit is set when:

(1) both of the automatic paper-size and magnification select modes of operation are found to be established at the steps M08 and M12, respectively, and both the improper size and magnification/reduction flags are found to be lowered (each to logic "0" bit) at the steps M10 and M14, respectively;

(2) the automatic paper-size select mode of operation is found to be established at the step M08 and the improper size flag is found to be lowered at the step M10, but the automatic magnification select mode of operation is found to be unestablished at the step M12;

(3) the automatic paper-size select mode of operation is found to be unestablished at the step M08, but the automatic magnification select mode of operation is found to be established at the step M12 and the improper magnification/reduction flag is found to be lowered at the step M14, or (4) both of the automatic paper-size and magnification select modes of operation are found to be unestablished at the steps M08 and M12, respectively.

Figure 17C:
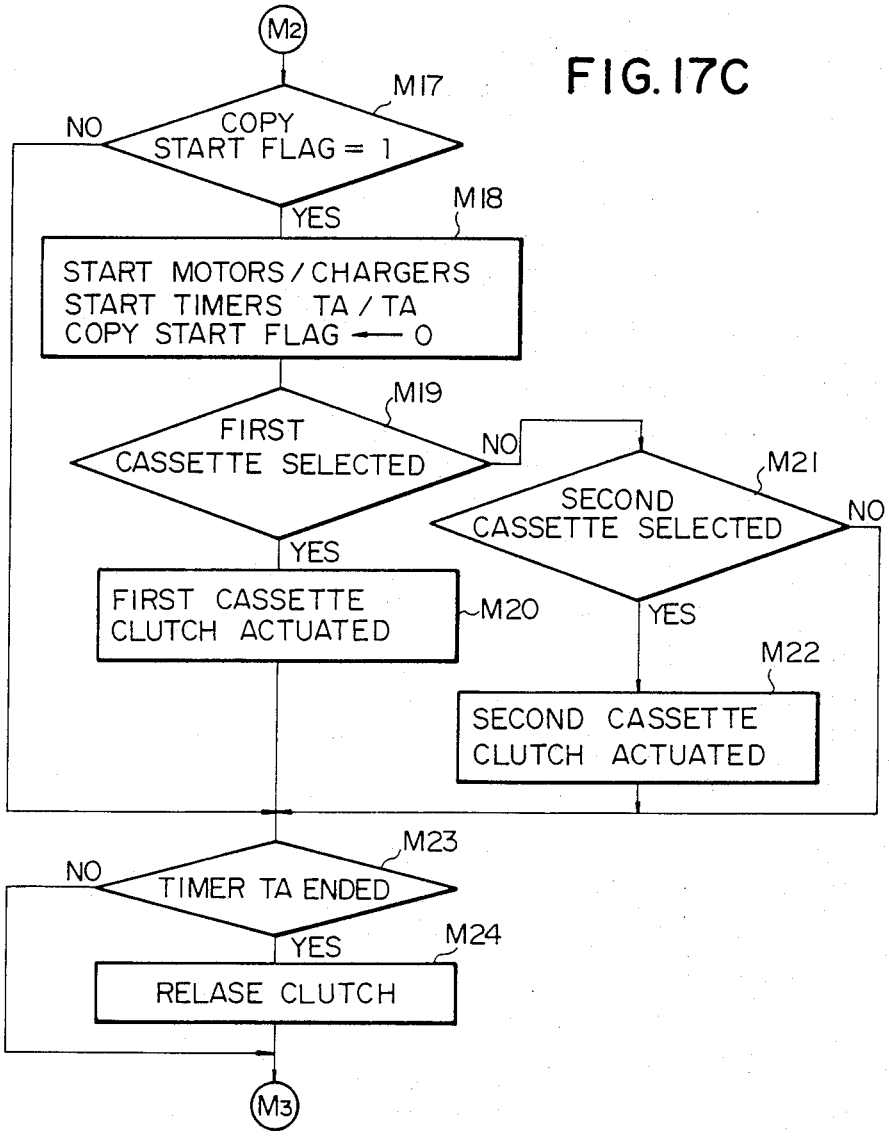

Subsequently to any of the process steps M03, M05, M11, M15 and M16, or when it is found at the decision step M04 that there is no document sheet detected in the document supply unit 128 of the automatic document feed module 32, at the decision step M06 that there is no ADF-mode ready state established M06, or at the decision step M107 that document sheet transferred into the document transport unit 130 of the automatic document feed module 32 has reached the correct document position on the document table 40, the subroutine program proceeds through a connector $M_2$ to a decision step M17 shown in FIG. 17C. At this decision step M17 is questioned whether or not there has been set a copying start flag of logic "1". If it is found at this step M17 that this is the case, the step M17 is followed by a process step° M18 at which instruction signals are issued from the system to start the various drive and actuator means included in or associate with the image reproducing arrangement 44 of duplicator module 30 shown in FIG. 1. These drive and control means means will include the main drive motor 68, the actuator means for the main charging stage 70, the actuator means for the selected developer unit **72*a* or 72*b*, the actuator means for the image transfer charging stage 74, the actuator means for the separation charging stage 76, the actuator means for the main charge eraser lamp 80, the auxiliary charging stage 82, the actuator means for the auxiliary charge eraser lamp 84**, and so on. The copying start flag is then shifted to a logic "0" bit and, furthermore, first and second system timers (herein referred to as timers "TA"

and "TB", respectively) incorporated in the system are enabled to start counting operation. By the first system timer "TA" is prescribed the timing at which the clutch for the paper feed roller 98 associated with the first paper for the paper feed roller 98 associated with the first paper supply cassette 94 or the clutch for the paper feed roller 100 associated with the second paper supply cassette 96 is to be de-energized and uncoupled. By the second system timer "TB" is prescribed the timing at which the scanner forming part of the optical scanning system 42 of duplicator module 30 is to be initiated into motion to scan the document sheet on the document table 40.

The process step M18 is followed by a decision step M19 at which is questioned whether or not the first paper supply cassette 96 has been selected. If it is found at this step M19 that this is the case, an instruction signal is issued from the system at a step M20 to actuate the clutch for the paper feed roller 98 associated with the first paper supply cassette 94. If it is determined at the decision step M that the first paper supply cassette 96 has not been selected, then it is queried at a decision step 21 whether or not the second paper supply cassette 98 has been selected. If it is found at this step M21 that this is the case, an instruction signal is issued from the system at a step M22 to actuate the clutch for the paper feed roller 100 associated with the second paper supply cassette 96.

Subsequently to the step M20 or M22 or w.hen it is found at the decision step M17 that there is present no copying start flag of logic "1" bit or at the decision step M21 that the second paper supply cassette 96 has not been selected, then it is tested at a decision step M23 whether or not the first system timer "TA" has terminated its counting operation. When the answer for this decision step M23 is given in the affirmative, an instruction signal issued from the system at a step M24 so that the clutch for the paper feed roller 98 or 100 associated with the paper supply cassette 94 or 96 which has been selected for use is de-energized and uncoupled. Subsequently to this step M24 or when it is determined at the preceding decision step M23 that the system timer "TA" is still in operation, the subroutine program proceeds through a connector $M_3$ to a decision step M24 shown in FIG. 17D and queries whether or not the time prescribed on the second system timer "TB" has lapsed. If the answer for this decision step M25 is given in the affirmative, a scan start signal of, for example, a logic "1" bit is generated in the system and is supplied to the second microprocessor 302. The second microprocessor 302 is now enabled to issue an instruction signal to start exposure lamp 50 and mirrors 52, 54 and 56 of the optical scanning system 42 (FIG. 1) for movement.

Subsequently to the step M26 or when it is found at the preceding decision step M25 that the second system timer "TB" is still in operation, then it is queried at a decision step M27 whether or not there is present a timing signal of, for example, a logic "1" bit. This timing signal is supplied from the second microprocessor 302 which is responsive to the signals output from the home position sensor 176 and first and second scan timing sensors 178 and 180 (FIG. 1). When it is determined at the decision step M27 that there is present the timing signal of logic "1" bit, then an instruction signal is issued from the system to energize the actuator means such as a solenoid-operated clutch for the timing rollers 108, which are accordingly driven for rotation. A copy sheet which has been fed and transported either from the first paper supply cassette 94 or from the second paper supply cassette 96 is allowed to pass between the timing rollers 108 into contact with the peripheral surface of the photosensitive image transfer drum 66. The toner particles which have been applied to the peripheral surface of the image transfer drum 66 are thus transferred to the surface of the copy sheet by by means of the image transfer charging stage 74. At the step M28 is further started a third system timer (herein referred to as timer "TC") which dictates the timing at which the scanning operation is to be terminated, the timings at which the actuator means for the various charging stages of the image reproducing arrangement 44 are to be de-energized, and the timing at which the clutch for the timing rollers 108 is to be de-energized. These timings are determined on the basis of the size of the copy sheets as detected at the decision step M19 or M21 and the selected ratio of magnification or reduction.

It is thereafter questioned at a decision step M29 whether or not the timings prescribed by the third system timer "TC" have been reached. If the answer for this decision step M29 is given in the affirmative, instruction signals are issued from the system from the system so that the scanning operation is terminated, the actuator means for the main charging stage 70 of the image reproducing arrangement 44 is de-energized, and the clutch for the timing rollers 108 is de-energized.

Figure 17E:
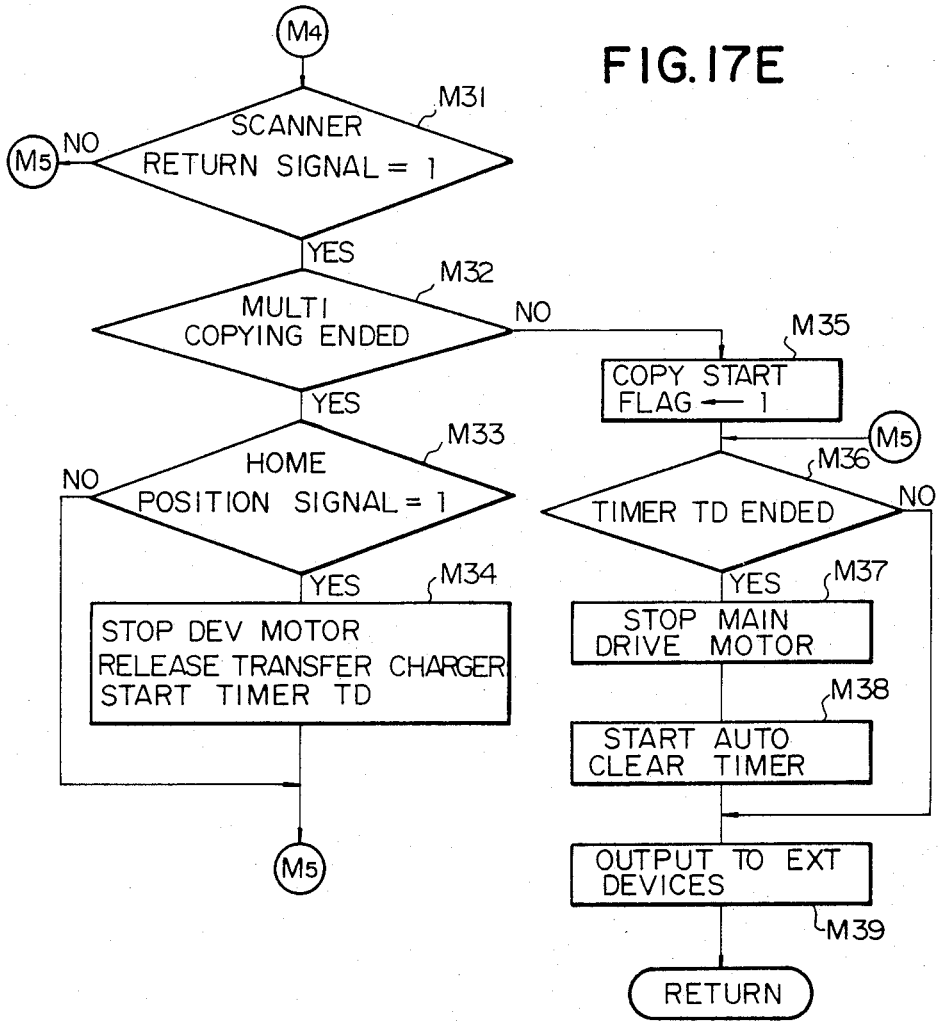

Subsequently to the process step M30 or when it is determined at the preceding decision step M29 that the timings dictated by the third system timer "TC" are not still reached, the subroutine program proceeds through a connector $M_4$ to a decision step M31 shown in FIG. 17E. The decision step M31 is responsive to a scanner return instruction signal supplied from the second microprocessor 302 and indicating with a logic "1" bit that the scanner is now on the way back toward its home position. In the step M31 is thus queried whether or not the scanner return signal is of a logic "1" bit. If the scanner is returning toward its home position so that the signal is of, for example, the logic "1" bit, it is further tested at a decision step M32 whether or not copying operation has been repeated a designated number of times. If it is found at this decision step M32 that this is the case, then it is questioned at a subsequent decision step M33 whether or not the scanner has reached its initial home position. This test is also made on the basis of a signal of, for example, a logic "1" bit supplied from the second microprocessor 302. If it is found that the signal is of the logic "1" bit and the answer for the decision step M33 is given in the affirmative, an instruction signal is issued from the system at a step M34 so that the actuator for the developing unit **72*a* or 72*b* which has been selected for use and the actuator means for the image transfer charging stage 74 are de-energized. At the step M34 is further started a fourth system timer (herein referred to as timer "TD") which dictates the timing at which the main drive motor 68 is to be brought to a stop. If it is determined in the preceding decision step M32 that the copying operation to be repeated a designated number of time is still in progress, an instruction signal is issued from the system at a step M35 to raise the copying start flag of logic "1" bit for a second time. Upon lapse of the time set for the fourth system timer "TD", either the step M34 or the step M35 is followed through a decision step M36 by a step M37 at which an instruction signal is issued from the system to de-energize the main drive motor 68. The step M37 is further followed by a step M38** at which the automatic clear timer incorporated in the system is enabled to start counting operation. If necessary, an instruction signal may be further issued from the system at a step M39 to supply signals to external devices, if any. The step M39 is followed also when it is found at the preceding decision step M36 that the counting operation by the automatic clear timer of the system is still in progress. Upon completion of the step M39, the subroutine program recycles to the initial step M01 shown in FIG. 17A.

Figure 17F:
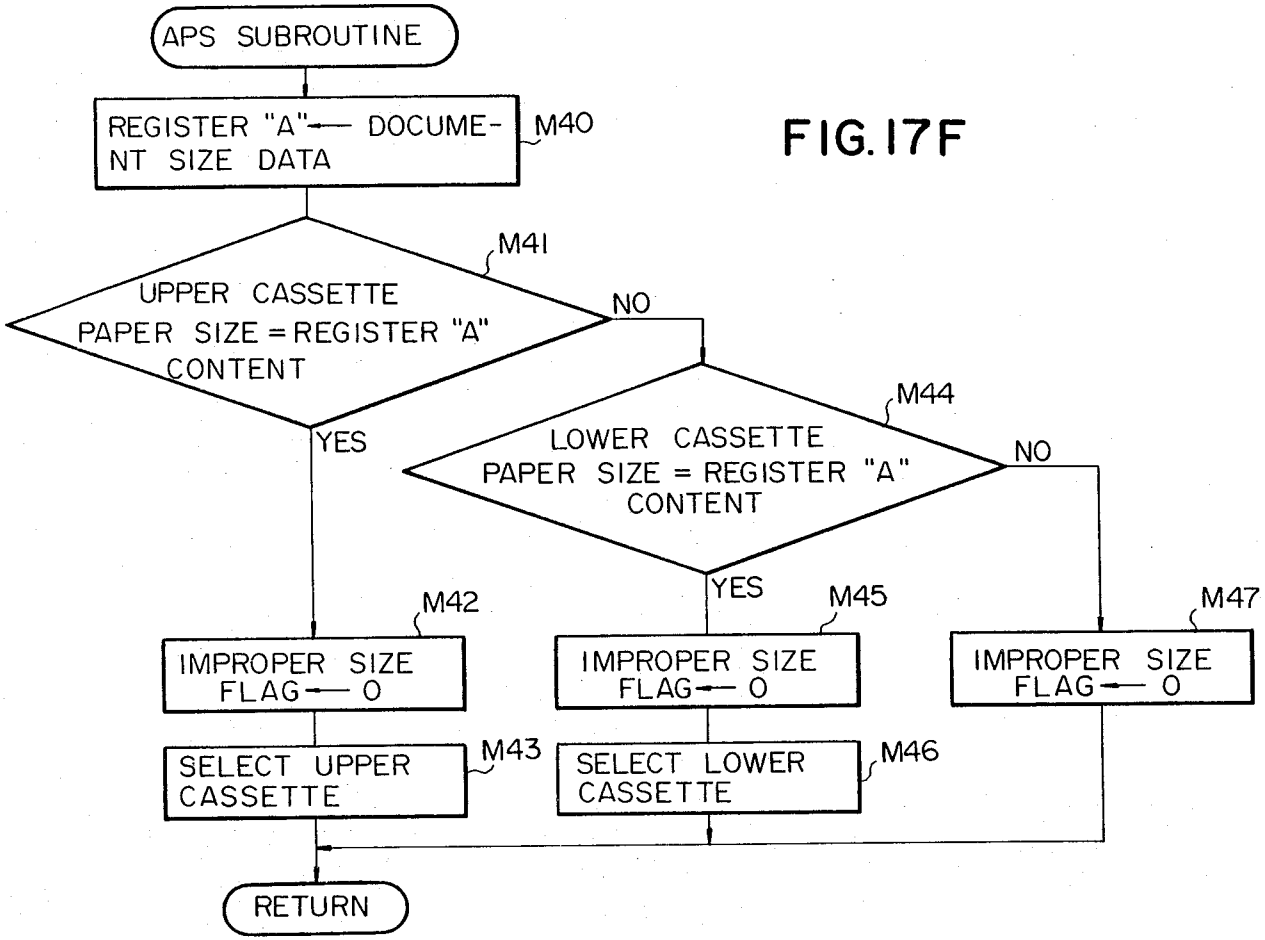

FIG. 17F shows the details of the automatic paper-size select subroutine program M09 included in t:he flowchart of FIG. 17A. The automatic paper-size select subroutine program M09 starts with a process step M40 at which an instruction signal is issued from the system to detect the size of the document sheet currently placed on the document table 40 and to store the data representative of the detected paper size into a first register (herein referred to as register "RA") incorporated in the system. It is then tested at a subsequent decision step M41 whether or not the size of the copy sheets stored in the first paper supply cassette 94 conforms to the size of the document thus memorized in the first register "RA" of the system. If it is determined at this decision step M41 that the two sizes are equal to each other, instruction signals are issued from the system at steps M42 and M43 to lower the improper paper-size flag to logic "0" bit and thereafter the first paper supply cassette 94 is selected for use. If it is determined at the preceding decision step M41 that the size of the copy sheets stored in the first paper supply cassette 94 is not in conformity to the size of the document memorized in the first register "RA" of the system, it is tested at a subsequent decision step M44 whether or not the size of the copy sheets stored in the second paper supply cassette 96 conforms to the size of the document memorized in the first register "RA" of the system. If it is determined at this decision step M44 that the two sizes are equal to each other, then instruction signals are issued from the system at steps M45 and M46 to lower the improper paper-size flag to logic "0" bit and thereafter the second paper supply cassette 96 is selected for use. If it is determined at the preceding decision step M44 that the size of the copy sheets stored in the second paper supply cassette 96 is not in conformity to the size of the document memorized in the first register "RA" of the system, an instruction signal is issued from the system at a step M47 to raise the improper paper-size flag to logic "1" bit. Upon completion of the step M43, step M46 or step M47, the subroutine program recycles to the initial step M40.

Figure 17G:
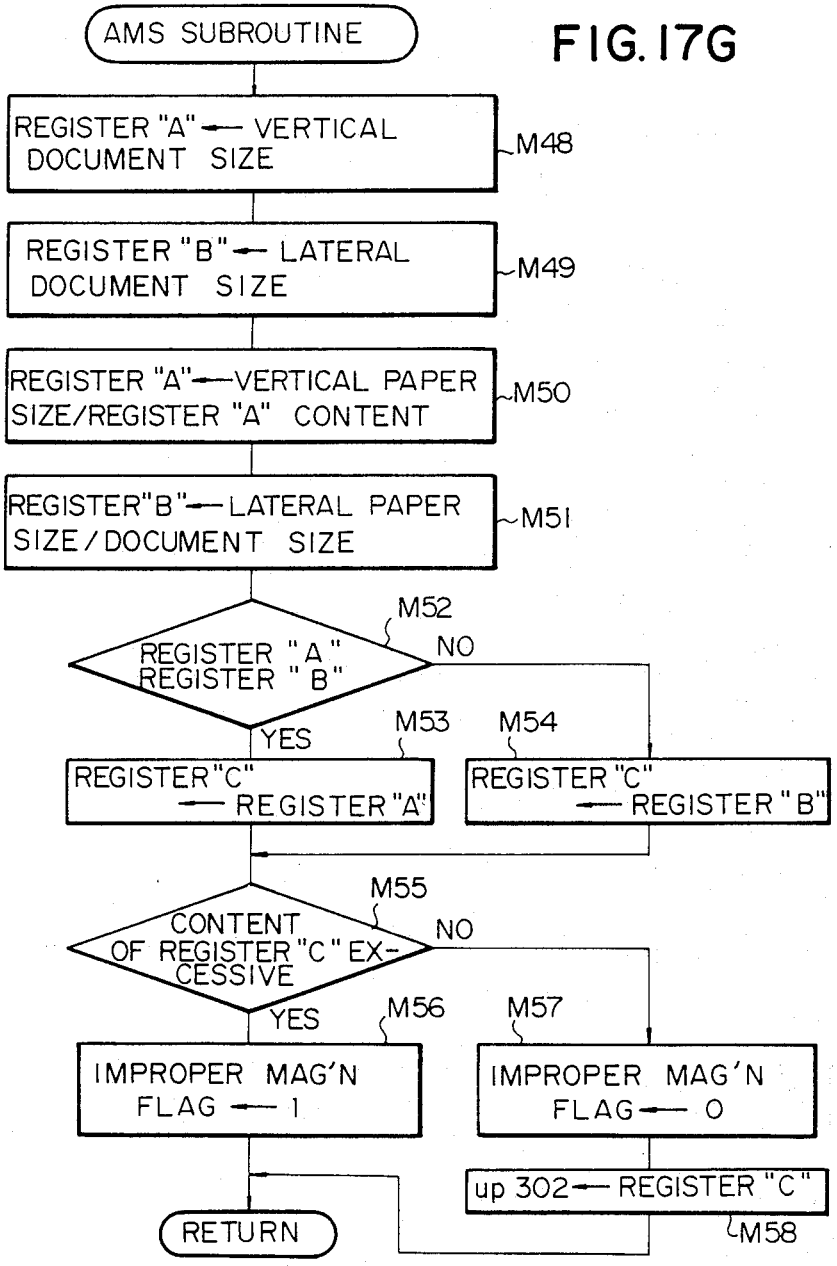

FIG. 17G shows the details of the automatic magnification select subroutine program M13 included in the flowchart of FIG. 17A. Through the subroutine program M13, the ratio of magnification or reduction calculated on the basis of the detected size of the document sheet is informed to the second microprocessor 302 if the ratio calculated is found to be acceptable for the capacity of the apparatus. For this purpose, data indicative of the vertical measurement of the document sheet currently placed on the document table 40 is supplied from the third microprocessor 304 and is stored at a first step M48 into the first system register "RA" and data indicative of the lateral measurement of the document sheet as also supplied from the third microprocessor 304 is stored at a second step M49 into a second register (herein referred to as register "RB") of the system. Furthermore, the vertical measurement of the copy sheets to be used is divided by the size represented by the data stored in the first system register "RA" and the resultant value, viz., quotient is stored into the system register "RA" at a step M50. Likewise, the lateral measurement of the copy sheets to be used is divided by the size represented by the data stored in the second system register "RB" and the quotient thus calculated is stored into the system register "RA" at a step M51.

The process steps M48 to M51 are followed by a decision step 52 at which is determined whether or not the quotient stored in the first system register "RA" is smaller than the quatient stored in the second system register "RB". If the answer for this decision step M52 is given in the affirmative, the data representative of the smaller measurement, viz., the size indicated by the data stored in the first system register "RA" is elected and is stored into a third register (herein referred to register "RC") of the system at a step M53. If it is determined at the decision step M52 that the quotient stored in the first system register "RA" is larger than the quotient stored in the second system register "RB", then the data representative of the smaller measurement, viz., the size indicated by the data stored in the second system register "RB" is elected and is stored into the third register "RC" of the system at a step M54. Either the step M53 or the step M54 is followed by a decision step M55 in which it is queried whether or not the value stored into the third system register "RC" at the step M53 or step M54 is allowable for the capacity of the apparatus. If it is found at this decision step M55 that this is the case, an improper magnification/reduction of logic "1" bit is set at a step M56. If, on the other hand, the answer for the decision step M55 is given in the negative, an improper magnification/reduction of logic "0" bit meaning that the value memorized by the third system register "RC" is acceptable is set at a step M57. In this instance, the value read from the third system register "RC" is passed over to the second microprocessor 302 at a step M58. Subsequently to the step M56 or step 58, the subroutine program reverts to the series of process steps M48 to M51.

Figure 18A:
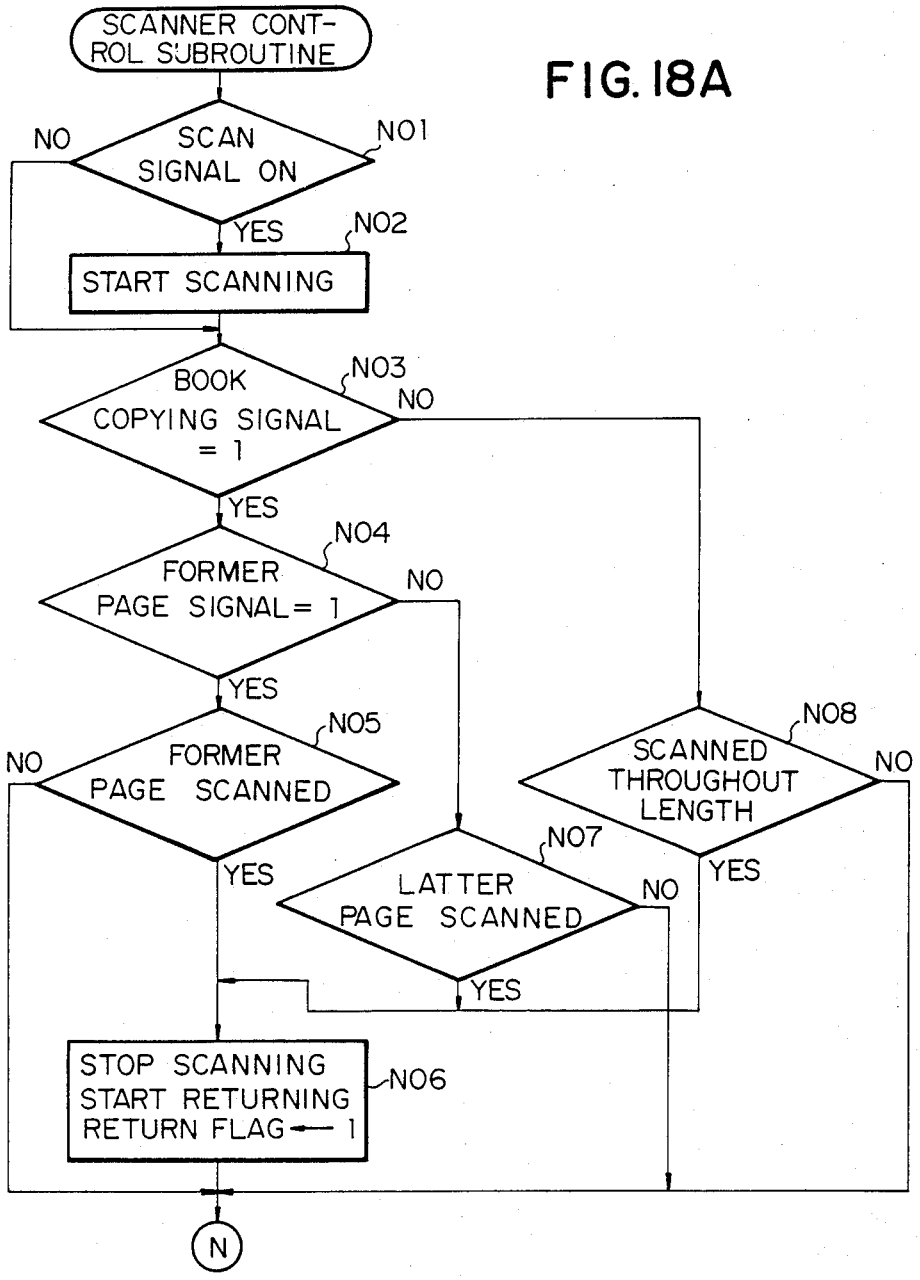
FIGS. 18A and 18B are flowcharts showing the details of the main routine program illustrated in FIG. 6.
Figure 18B:
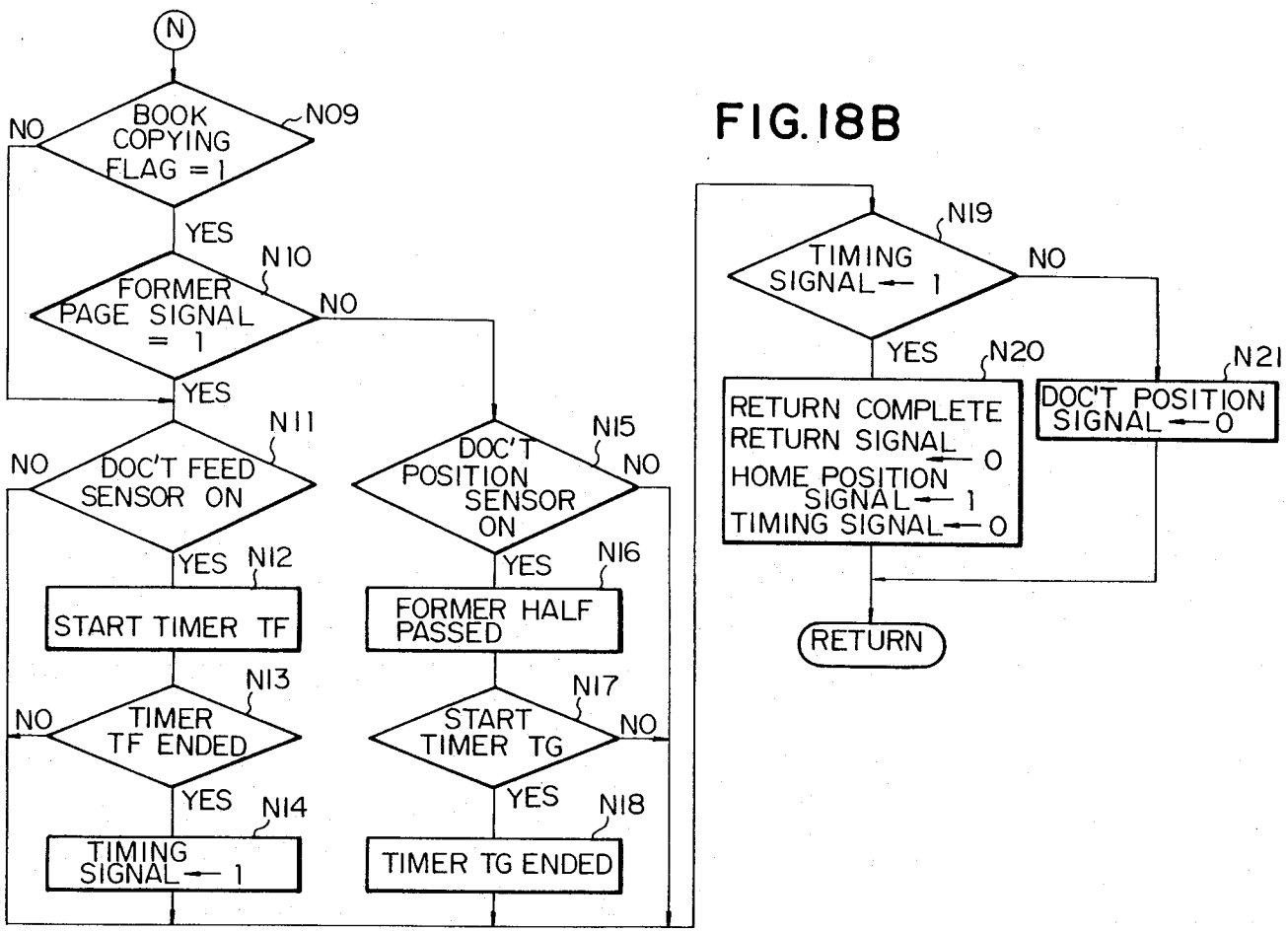

SECOND MICROPROCESSOR 302 (FIGS. 18A and 18B)

FIGS. 18A and 18B are flowcharts showing the scan control routine program to be executed by the second microprocessor 302 included in the control circuit described with reference to FIG. 3. Referring first to FIG. 18A, the scan control subroutine program starts with a decision step N01 at which it is questioned whether or not there is present an active scan start signal as produced on the basis of the sensors 176, 178 and 178 (FIG. 1). If the answer for this decision step N01 is given in the affirmative, an instruction signal is issued from the second microprocessor 302 to start scanning operation by the scanner including the exposure lamp 50 and mirrors 54, 56 and 58 of the optical scanning system 42 shown in FIG. 1. Subsequently to this step N02 or if the answer for the preceding decision step N01 is given in the negative, it is queries at a decision step N03 whether or not a book copying mode flag of, for example, a logic "1" bit is raised with the book copying mode of operation has been selected. If it is found at the decision step N03 that such a flag is set, it is questioned at a subsequent decision step N04 whether or not a former-page scan signal of, for example, a logic "1" bit is set demanding the scanning of the former half, or page, of the book area occupied by the spread opposite pages of the book placed on the document table 40. This former-page scan signal is produced on the basis of the signal output from the second scan timing sensor 180 (FIG. 1). If it is determined at the decision step N04 that there is present such a flag, it is further tested at a decision step N05 whether or not the former page of the book area has been completely scanned. If it is found at this decision step N05 that the scanning of the former page of the book area is complete, an instruction signal is issued from the microprocessor 302 at step N06 so that the scanner terminates the scanning operation and starts to return toward its initial home position and, at the same time, a scanner return flag of logic "1" bit is set.

If it is determined at the decision step N03 that there is no former-page scan signal of logic "1" bit, it is queried at another decision step N07 whether or not the latter page of the book area has been completely scanned. If, furthermore, it is found at the preceding decision step N03 that there is set no book copying mode flag of logic "1" bit, it is questioned at a decision step N08 whether or not the document sheet placed on the document table 40 has been completely scanned throughout its length. If it is found at the decision step N07 that the scanning of the latter page of the book area is complete or at the decision step N08 that the document sheet has been scanned throughout its length, the step N06 is also followed.

If, however, it is found at the decision step N05 or N07 that neither the former page nor the latter page of the book area has been completely scanned or at the decision step N08 that the scanning of the document sheet in the direction of length of the sheet is incomplete, the subroutine program proceeds through a connector N to a decision step N09 shown in FIG. 18B. At this decision step N09 is for a second time questioned whether or not the book copying flag of logic "1" is set. If the answer for this decision step N09 is given in the affirmative or if the answer for the preceding decision step N09 is given in the negative, it is further queried at a decision step N10 whether or not the former-page scan signal of logic "1" bit is present. If it is found at the decision step N09 that the book copying flag of logic "1" is set or at the subsequent decision step N10 that the former-page scan signal of logic "1" bit is present, it is now questioned at a decision step N11 whether or not there is present an active output signal from the first scan timing sensor 178 (FIG. 1). If such a signal is found to be present at the step N11, then a first system timer (herein referred to as timer "TF") of the microprocessor 302 is enabled to start counting operation at a step N12. Thereupon, it is questioned at a decision step N13 whether or not the counting operation by the system timer "TF" is terminated. If the answer for this decision step N13 is given in the affirmative, a timing signal of logic "1" bit is produced at a subsequent step N14. Subsequently to this step N14 or if it is found at the decision step N11 that there is present an active output signal from the first scan timing sensor 178 or at the decision step N13 that the counting operation by the first system timer "TF" is still in progress, the subroutine program proceeds to a decision step N15.

If it is found at the decision step N010 that there is present no former-page scan signal of logic "1" bit, then it is questioned at a decision step N16 whether or not the former page of the book area has been completely scanned. If the answer for this decision step N15 is given in the affirmative, a second system timer (herein referred to as timer "TG") of the microprocessor 302 is now enabled to start counting operation at a step N17. For this second system timer "TG" is set a time depending upon the ratio of magnification or reduction which is currently in effect. Thereupon, it is questioned at a decision step N18 whether or not the counting operation by the second system timer "TG" is terminated. If the answer for this decision step N18 is given in the affirmative, a timing signal of logic "1" bit is produced at a subsequent step N19. Subsequently to this step N19 or if it is found at the decision step N16 that the scanning of the former page of the book area is still incomplete or at the decision step N13 that the counting operation by the second system timer "TG" is still in progress, the subroutine program also proceeds to the decision step N15.

At this decision step N15 is questioned whether or not an active signal is currently output from the home position sensor 176 (FIG. 1). The home position sensor 176 detects arrival of the scanner at its home position so that, if the answer for the decision step N15 is given in the affirmative, an instruction signal is issued from the microprocessor 302 to indicate that the return of the scanner is now complete. Signals are thus produced at a subsequent step N20, including a scanner return signal of a logic "0" bit, a home position sign of a logic "1" bit and a timing signal of a logic "0" bit. If it is found at the decision step N15 that there is no active signal currently output from the home position sensor 176, a home position signal of, conversely, a logic "0" bit is produced at a step N21. The subroutine program now recycles to the initial decision step N01.

THIRD MICROPROCESSOR 304

In FIGS. 19A and 19B to FIG. 24 are shown the details of the main routine program to be executed by the third microprocessor 304 as generally described with reference to FIG. 7. The subroutine programs herein shown are subsequent to the steps C01 and C02 described with reference to FIG. 7 and consist of the document feed/recirculate/discharge subroutine program C03 and the document size detect subroutine program C04.

Document Feed/Recirculate/Discharge Subroutine C03 (FIGS. 19A and 19B and FIGS. 20 to 23)

Figure 19A:
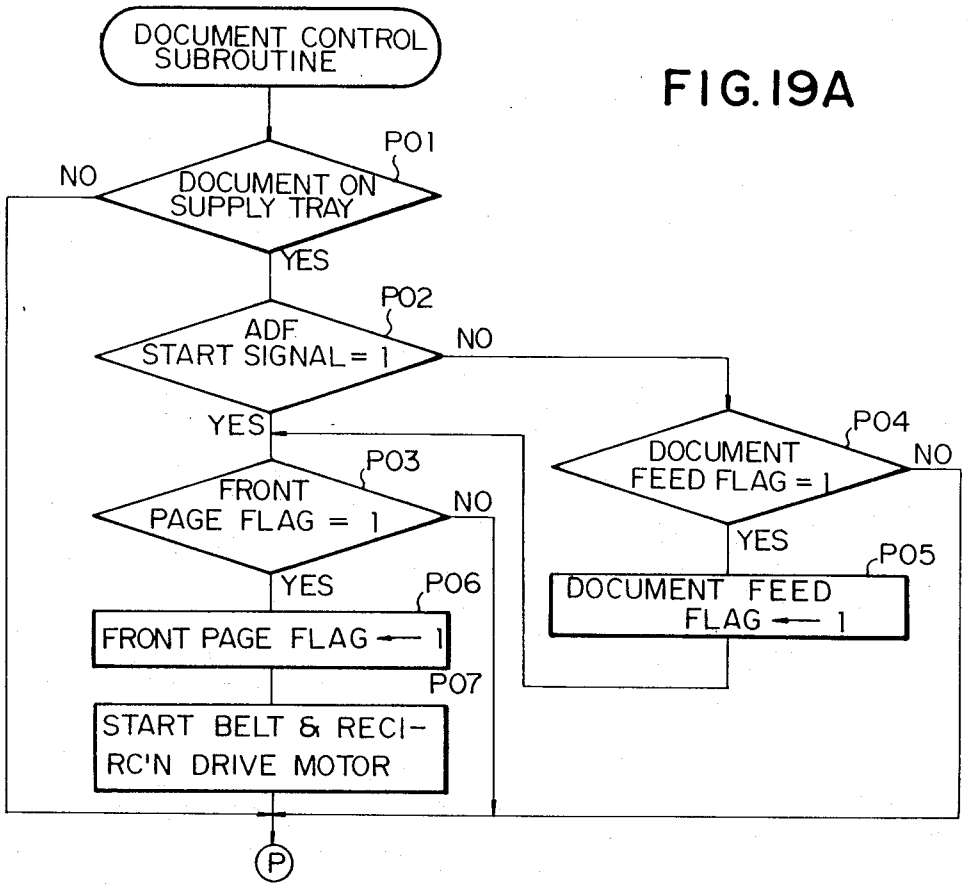
FIGS. 19A and 19B are flowcharts of a document control subroutine program included in the main routine program illustrated in FIG. 7.
Figure 19B:
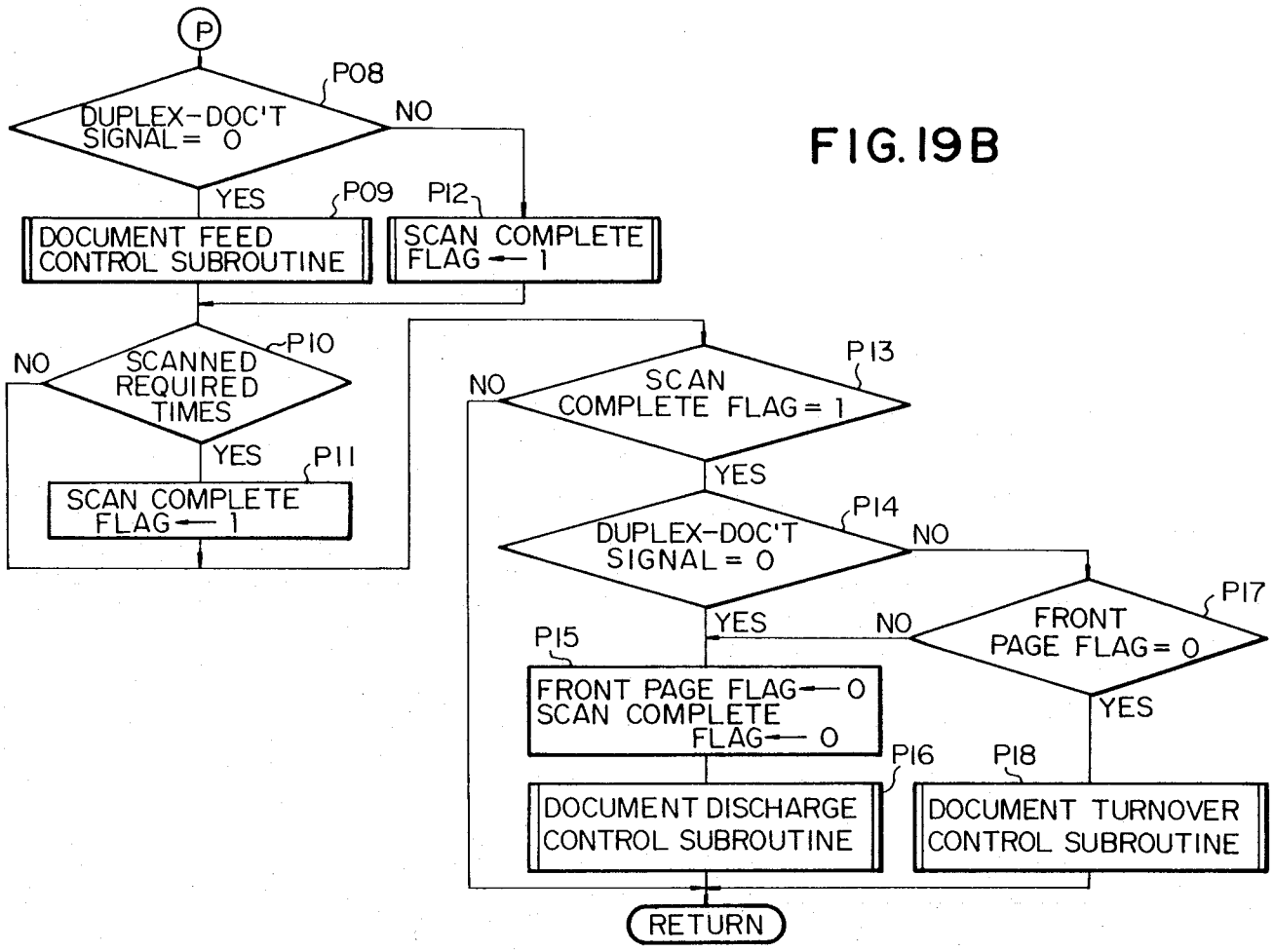

Referring first to FIG. 19A, the document feed/recirculate/discharge subroutine program C03 starts with a decision step P01 at which is questioned whether or not there is a document sheet placed on the document table 40 of duplicator module 30 shown in FIG. 1. If it is found at this decision step P01 that there is a document sheet on the document table 40, the step P01 proceeds to another decision step P02 which is responsive to an automatic document feed start signal supplied from the first microprocessor 300. At the decision step P02 is thus queried whether or not there is present an automatic document feed start signal of, for example, a logic "1" bit. If it is found at the step P02 that such a signal is present, it is further determined at a decision step P03 whether or not a front side copying flag of, for example, a logic "0" bit is set. If it is found at the preceding decision step P02 that there is present the automatic document feed start signal of logic "1" bit, then the step P02 proceeds to a decision step P04 to query whether or not a document feed flag of, for example, a logic "1" bit is raised. If the answer for this decision step P04 is given in the affirmative, then the document feed flag is shifted to a logic "0" bit at a step P05 and the subroutine program also proceeds to the decision step P03. If it is found at this decision step P03 that there is present the front side copying flag of logic "0" bit, an instruction signal is issued from the microprocessor 304 at a step P07 so that the roller drive motor 142 in the document supply unit 128 and the belt drive motor 154 in the document transport unit 130 of the automatic document feed module 32 are energized. In this instance, the belt drive motor 154 in the document transport unit 130 is energized so that the endless transport belt 150 is to be driven to have its lower travelling path portion moved forwardly in the direction of arrow d shown in FIG. 1.

Subsequently to the step P07 or if it is found at the decision step P01 that there is no document sheet placed on the document table 40, at the decision step P03 that there is no front side copying flag of logic "1" bit, or at the decision step P04 that there is no document feed flag of logic "1" bit, the subroutine program proceeds through a connector P to a decision step P08 shown in FIG. 19A.

At the decision step P08 is tested whether or not a duplex document flag of, for example, a logic "0" is set to indicate that the duplex document copying mode of operation is currently selected in the apparatus. The duplex document flag of logic "0" is supplied from the first microprocessor 300 and may be set through detection of the mode indicator 242*a* on the control panel 200 (FIG. 2). If it is found at the decision step P08 that there is such a flag present, the decision step P08 is followed by a document feed control subroutine program P09 shown in FIG. 20 and, if it is found at the step P08 that there is no duplex document flag present, then the step P08 is followed by a document feed/recirculate control subroutine program P10 shown in FIG. 21. Upon completion of the document feed control subroutine program P09 or the document feed/recirculate control subroutine program P10, the subroutine program proceeds to a decision step P11 to question whether or not the scanning operation has been repeated a number of times entered into the system. If the answer for this decision step P11 is given in the affirmative, then a scan complete flag of, for example, a logic "1" bit is raised at a step P12. Subsequently to this step P12 or if it is found at the preceding decision step P11 that the scanning operation has been repeated the preset number of times, then it is questioned at a decision step P13 whether or not the scan complete flag of logic "1" bit is present. If the answer for this decision step P13 is given in the affirmative, it is further questioned at a decision step P14 whether or not the duplex document flag of logic "0" bit is present. If it is found at this decision step P14 that such a flag is present, then each of the front side flag copying flag and the scan complete flag is shifted to a logic "0" bit at a step P15, whereupon the subroutine program proceeds to a document discharge subroutine program P16 shown in FIG. 22. If it is determined at the decision step P14 that there is present no front side copying flag of logic "0" bit, it is further questioned at a decision step P17 whether or not there is present the front side copying flag of logic "1" bit. If the answer for this decision step P17 is given in the negative, the decision step P17 proceeds to the step P15 and further to the document discharge subroutine program P16 and, if in the affirmative, then the step P17 proceeds to a document turnover control subroutine program P18 shown in FIG. 23. If it is found at the preceding decision step P13 that the scan complete flag of logic "1" is not present or subsequently to the subroutine program P16 or P18, the subroutine program C03 reverts to the initial decision step P01 shown in FIG. 19A.

Figure 20:
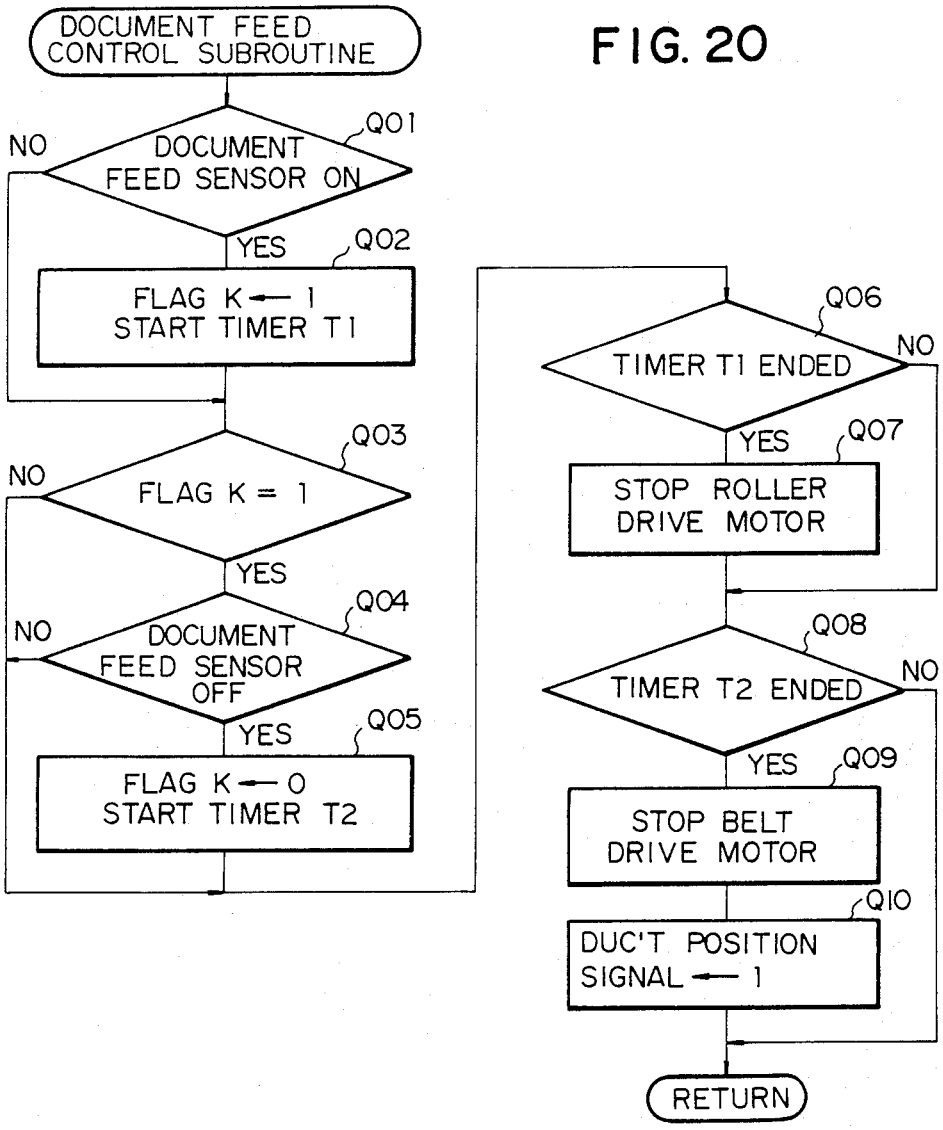
FIG. 20 is a flowchart of a document supply/feed control subroutine program included in the main routine program illustrated in FIG. 7.

Document Feed Control Subroutine P09 (FIG. 20)

Referring to FIG. 20, the document feed control subroutine P09 is executed to transport a document sheet detected by the document feed sensor 192 to a correct exposure position on the document table 40 of duplicator module 30 by means of the transport belt 150 of the document transport unit 130. Such a subroutine program P10 starts with a decision step Q01 at which is queried whether or not there is an active signal produced by the document feed sensor 192. If it is found at the decision step Q01 that such a signal is present, a flag "K" of, for example, a logic "1" bit for memorizing the condition of the document feed sensor 192 is set at a step and at the same time a first system system (herein referred to as timer "T1") of the third microprocessor 304 is enabled to start counting operation at a step Q02. For this first system system "T1" is set a period of time for which the roller drive motor 142 in the document supply unit 128 is to be actuated to operate continuously. The roller drive motor 142 being thus actuated, the document sheet which has been placed into the document supply unit 128 is driven to travel forwardly into the document transport unit 130 until the sheet is brought into contact with the travelling transport belt 150.

Figure 21:
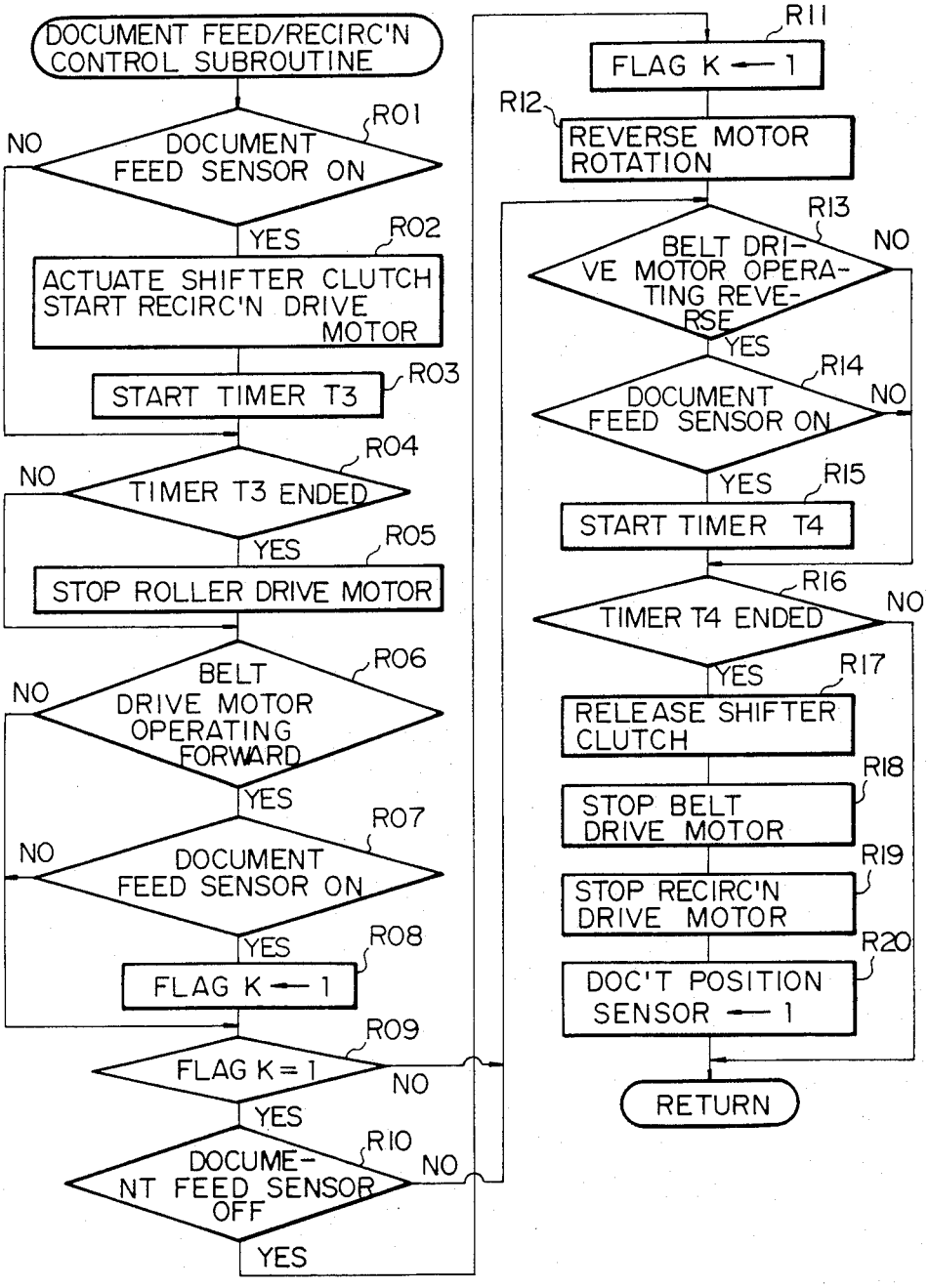
FIG. 21 is a flowchart of a document feed/recirculate control subroutine program included in the main routine program illustrated in FIG. 7.

Subsequently to the step Q02 or if it is found at the preceding decision step Q01 that there is no active signal output from the document feed sensor 192, it is questioned at a decision step Q03 whether or not the flag "K" of logic "1" bit is present. If the answer for this is given in the affirmative, it is further queried at a decision step Q04 whether or not there is an inactive signal output from the document feed sensor 192. If it is found at this decision step Q04 that such a signal is present, the flag "K" is shifted to a logic "0" bit and at the same time a second system timer (herein referred to as timer "T2") of the microprocessor 304 is enabled to start counting operation at a step Q05. For this second system timer "T2" is set a time when the document sheet travelling forwardly on the document table 40 reaches a position having its trailing end at the rearmost end of the correct exposure position on the document table 40. Subsequently to the step Q05 or it is found at the preceding decision step Q03 that there is no flag "K" present or at the decision step Q04 that there is no inactive signal output from the document sensor 192, the subroutine program proceeds to a decision step Q06 to query whether or not the time preset for the first system timer "T1" has lapsed. If the answer for this decision step Q06 is given in the affirmative, then the roller drive motor 142 in the document supply unit 128 is de-energized to come to a stop at a step Q07. Subsequently to this step Q07 or if it is found at the preceding decision step Q06 that the counting operation by the first system timer "T1" is still in progress, it is questioned at a decision step Q08 whether or not the time preset for the second system timer "T2" has lapsed. If the answer for this decision step Q08 is given in the affirmative, then the belt drive motor 146 in the document transport unit 130 is de-energized and brought to a stop at a step Q09 and thereafter the exposure position signal is shifted to a logic "0" bit at a step Q10. Subsequently to the step Q10 or if it is found at the preceding step Q08 that the second system timer "T2" is still in operation, the subroutine program recycles to the initial decision step Q01. Document Feed/Recirculate Control Subroutine P10 (FIG. 21)

The document feed/recirculate control subroutine P10 is executed to control the movement of the document sheet which is driven to travel through the document transport unit 130 into the document recirculation unit 132 and back from the recirculation unit 132 to the initial exposure position on the document table 40. Referring to FIG. 21, such a subroutine program P10 starts with a decision step R01 at which is tested whether or not there is present an active signal currently output from the document feed sensor 192. If it is found at this decision step R01 that such a signal is present, the clutch for the document withdraw/recirculate shifter 158 provided in the document transport unit 130 is actuated and at the same time the document recirculation drive motor 174 is energized to start. The shifter 158 is conditioned to establish an unobstructed path from the document transport unit 130 to the recirculation unit 132.

Thereupon, a third system timer (herein referred to as timer "T3") of the microprocessor 304 is enabled to start counting operation at a step R03. For this third system timer "T3" is set a period of time for which the document recirculation drive motor 174 is to be continuously in operation. Subsequently to the step R03 or if it is found at the initial decision step R01 that there is no active signal currently output from the document feed sensor 192, it is questioned at a decision step R04 whether or not the time set for the third system timer "T3" has lapsed. If the answer for this decision step R04 is given in the affirmative, then the document recirculation drive motor 174 is de-energized and brought to a stop at a step R05. Subsequently to this step R05 or if it is found at the preceding decision step R04 that the third system timer "T3" is still in operation, it is questioned at a decision step R06 whether or not the belt drive motor 154 in the document transport unit 130 is in operation for forward rotation so that the transport belt 150 has its lower travelling path portion moving forwardly in the direction of arrow d in FIG. 1. If it is found at this decision step R06 that this is the case, it is queried at a subsequent decision step R07 whether or not there is present an active signal currently output from the document feed sensor 192. If it is found at this decision step R07 that there is present such a signal, then the flag "K" of logic "1" bit for memorizing the condition of the sensor 192 is set at a step R08.

Subsequently to the step R8 or if it is found at the preceding decision step R06 that the belt drive motor 154 is in operation for rotation in the reverse direction or at the decision step R07 that there is present no active signal currently output from the document feed sensor 192, it is questioned at a decision step R09 whether or not the flag "K" of logic "1" bit is present. If it is found at this decision step R09 that this is the case, it is further queried at a decision step R10 whether or not there is present an inactive signal currently output from the document feed sensor 192. If the answer for this decision step R10 is given in the affirmative, the flag "K" is shifted a logic "0" bit at a step R11 and thereafter the belt drive motor 154 is actuated to operate for rotation in the reverse direction at a step R12. Subsequently to this step R12 or if it is found at the preceding decision step R09 that there is no flag "K" of logic "1" bit present or at the decision step R10 that there is no inactive signal currently output from the document feed sensor 192, it is confirmed at a decision step R13 whether or not the belt drive motor 154 is in operation for rotation in the reverse direction. If the answer for this decision step R13 is given in the affirmative, it is further queried at a decision step R14 whether or not there is present an active signal currently output from the document feed sensor 192. If it is found at this decision step R14 that there is present such a signal, a fourth system timer (herein referred to as timer "T4") of the microprocessor 304 is enabled to start counting operation at a step R15. For this fourth system timer "T4" is set a time at which the document sheet now being driven to travel backwardly on the document table 40 is to reach the initial exposure position with its leading end located at the initial rearmost end of the exposure position on the document table 40.

Further to the step R15 or if it is found at the preceding decision step R13 that the belt drive motor 154 is not in operation for rotation in the reverse direction or at the decision step R14 that there is no active signal currently output from the document feed sensor 194, it is questioned at a decision step R16 whether or not the time preset for the fourth system timer "T4" has lapsed. If it is found at this step R16 that this is the case, then instruction signals are issued from he microprocessor 304 to de-activate the clutch for the document withdraw/recirculate shifter 158 at a step R17, de-energize each of the belt and recirculation drive motors 154 and 174 at steps R18 and R19. Furthermore, the exposure position signal is shifted to a logic "1" bit at a step R20. The exposure position signal of logic "1" bit is transferred to the first microprocessor 300. Subsequently to the last step R20 or if it is found at the preceding decision step R16 that the fourth system timer "T4" is still in operation, the subroutine program recycles to the initial decision step R01.

Figure 22:
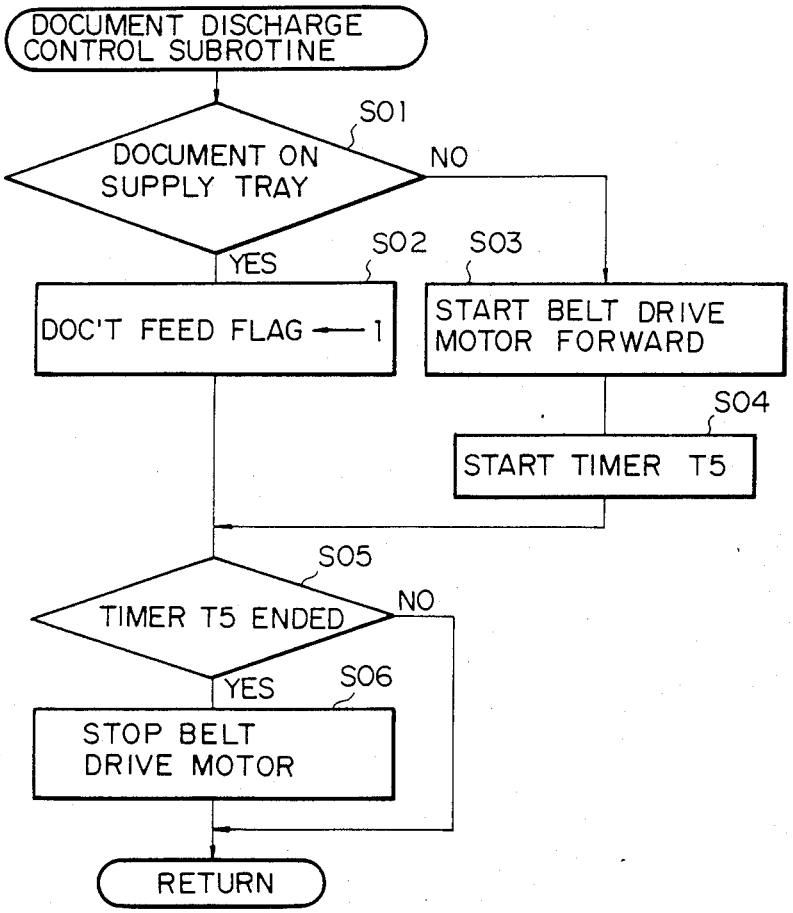
FIG. 22 is a flowchart of a document discharge control subroutine program included in the main routine program illustrated in FIG. 7.

Document Discharge Subroutine P16 (FIG. 22)

The document discharge control subroutine P16 is executed to determine whether or not there is a document sheet inserted into the document supply unit 128 and, if a document sheet is found inserted thereinto, memorizes the particular event and, if there is no document sheet found therein, then causes the document sheet on the document table 40 to withdraw therefrom. Referring to FIG. 22, such a document discharge control subroutine P16 starts with a decision step S01 to confirm whether or not there is a document sheet remaining in the document supply unit 128. This confirmation is made on the basis of the signal from the document sensor 188 located within the document supply unit 128. If it is found at this step S01 that there is a document sheet in the document supply unit 128, a document feed flag of a logic "1" bit is raised at a step S02. If the answer for the decision step S02 is given in the negative, then the belt drive motor 154 in the document transport unit 130 is actuated for rotation in the forward rotation as at a step S03 so that the document sheet on the document table 40 is driven by the transport belt 150 for forward movement on the document table 40. A fifth system timer (herein referred to as timer "T5") of the microprocessor 304 is then enabled to start counting operation at a step S05. For this fifth system timer "T5" is set a time for which a document sheet of possibly the largest size that may be placed on the table 40 will be allowed to move on and leave the document table 40. Either the step S02 or the step S04 is followed by a decision step S05 at which is tested whether or not the fifth system timer "T5" has terminated its counting operation. If it is found at the step S05 that this is the case, the belt drive motor 154 is de-energized to come to a stop at a step S06. Subsequently to the step S6 or if it is found at the preceding decision step S05 that the fifth system timer "T5" of the microprocessor 304 is still in operation, the subroutine program reverts to the initial decision step R01.

Figure 23:
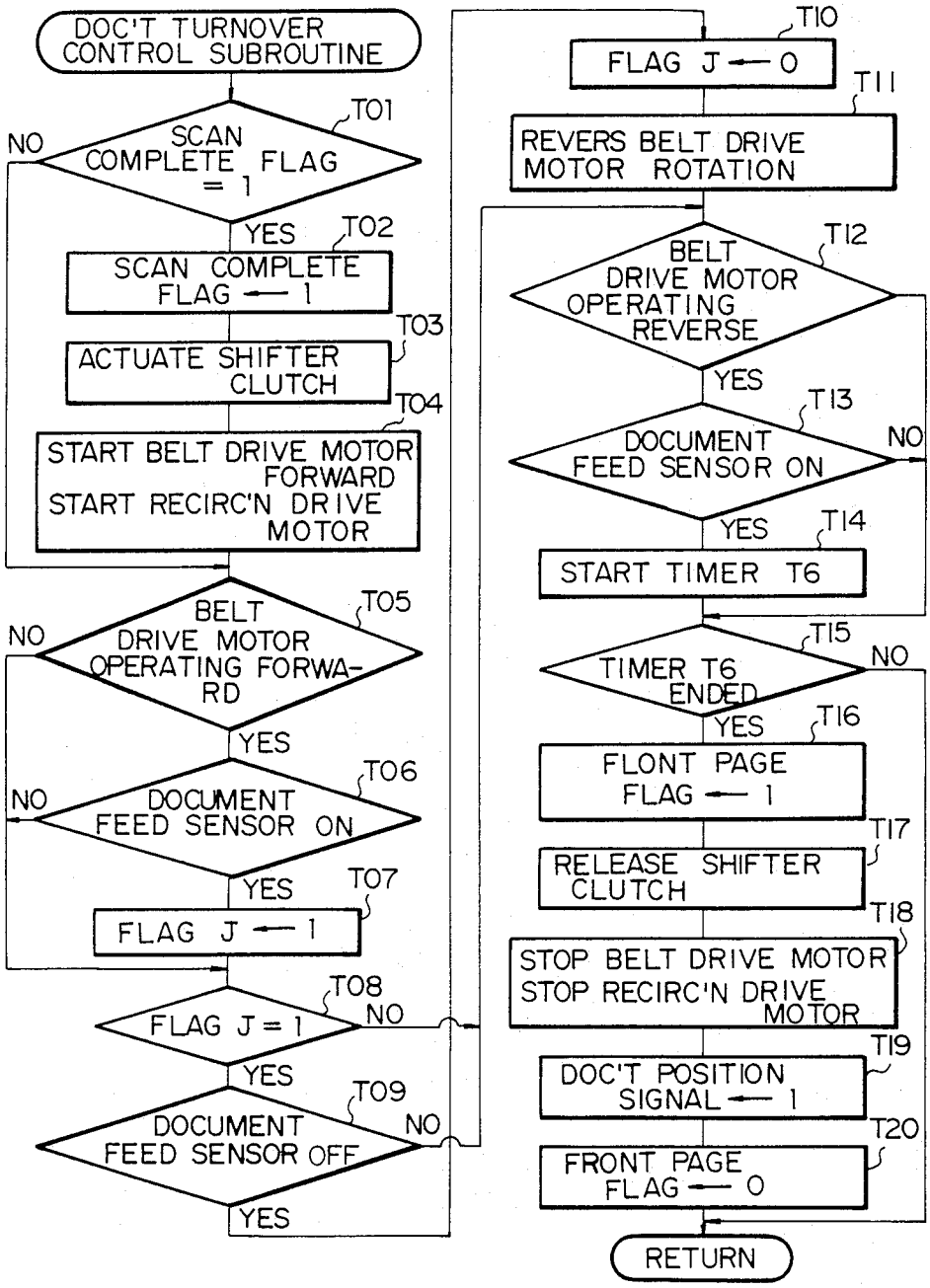
FIG. 23 is a flowchart of a document turnover control subroutine program included in the document control subroutine program illustrated in FIG. 19.

Document Turnover Control Subroutine P18 (FIG. 23)

The document turnover control subroutine P17 is executed to control the movement of the document sheet which is driven to travel forwardly from the exposure position on the document table 40, transferred to the document recirculation unit 132, reversed upside down within the recirculation unit 132, and thereafter driven to travel backwardly to the exposure position on the document table 40. Referring to FIG. 23, such a document turnover control subroutine P17 starts with a decision step T01 at which is confirmed whether or not there is present a scan complete flag of logic "1". If it is found at this decision step T01 that this is the case, then the subroutine program issues instructions to shift the shift complete flag to a logic "0" bit at a step T02 and actuate the clutch for the document withdrawal/recirculate shifter 158 at a step T04. The shifter 158 is conditioned to establish an unobstructed path from the document transport unit 130 to the recirculation unit 132. At a subsequent step T04, furthermore, the belt drive motor 154 in the document transport unit 130 is energized to start rotation in the forward direction and at the same time the recirculation drive motor 174 in the document recirculation unit 132 is energized to start.

Subsequently to the step T04 or if it is found at the preceding decision step T01 that there is present no scan complete flag of logic "1" bit, it is questioned at a decision step T05 whether or not the belt drive motor 154 in the document transport unit 130 is in operation rotation in the forward direction. If the answer for this decision step T05 is given in the affirmative, it is further queried at a decision step T06 whether or not there is an active signal currently output from the document feed sensor 192. If it is found at this decision step T06 that such a signal exists, a flag "J" of a logic "1" bit indicating that the document sheet has reached the document recirculation unit 132 is raised at a step T07. Subsequently to the step T07 or if it is found at the preceding decision step T05 that the belt drive motor 154 is not in operation for rotation in the forward direction or at the decision step T06 that there is present no active signal currently supplied from the document feed sensor 192, the subroutine program proceeds to a decision step T08.

At this step T08 is questioned whether or not there is present the flag "J" of logic "1" bit. If the answer for this decision step T09 is given in the affirmative, it is further queried at a subsequent decision step T09 whether or not there is present an inactive signal currently output from the document feed sensor 192. If it is found at this step T09 that this is the case, then the flag "J" is shifted to a logic "0" bit at a step T10 and thereafter the belt drive motor 154 is actuated to reverse its direction of rotation at a step T11. Subsequently to the step T11 or if it is found at the preceding decision step T08 that there is present no flag "J" of logic "1" bit or at the decision step T09 that there is no inactive signal currently supplied from the document feed sensor 192, it is questioned at a decision step T12 whether or not the belt drive motor 154 is in operation for rotation in the reverse direction. If the answer for this decision step T12 is given in the affirmative, it is further queried at a subsequent decision step T13 whether or not there is present an active signal currently output from the document feed sensor 192. If it is found at this step T13 that such a signal is present, a sixth system timer (herein referred to as timer "T6") of the microprocessor 304 is enabled to start counting operation at a step T12. For this sixth system timer "T6" is set a time required for the document sheet to reach its initial exposure position on the document table 40.

Subsequently to the step T14 or if it is found at the step T12 that the belt drive motor 154 is in operation for rotation in the reverse direction or at the decision step T13 that there is no active signal currently supplied from the document feed sensor 192, it is questioned at a decision step T15 whether or not the period of time preset for the sixth system timer "T6" has lapsed. If it is found at this decision step T15 that this is the case, the front-side copying flag is shifted to a logic "0" at a step T16, and the clutch for the document withdraw/recirculate shifter 158 is de-activated at a step T17. In addition, each of the belt drive motor 154 and the recirculation drive motor 174 is de-energized to come to a full stop as at a step T18, whereupon the exposure position signal is shifted to a logic "1" bit at a step T19 and is passed over the first microprocessor 300. Subsequently to the step T19 or if it is found at the preceding decision step T15 that the sixth system timer "T6" is still in operation, the subroutine program returns to the initial decision step T01.

Figure 24:
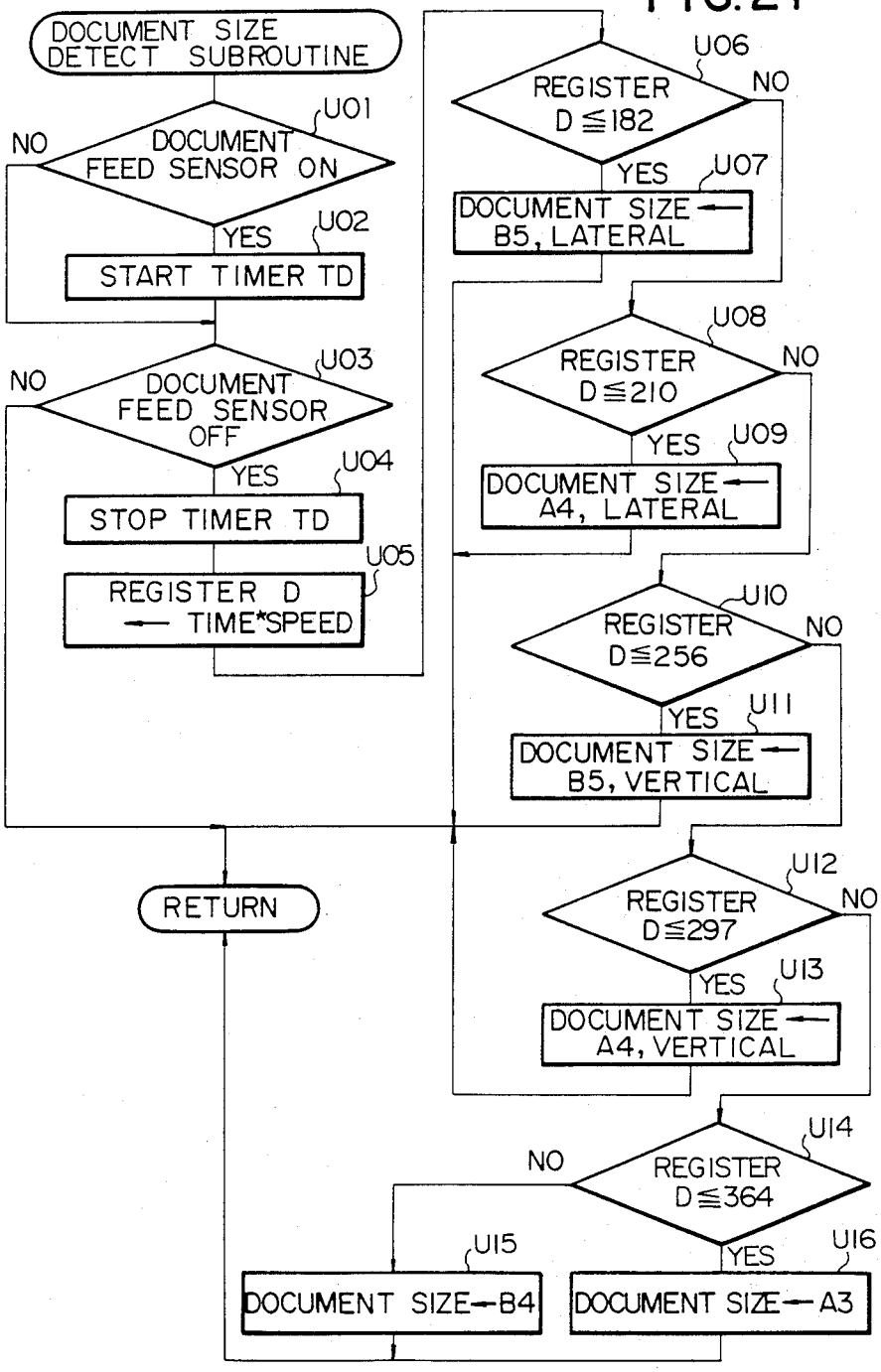
FIG. 24 is a flowchart of a document size detect subroutine program included in the main routine program illustrated in FIG. 7.

Document Size Detect Subroutine C04 (FIG. 24)

The document size detect subroutine program C04 is executed to detect the length of the document sheet to be copied and determine the detected length is either the vertical measurement or the lateral measurement of the document sheet. Such a document size detect subroutine program C04 starts with a decision step U01 at which is confirmed whether or not there is present an active signal currently output from the document feed sensor 192. If it is determined at this step U01 that there is present such a signal, a size detect timer "TD" incorporated in the microprocessor 304 is enabled to start counting operation at a step U02. Subsequently to the step U02 or if it is found at the step U01 that there is no active signal currently produced from the document feed sensor 192, it is questioned at a decision step U03 whether or not there is an inactive signal currently output from the document feed sensor 192. If the answer for this step U03 is given in the affirmative, then the size detect timer "TD" is brought to a stop at a step U04. The step U04 is followed by a step U05 at which the time interval for which the size detect timer "TD" has been in operation is multiplied by the speed at which the document sheet was driven to travel on the document table 40 to obtain the length of the document sheet or, more exactly, the measurement of the document sheet in the direction of movement on the document table 40. The length of the document thus calculated is stored in a register "D" of the microprocessor 304 also at the step U05.

The value thus stored in the register "D" of the microprocessor 304 is compared with various numerical values which are, typically, representative of the vertical and lateral measurements of standardized paper sizes. For this purpose, the calculation step U05 is followed by a decision step U06 at which it is tested whether or not the value stored in the register "D" is less than 182 mm. If it is found at the decision step U06 that this is the case, it is determined at a subsequent step U07 that the measured length of the document sheet is the lateral measurement of the standardized B5 paper size. If the answer for the decision step U06 is given in the negative, then it is further tested at a decision step U08 whether or not the value stored in the register "D" is less than 210 mm. If it is found at the decision step U08 that this is the case, it is determined at a subsequent step U09 that the measured length of the document sheet is larger than 182 mm and not less than 210 mm and is accordingly the lateral measurement of the standardized A4 paper size. If the answer for the decision step U08 is given in the negative, then it is further tested at a decision step U10 whether or not the value stored in the register "D" is less than 256 mm. If it is found at the decision step U10 that this is the case, it is determined at a subsequent step U11 that the measured length of the document sheet is larger than 210 mm and not less than 256 mm and is accordingly the vertical measurement of the standardized B5 paper size. If the answer for the step U10 is given in the negative, then it is further tested at a decision step U12 whether or not the value stored in the register "D" is less than 297 mm. If it is found at the decision step U12 that this is the case, it is determined at a subsequent step U13 that the measured length of the document sheet is larger than 256mm and not less than 297 mm and is accordingly the vertical measurement of the standardized A4 paper size. If the answer for the step U12 is given in the negative, then it is further tested at a decision step U14 whether or not the value stored in the register "D" is less than 364 mm. If it is found at the decision step U14 that this is the case, it is determined at a subsequent step U15 that the measured length of the document sheet is larger than 297 mm and not less than 364 mm and is accordingly the vertical measurement of the standardized B4 paper size. If the answer for the step U14 is given in the negative, then it is determined at a subsequent step U16 that the size of the document sheet is larger in length than 297 mm and is accordingly the standardized A3 paper size.

As will have been understood from the foregoing description, the program load/call subroutine program A05 described with reference to FIGS. 10A and 10B implements means for controlling the programming of the various optional copying conditions and modes of operation available in the apparatus embodying the present invention. These optional copying conditions and modes of operation consist of those for the quantity of copy sheets to be printed, the density of the images to be printed on the copy sheets, the size of copy sheets, the colors in which images are to be printed, the book copying mode, the duplex-document copying mode, the automatic paper-size select select mode, and the automatic magnification select select mode of operation. Such optional copying conditions and modes of operation available in the described embodiment are, however, not limitative of the present invention and, thus, any combination of these or any combination of one or some of these and one or more of any other conditions and modes of operation which have not been hereinbefore mentioned may be selected for use in an apparatus according to the present invention. If there are provided a plurality of memories for the storage of a plurality of packages each of such optional conditions and modes of operation, the user of the apparatus will have a wide range of selection among the various programs.

When any of the optional copying conditions and modes of operation programmed into the memory of the system can not be used temporarily under any of particular states of the apparatus, the desired copying operation using the complete package of the optional conditions and modes of operation is provisionally held in abeyance. The copying operation is started at a point of time the state of the apparatus which has been a bar to executing the copying operation using the complete package of the optional conditions and modes of operation is thereafter eliminated. Typical of such states inhibiting the execution of the copying operation using the complete set of optional conditions and modes of operation is the lack of the ADF-mode ready state as may be frequently brought about on the automatic document feed module which has been assumed to form part of the apparatus embodying the present invention. The apparatus is operable for the automatic paper-size and magnification select modes with the subsidiary automatic document feed module added to the main duplicator module. The automatic paper-size and magnification select modes of operation being included in the program stored in the memory, these modes of operation would be inevitably displayed on the control panel in spite of the fact that such functions are in reality temporarily freezed when and as long as the automatic document feed remains in an inoperable state or the main duplicator module is used as an integral unit independently of the automatic document feed module. This would mislead the operator into the belief that the apparatus is nevertheless operable for the automatic paper-size and magnification select modes and in the result he or she would fail to perform the copying operation properly. In the apparatus herein proposed by the present invention, such an inconvenience can be avoided advantageously by adding the data representative of these modes of operation to the data fetched from the memory. When the optional copying conditions and modes of operation stored in the memory are called from the memory, only those which can be currently used are thus displayed on the control panel when the automatic document feed module is not in a state ready to operate or the apparatus is devoid of the automatic document feed module either physically or in effect.

What is claimed is:

1. An image duplicating apparatus having a plurality of predetermined optional copying conditions and modes of operation available therein, comprising image producing means for producing a visible image corresponding to an original visible image on a sheet medium, said image producing means comprising a support member on which said sheet medium is to be placed, transport means for automatically moving said sheet medium into and out of a desired position on said support member, said image producing means and said transport means being operatively coupled together under a predetermined state therebetween, data input means for entering data indicating selected ones of said optional copying conditions and modes of operation to be established in said apparatus, said data including data for designating a specific mode of operation to be performed through cooperation between said image producing means and said automatic transport means, display means for visually displaying said selected ones of said optional copying conditions and modes of operation, memory means for storing the data displayed by said display means, data fetch means for fetching from the memory means the data representative of the optional copying conditions and modes of operation stored therein, detecting means for detecting whether or not said predetermined state is present at a given point of time, and control means establishing in said apparatus the optional copying conditions and modes of operation represented by the data fetched from said memory means, the control means comprising means for establishing said specific mode of operation in the presence of said predetermined state at said given point of time, and means for establishing said specific mode of operation if and when it is detected by said detecting means that said predetermined state is not present at said given point of time and thereafter that there is present said predetermined state.

2. An image duplicating apparatus as set forth in claim 1, in which said optional copying conditions and modes of operation available in said apparatus include a paper-size select mode of operation for selecting the size of copy sheets for temporary use, said apparatus further comprising:

a plurality of paper supply units each detachably assembled to said apparatus, said paper supply units being adapted to supply copy sheets of different sizes, respectively, said data input means being operable for entering data indicating a selected paper size for said temporary use, detecting means for detecting whether or not one of said different paper sizes available with said paper supply units is, at a given point of time, in conformity to said selected paper size, said control means further comprising means for selecting one of said paper supply units if and when it is detected by said detecting means that one of said different paper sizes available with said paper supply units is, at said given point of time, in conformity to said selected paper size, and means which is operative, if it is detected by said detecting means that none of said different paper sizes available with said paper supply units is in conformity to said selected paper size at saif given point of time and thereafter that there is assembled to the apparatus a new paper supply unit operable for supplying copy sheets of said selected paper size, for selecting said new paper supply unit.

3. An image duplicating apparatus having a plurality of predetermined optional copying conditions and modes of operation available therein, comprising image producing means for producing a visible image corresponding to an original visible image, said optional copying conditions and modes of operation including a condition in which said visible image is to be produced through optical magnification or reduction of said original image at a variable ratio, data input means for entering data indicating selected ones of said optional copying conditions and modes of operation to be established in said apparatus, said data including specific data for designating a selected ratio said optical magnification or reduction, display means for visually displaying said selected ones of said optional copying conditions and modes of operation, memory means for storing the data displayed by said display means, data fetch means for fetching from the memory means the data representative of the optional copying conditions and modes of operation stored therein, detecting means for detecting whether or not said selected ratio is operable in said apparatus at a given point of time, and control means establishing in said apparatus the optional copying conditions and modes of operation represented by the data fetched from said memory means, said control means comprising means for established said selected ratio if and when it is detected by said detecting means that said selected ratio is operable in said apparatus at said given point of time, and means establishing said selected ratio if it is detected by said detecting means that said selected ratio is inoperable in said apparatus at said given point of time and thereafter that said selected ratio is operable in said apparatus.

4. An image duplicating apparatus having a plurality of predetermined optional copying conditions and modes of operation available therein, comprising image producing means for producing a visible image corresponding to an original image, said visible image being produced from said original image through an intermediate image, said image producing means comprising a plurality of image developing units each detachably assembled in said image producing means, said image developing units being operable for converting said intermediate image into a visible image of different colors, respectively, said optional copying conditions and modes of operation including a color select mode of operation for selecting the color in which the visible image is to be produced, data input means for entering data indicating selected ones of said optional copying conditions and modes of operation to be established in said apparatus, said data including specific data indicating a selected color for the visible image to be produced, display means for visually displaying said selected ones of said optional copying conditions and modes of operation, memory means for storing the data displayed by said display means, data fetch means for fetching from the memory means the data representative of the optional copying conditions and modes of operation stored therein, detecting means for detecting whether or not one of said different colors available with said image developing units is, at a given point of time, in conformity to said selected color, and control means establishing in said apparatus the optional copying conditions and modes of operation represented by the data fetched from said memory means, said control means comprising means for selecting one of said image developing units if and when it is detected by said detecting means that one of said different colors available with said image developing units is, at said given point of time, in conformity to said selected color, and means which is operative, if it is detected by said detecting means that none of said different colors available with said image developing units is in conformity to said selected color at said given point of time and thereafter that there is assembled to the apparatus a new image developing unit operable for converting said intermediate image into a visible image of said selected color, for selecting said new image developing unit.

5. An image duplicating apparatus having a plurality of predetermined optional copying conditions and modes of operation, comprising (a) program memory means, (b) program enable means for producing an instruction to enable programming of selected ones of said optional copying conditions and modes of operation, (c) program data input means for entering data indicating selected ones of said optional copying conditions and modes of operation to be established in said apparatus, (d) program call means for producing an instruction to call the programmed optional copying conditions and modes of operation from said program memory means, (e) first program memory control means responsive to the instruction from said program enable means for storing into said program memory means the data representative of the selected ones of said optional copying conditions and modes of operation, (f) second program memory control means responsive to the instruction from said program call means for calling from said program memory means the data representative of the selected ones of said optional copying conditions and modes of operation, (g) mode control means responsive to the data entered by said program data input means and the data called from said program memory means for producing instructions to establish in said apparatus the optional copying conditions and modes of operation represented by the data called from said program memory means, (h) detecting means for detecting whether or not said apparatus is in a state operable for executing the instructions from said mode control means at a given point of time, and (i) data storage control means which is operative, if and when it is detected by said detectng means that at least one of the instructions produced by said mode control means is unexecutable at said given point of time, for storing the data representative of any of the optional copying conditions and modes of operation designated by the unexecutable instruction and, if and when it is thereafter detected by said detecting means that any of the optional copying conditions designated by said unexecutable instruction is executable, for producing an instruction to execute the unexecutable instruction which is currently executable.

6. An image duplicating apparatus as set forth in claim 5, further comprising (j) means for producing a visible image corresponding to an original visible image on a sheet medium, said image producing means comprising a support member on which said sheet medium is to be placed, (k) means for automatically moving said sheet medium into and out of a desired position on said support member, (l) said image producing means and said transport means being operatively coupled together under a predetermined state therebetween, (m) said data input means being operable for designating a mode of operation to be performed through cooperation between said image producing means and said automatic transport means, (n) detecting means for detecting whether or not said predetermined state is present at a given point of time, (o) first control means for establishing said mode of operation in the presence of said predetermined state at said given point of time, and (p) second control means for establishing said mode of operation if it is detected by said detecting means that said predetermined state is not present at said given point of time and thereafter that there is present said predetermined state.

7. An image duplicating apparatus as set forth in claim 6, in which said optional copying conditions and modes of operation available in said apparatus include a paper-size select mode of operation for selecting the size of copy sheets for temporary use, said apparatus further including (q) a plurality of paper supply units each detachably assembled to said apparatus, said paper supply units being adapted to supply copy sheets of different sizes, respectively, wherein (r) said data input means is operable for entering data indicating a selected paper size for said temporary use, said apparatus further comprising (s) detecting means for detecting whether or not one of said different paper sizes available with said paper supply units is, at a given point of time, in conformity to said selected paper size, (t) first control means for selecting one of said paper supply units if and when it is detected by said detecting means that one of said different paper sizes available with said paper supply units is, at said given point of time, in conformity to said selected paper size, and (u) second control means which is operative, if it is detected by said detecting means that none of said different paper sizes available with said paper supply units is in conformity to said selected paper size at said given point of time and thereafter that there is assembled to the apparatus a new paper supply unit operable for supplying copy sheets of said selected paper size, for selecting said new paper supply unit.

8. An image duplicating apparatus as set forth in claim 6, in which said optional copying conditions and modes of operation available in said apparatus include a condition in which said visible image is to be produced through optical magnification or reduction of said original image at a variable ratio, (q) said data input means being operable for designating a selected ratio of said optical magnification or reduction, said apparatus further comprising (r) detecting means for detecting whether or not said selected ratio is operable in said apparatus at a given point of time, (s) first control means for establishing said selected ratio if and when it is detected by said detecting means that said selected ratio is operable in said apparatus at said given point of time, and (t) second control means for establishing said selected ratio if and when it is detected by said detecting means that said selected ratio is inoperable in said apparatus at said given point of time and thereafter that said selected ratio is operable in said apparatus.

9. An image duplicating apparatus as set forth in claim 6, in which said optional copying conditions and modes of operation available in said apparatus include a book copying mode of operation for duplicating a bcok area of a bound volume of sheets, (q) said data input means being operable for entering data indicating that said book copying mode of operation is selected, said apparatus further comprising (r) detecting means for detecting whether or not said book copying mode of operation is operable in said apparatus at a given point of time, (s) first control means for establishing said book copying mode of operation in said apparatus if and when it is detected by said detecting means that the book copying mode of operation is operable in said apparatus at said given point of time, and (t) second control means which is operative, if it is detected by said detecting means that the book copying mode of operation is inoperable in said apparatus at said given point of time and thereafter that the book copying mode of operation is operable in said apparatus.

10. An image duplicating apparatus including (a) image producing means for producing a visible image corresponding to an original image, the image producing means having a plurality of modes of operation, comprising (b) mode designating switch means for designating any of said modes of operation for temporary use, (c) first control means responsive to the designation by said designating switch means for establishing in said image producing means the modes of operation designated by said designating switch means, (d) non-volatile memory means responsive to the designation by said designating switch means for storing data representative of said the modes of operation designated by said designating switch means, (e) instruction output switch means for entering an instruction to fetch from said memory means at least a portion of the data stored therein, (f) second control means responsive to the instruction from said instruction output means for fetching the data from said memory means and establishing each of the modes of operation represented by the data fetched from said memory means, (g) clear signal generating means for producing a clear signal, and (h) third control means responsive to said clear signal for clearing all the modes of operation established in said image producing means by said first control means.

11. An image duplicating apparatus as set forth in claim 10, in which said clear signal generating means comprises means for counting time after said modes of operation have been selected by said mode designating switches and a switch for producing a signal effective to initialize said image producing means.

12. An image duplicating apparatus as set forth in claim 10, in which said third control means is operative to maintain the modes of operation established in said image producing means by said second control means in response to said clear signal.

13. An image duplicating apparatus including (a) image producing means for producing a visible image corresponding to an original image, the image producing means having a plurality of modes of operation including first and second initial modes of operation, comprising (b) a plurality of mode designating switches each for designating each of said modes of operation for temporary use, (c) first control means responsive to the designation by each of said designating switches for establishing in said image producing means the mode of operation designated by the particular designating switch, (d) first memory means for storing data representative of said first initial mode of operation of said image producing means, (e) second memory means for storing data representative of said second initial mode of operation of said image producing means, (f) memory select switch means for selecting one of said first and second memory means, (g) clear signal generating means for producing a clear signal, (h) second control means for clearing the modes of operation established in said image producing means by said first control means and establishing in said image producing means said first initial mode of operation represented by the data fetched from said first memory means when the first memory means is selected for operation by said memory select switch means, and (i) third control means for clearing the modes of operation established in said image producing means by said first control means and establishing in said image producing means said second initial mode of operation represented by the data fetched from said second memory means when the second memory means is selected for operation by said memory select switch means.

14. An image duplicating apparatus as set forth in claim 13, in which said clear signal generating means comprises means for counting time after said modes of operation have been selected by said mode designating switches and a switch for producing a signal effective to initialize said image producing means.

15. An image duplicating apparatus as set forth in claim 13, in which said mode designating switches include a switch which is operative to establish said second initial mode of operation in said image producing means.

16. An image duplicating apparatus as set forth in claim 13, in which said mode designating switches include a switch which is operative to establish said second initial mode of operation in said image producing means when the second memory means is selected for operation by said memory select switch means.

17. An image duplicating apparatus having different optional copying conditions and modes of operation available therein and predetermined ordinary and non-ordinary operational states, including (a) a main module for producing a visible image corresponding to an original image, said different optional copying conditions and modes of operation including those related to said main module, and (b) a subsidiary module having a first condition operatively uncoupled from said main module and a second condition operable in combination with said main module, said different optional copying conditions and modes of operation including those related to said subsidiary module, comprising (c) first selecting means for selecting any ones of said optional copying conditions and modes of operation under each of said ordinary and non-ordinary operational states, (d) display means for visually displaying the selected ones of said optional copying conditions and modes of operation, (e) second selecting means for selecting one of said ordinary and non-ordinary operational states, (f) inhibitive means for inhibiting selection of said different optional copying conditions and modes of operation related to said subsidiary module if said subsidiary module is in said first condition under said ordinary operational state, (g) selection allowing means for allowing selection of said different optional copying conditions and modes of operation related to said subsidiary module if said subsidiary module is in said first condition under said non-ordinary operational state, (h) means for producing an instruction to display on said display means those optional copying conditions and modes of operation allowed for selection by said selection allowing means, (i) memory means for storing data representative of said optional copying conditions and modes of operation allowed for selection by said selection allowing means under said non-ordinary operational state, (j) data fetch means for producing an instruction to fetch at least a portion of the data stored in said memory means, and (k) control means responsive to the instruction from said data fetch means under said ordinary operational state for establishing in said apparatus the optional copying conditions and modes of operation represented by the data fetched from said memory means.

18. An image duplicating apparatus including (a) a main module for producing a visible image corresponding to an original image, (b) a subsidiary module having a first state operable in combination with said main module and a second state operatively uncoupled from said main module, (c) memory means, and (d) data input means for entering into the memory means data representative of conditions in which said visible image is to be produced by said main module, comprising (e) instruction output means for producing an instruction to fetch at least a portion of said data from said memory means, (f) discriminating means for determining whether or not at least one of said main and subsidiary modules is, at a given point of time, in a state operable under the conditions represented by the data fetched from said memory means and discriminating at least one condition under which at least one of said main and subsidiary modules is operable at said given point of time and at least one condition under which at least one of said main and subsidiary modules is inoperable at said given point of time, (g) first control means for establishing, in at least one of said main and subsidiary modules and substantially at said given point of time, said condition under which at least one of said main and subsidiary modules is operable at said given point of time, (h) said memory means being further operative to memorize, substantially at said given point of time, said condition under which at least one of said main and subsidiary modules is inoperable at said given point of time, and (i) second control means for establishing, in at least one of said main and subsidiary modules, said condition under which at least one of said main and subsidiary modules is inoperable at said given point of time, wherein said condition under which at least one of said main and subsidiary modules is inoperable at said given point of time is established in at least one of said main and subsidiary modules by said second control means if and when at least one of said main and subsidiary modules is thereafter determined by said discriminating means to be in a state operable under the condition under which at least one of said main and subsidiary modules is inoperable at said given point of time.

* * * * *